US008982168B2

(12) United States Patent
Maeda et al.

(10) Patent No.: US 8,982,168 B2
(45) Date of Patent: Mar. 17, 2015

(54) IMAGE FORMING APPARATUS

(71) Applicant: Canon Kabushiki Kaisha, Tokyo (JP)

(72) Inventors: Yasukazu Maeda, Yokohama (JP); Kiyoto Toyoizumi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/281,718

(22) Filed: May 19, 2014

(65) Prior Publication Data

US 2014/0347430 A1 Nov. 27, 2014

(30) Foreign Application Priority Data

May 21, 2013 (JP) ..... 2013-107467
May 21, 2013 (JP) ..... 2013-107468
May 21, 2013 (JP) ..... 2013-107469

(51) Int. Cl.
*B41J 2/385* (2006.01)
*G03G 15/043* (2006.01)

(52) U.S. Cl.
CPC ..... *G03G 15/043* (2013.01)
USPC ..... 347/118

(58) Field of Classification Search
USPC ..... 347/118, 130, 132–135, 137, 138, 224, 347/237, 238, 241–245, 247
See application file for complete search history.

(56) References Cited

U.S. PATENT DOCUMENTS 8,432,426 B2 * 4/2013 Sakamoto et al. ..... 347/134
8,773,482 B2 * 7/2014 Tomioka ..... 347/132
2002/0048072 A1 * 4/2002 Ishihara ..... 347/134
2011/0221847 A1 * 9/2011 Takezawa ..... 347/118
2011/0304683 A1 * 12/2011 Ishida et al. ..... 347/224
2012/0147119 A1 6/2012 Toyoizumi et al.
2012/0230705 A1 9/2012 Shimura et al.
2014/0072318 A1 3/2014 Hayakawa

FOREIGN PATENT DOCUMENTS

JP P2003-305882 A 10/2003
JP P2012-137743 A 7/2012
JP P2012-189886 A 10/2012

* cited by examiner

*Primary Examiner* — Kristal Feggins

(74) *Attorney, Agent, or Firm* — Canon U.S.A., Inc. IP Division

(57) ABSTRACT

A light irradiating device causes a light source to emit light with normal emitted light quantity sufficient for adhering toner on a photosensitive member, on an image portion of the photosensitive member, and causes the light source to emit light with minute emitted light quantity sufficient for preventing toner from being adhered on the photosensitive member, which is smaller than normal emitted light quantity. The light irradiating device includes a determining unit to determine a reference value input to the light irradiating device. Minute emitted light quantity is set based on the reference value input to the light irradiating device. The determining unit determines the reference value to be input to the light irradiating device based on information of relationship between a predetermined reference value and the light quantity in the position of the photosensitive member when causing the light source to emit light, based on the predetermined reference value.

37 Claims, 37 Drawing Sheets

| | LIGHT QUANTITY AT PHOTOSENSITIVE DRUM SURFACE [μW] |
|---|---|
| MAXIMUM USED LIGHT QUANTITY | 45 |
| MINIMUM USED LIGHT QUANTITY | 8.6 |

| PWM2 SIGNAL Duty [%] | Vref21 [V] | MEASURED LIGHT QUANTITY AT PHOTOSENSITIVE DRUM SURFACE POSITION [μW] |
|---|---|---|
| 0 | 1.25 | 48 |
| 60 | 0.50 | 19.2 |
| 80 | 0.25 | 8.6 |

FIG. 10

| TARGET LIGHT QUANTITY AT PHOTOSENSITIVE DRUM SURFACE POSITION [$\mu$W] | Duty VALUE OF PWM2 SIGNAL [%] |
|---|---|
| 45 | 6 |
| 19.2 | 60 |
| 8.6 | 80 |

FIG. 18

| NUMBER OF DRUM ROTATIONS [×1000] | EMITTED LIGHT QUANTITY FOR MINUTE EMISSION [mW] | MINUTE EMISSION DROOP TIME [μsec] | EMITTED LIGHT QUANTITY FOR NORMAL EMISSION [mW] |
|---|---|---|---|
| $0 \leq r < 37.5$ | 0.42 | 60.0 | 3.50 |
| $37.5 \leq r < 75$ | 0.66 | 45.0 | 4.20 |
| $75 \leq r < 112.5$ | 0.95 | 36.5 | 5.04 |
| $112.5 \leq r < 150$ | 1.30 | 26.0 | 5.74 |
| $150 \leq r$ | 1.68 | 13.5 | 6.44 |

FIG. 30A

| NUMBER OF PRINTS (SHEETS) | PHOTOSENSITIVE DRUM (5Y, 5M, 5C, 5K) USAGE STATE | LD401Y LD401K EMITTED LIGHT QUANTITY (TARGET VALUE) | LD401M LD401C EMITTED LIGHT QUANTITY (TARGET VALUE) |
|---|---|---|---|
| 0 TO 400 | FIRST STAGE | P(a1) | P(b1) |
| 401 TO 800 | MIDDLE STAGE | P(a2) | P(b2) |
| 801 TO 1200 | LAST STAGE | P(a3) | P(b3) |

FIG. 30B

| NUMBER OF PRINTS (SHEETS) | PHOTOSENSITIVE DRUM (5Y, 5M, 5C, 5K) USAGE STATE | LD401Y LD401K EMITTED LIGHT QUANTITY (TARGET VALUE) | LD401M LD401C EMITTED LIGHT QUANTITY (TARGET VALUE) |
|---|---|---|---|
| 0 TO 400 | FIRST STAGE | P(c1) | P(d1) |
| 401 TO 800 | MIDDLE STAGE | P(c2) | P(d2) |
| 801 TO 1200 | LAST STAGE | P(c3) | P(d3) |

FIG. 36A

| NUMBER OF PRINTS (SHEETS) | PHOTOSENSITIVE DRUM (5Y, 5M, 5C, 5K) USAGE STATE | LD401Y LD401K EMITTED LIGHT QUANTITY (TARGET VALUE) | | LD401M LD401C EMITTED LIGHT QUANTITY (TARGET VALUE) | |
|---|---|---|---|---|---|
| | | EXPOSURE AMOUNT | APC TIME WIDTH | EXPOSURE AMOUNT | APC TIME WIDTH |
| 0 TO 400 | FIRST STAGE | P(a1) | Ta1 | P(b1) | Tb1 |
| 401 TO 800 | MIDDLE STAGE | P(a2) | Ta2 | P(b2) | Tb2 |
| 801 TO 1200 | LAST STAGE | P(a3) | Ta3 | P(b3) | Tb3 |

FIG. 36B

| NUMBER OF PRINTS (SHEETS) | PHOTOSENSITIVE DRUM (5Y, 5M, 5C, 5K) USAGE STATE | LD401Y LD401K EMITTED LIGHT QUANTITY (TARGET VALUE) | | LD401M LD401C EMITTED LIGHT QUANTITY (TARGET VALUE) | |
|---|---|---|---|---|---|
| | | EXPOSURE AMOUNT | APC TIME WIDTH | EXPOSURE AMOUNT | APC TIME WIDTH |
| 0 TO 400 | FIRST STAGE | P(c1) | Tc1 | P(d1) | Td1 |
| 401 TO 800 | MIDDLE STAGE | P(c2) | Tc2 | P(d2) | Td2 |
| 801 TO 1200 | LAST STAGE | P(c3) | Tc3 | P(d3) | Td3 |

IMAGE FORMING APPARATUS

BACKGROUND OF THE INVENTION

1. Field of the Invention

The present invention relates to an image forming apparatus such as a laser printer, a copier, or the like that utilizes an electrophotography recording method.

2. Description of the Related Art

An image forming apparatus utilizing an electrophotographic method includes an optical scanning device configured to condense laser light emitted from a laser diode to form an image on a photosensitive member by a lens and expose the photosensitive member. The optical scanning device performs, in order to maintain desired image quality under various exposure conditions, adjustment so that the amount of laser light emitted from the laser diode becomes a desired value.

Specifically, in a case of exposing the photosensitive member using light emitted from the chip front side of the laser diode, laser light emitted from behind the chip is received at a photodiode disposed behind the chip. Next, so-called auto power control (APC) is performed for adjusting the amount of emitted laser light based on output from this photodiode. Japanese Patent Laid-Open No. 2003-305882 describes, regarding APC, a method for adjusting the amount of light emitted from a laser diode by feeding back a comparison value between a voltage value converted from monitor current generated based on the amount of received light detected at the photodiode and a reference voltage value set from a duty value of a pulse width modulation (PWM) signal. The reason why the amount of emitted laser light is adjusted using the light received behind the chip is based on a premise that the amount of light that is emitted from behind the chip and received by the photodiode is proportional to the amount of light emitted from the front of the chip to form an image on the photosensitive member. That is to say, detecting laser light emitted from behind the chip is substantially the same as detecting light emitted from the front of the chip to form an image on the photosensitive member.

High image quality has increasingly been demanded for image forming apparatuses using the electrophotography method in recent years. For example, the image forming apparatus disclosed in Japanese Patent Laid-Open No. 2012-137743 irradiates locations of the photosensitive member where toner is to be adhered with laser light at a normal emission level (first emission level) for normal printing. In addition, the image forming apparatus suppresses occurrences such as a normal fogging phenomenon and so forth by irradiating a location of the photosensitive member on which no toner is adhered, thereby forming an image with high image quality with laser light at a minute emission level (second emission level) lower than the emission level for normal printing.

SUMMARY OF THE INVENTION

The present disclosure provides a configuration for performing irradiation of laser light with the above minute emission level (second emission level) at suitable light quantity or timing.

The present disclosure also provides an image forming apparatus including a photosensitive member; a light irradiating device, which includes a light source, configured to irradiate light that the light source emits on the photosensitive member; a developing device configured to adhere toner on the photosensitive member; and a determining unit configured to determine a reference value to be input to the light irradiating device. The light irradiating device causes the light source to emit light with normal emitted light quantity sufficient for adhering toner on an image portion of the photosensitive member, and causes the light source to emit light with minute emitted light quantity smaller than normal emitted light quantity sufficient for preventing toner from being adhered on a non-image portion of the photosensitive member. The minute emission amount is set based on the reference value to be input to the light irradiating device. The determining unit determines the reference value to be input to the light irradiating device based on information relating to relationship between a predetermined reference value, and the light quantity in the position of the photosensitive member at the time of causing the light source to emit light based on the predetermined reference value.

Also, the present disclosure provides an image forming apparatus including: a photosensitive member; a light irradiating device, which includes a light source, configured to irradiate light that the light source emits on the photosensitive member; a developing device configured to adhere toner on the photosensitive member; and a determining unit configured to determine a reference value to be input to the light irradiating device. The light irradiating device causes the light source to emit light with normal emitted light quantity sufficient for adhering toner on an image portion of the photosensitive member, and causes the light source to emit light with minute emitted light quantity smaller than the amount of normal light sufficient for preventing toner from being adhered on a non-image portion of the photosensitive member. The minute emission amount is set based on the reference value to be input to the light irradiating device. The determining unit determines the reference value to be input to the light irradiating device based on information relating to relationship between predetermined light quantity, and a reference value for causing the light source to emit light so that the light quantity at the position of the photosensitive member becomes the predetermined light quantity.

Further features of the present invention will become apparent from the following description of exemplary embodiments with reference to the attached drawings.

BRIEF DESCRIPTION OF THE DRAWINGS

FIG. 10 is diagram illustrating relationship between target light quantity and the duty value of a PWM2 signal.

FIG. 18 is a diagram illustrating an example of a table in which state of usage of a photosensitive drum, normal emitted light quantity, and minute emitted light quantity are associated.

FIGS. 30A and 30B are diagrams illustrating target values of the amount of first light and the amount of second light corresponding to the state of usage of the photosensitive drum.

FIGS. 36A and 36B are diagrams illustrating the target values of the amount of the first light and the amount of the second light corresponding to the state of usage of the photosensitive drum.

DESCRIPTION OF THE EMBODIMENTS

Specific configurations of the present invention will be described based on the following embodiments. Components described in the embodiments are just exemplifications, which do not restrict the scope of the present invention to those alone.

First Embodiment

In the case of performing minute emission, the amount of light which is irradiated on a photosensitive member may differ at the time of causing a laser diode chip to emit minute light depending on optical scanning devices due to individual difference such as a laser diode chip, other driving circuits, lenses, and so forth. Therefore, image defects may occur since, in some cases, minute emission is performed with unsuitable light quantity, and the potential of a portion of the photosensitive member where minute emission has been performed is not normalized. The present embodiment will describe a configuration configured to irradiate laser light of a minute emission level (second emission level) with suitable light quantity.

Image Forming Apparatus

Figure 2:
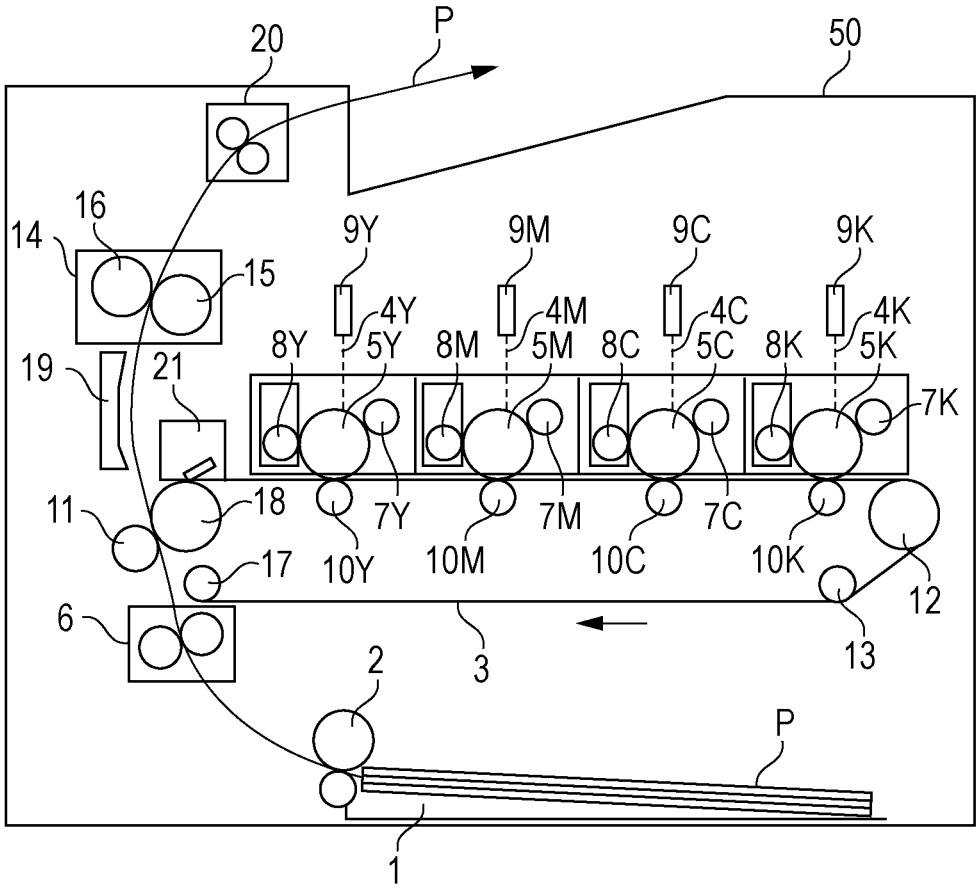
FIG. 2 is a schematic cross-sectional view of an image-forming device.

FIG. 2 is a schematic cross-sectional view of a color image forming apparatus. Note that, though description will be made below using the color image forming apparatus, the present invention is not restricted to this. Minute emission of a non-image portion, which will be described later in detail, may also be applied to a monochromatic image forming apparatus, for example. Also, though description will be made below with a color image forming apparatus conforming to the in-line method as an example, there may be employed a color image forming apparatus conforming to the rotary method. Hereinafter, the color image forming apparatus conforming to the in-line method will be described as an example.

As illustrated in FIG. 2, a color laser printer 50 includes multiple photosensitive drums 5 (5Y, 5M, 5C, and 5K) which are photosensitive members, and is a printer configured to consecutively perform multi-transfer on an intermediate transfer belt 3 to obtain a full-color print image.

The intermediate transfer belt 3 is an endless belt in a no end shape, and is suspended on a driving roller 12, a tension roller 13, an idler roller 17, and an opposing roller 18 for secondary-transfer, and is rotated in an arrow direction in FIG. 2 at process speed of 115 mm/sec. The driving roller 12, tension roller 13, and opposing roller 18 for secondary-transfer are support rollers configured to support the intermediate transfer belt 3. The driving roller 12 and opposing roller 18 for secondary-transfer have a 24-mm diameter configuration, and the tension roller 13 has a 16-mm diameter configuration.

The four photosensitive drums 5 (5Y, 5M, 5C, and 5K) are serially disposed in the moving direction of the intermediate transfer belt 3. The photosensitive drum 5Y including a developing device 8Y is evenly subjected to charging processing in a predetermined polarity and potential by a primary charging roller 7Y during a rotation process, and subsequently on which laser light 4Y is irradiated by an optical scanning device 9Y serving as a light irradiating device. Thus, there has been formed an electrostatic latent image corresponding to a first color (yellow) component image of a target color image. Next, yellow toner which is the first color is adhered on the electrostatic latent image thereof and developed by a first developing device (yellow developing device) 8Y. Thus, visualization of the image is performed. Such a method for toner being developed on a portion where light is irradiated and an electrostatic latent image is formed will be referred to as "reversal developing method".

The yellow toner image formed on the photosensitive drum 5Y enters a primary transfer nip portion connected to the intermediate transfer belt 3. The primary transfer nip portion causes a bias applying member (primary transfer roller) 10Y to be in contact with the rear side of the intermediate transfer belt 3. The bias applying member 10Y is connected with a primary transfer bias power source which is not illustrated for enabling a bias to be applied. First, the yellow toner image is transferred to the intermediate transfer belt 3 through a first color port.

Next, from the photosensitive drums 5M, 5C, and 5K on which magenta, cyan, and black toner images have been formed through a process equivalent to the above yellow process, the magenta, cyan, and black toner images are sequentially multi-transferred onto the yellow toner image. The four toner images transferred onto the intermediate transfer belt 3 are moved rotating in an arrow (clockwise) direction in FIG. 2 along with the intermediate transfer belt 3.

On the other hand, a recording material P stacked and stored in a sheet supplying cassette 1 is fed by a paper feeding roller 2, conveyed to a nip portion of a registration roller pair 6, and temporarily stopped. The temporarily stopped recording material P supplied to the secondary transfer nip by the registration roller pair 6 in sync with timing of the four color toner images formed on the intermediate transfer belt 3 arriving at a secondary transfer nip. Next, the toner images on the intermediate transfer belt 3 are transferred onto the recording material P by bias application (about +1.5 kV) between a secondary transfer roller 11 and the opposing roller 18 for secondary-transfer.

The recording material P on which the toner images have been transferred is separated from the intermediate transfer belt 3 and fed to a fixing device 14 via a conveyance guide 19, where the recording material P receives heating and pressurization from a fixing roller 15 and a pressurizing roller 16 respectively and the toner images are fused and fixed on the surface of the recording material P. Thus, a four-full-color image is obtained. Thereafter, the recording material P is externally discharged from a discharge roller pair 20, and one cycle in printing is ended. On the other hand, toner remaining on the intermediate transfer belt 3 without being transferred to the recording material P in the secondary transfer portion is removed by a cleaning unit 21 disposed further downstream than the secondary transfer portion.

The above is description of the image forming apparatus and operation thereof.

The image forming apparatus according to the present embodiment irradiates, in order to suppress normal fogging, reverse fogging, or other image defects, light of minute emission quantity on a portion of the surfaces of the photosensitive drums 5 where toner is not adhered (non-image portion) using optical scanning devices 9 (9Y, 9M, 9C, and 9K). The light of minute emission quantity is irradiated on the photosensitive drums 5, thereby changing the potentials of the surfaces of the photosensitive drums 5 to a suitable potential sufficient for preventing toner from being adhered. Note that the optical scanning devices 9 (9Y, 9M, 9C, and 9K) irradiates, in order to change the potentials of the surfaces of the photosensitive drums 5 to a suitable potential sufficient for adhering toner, light of normal emission quantity on a portion of the surfaces of the photosensitive drums 5 where toner is adhered.

Next, hereinafter, description will be made first regarding an external appearance view of the optical scanning device 9 serving as the optical scanning devices 9 (9Y, 9M, 9C, and 9K) in connection with the laser driving system, and thereafter, detailed description will be made regarding the circuit configuration of the laser driving system.

Optical Scanning Devices

Figure 1:
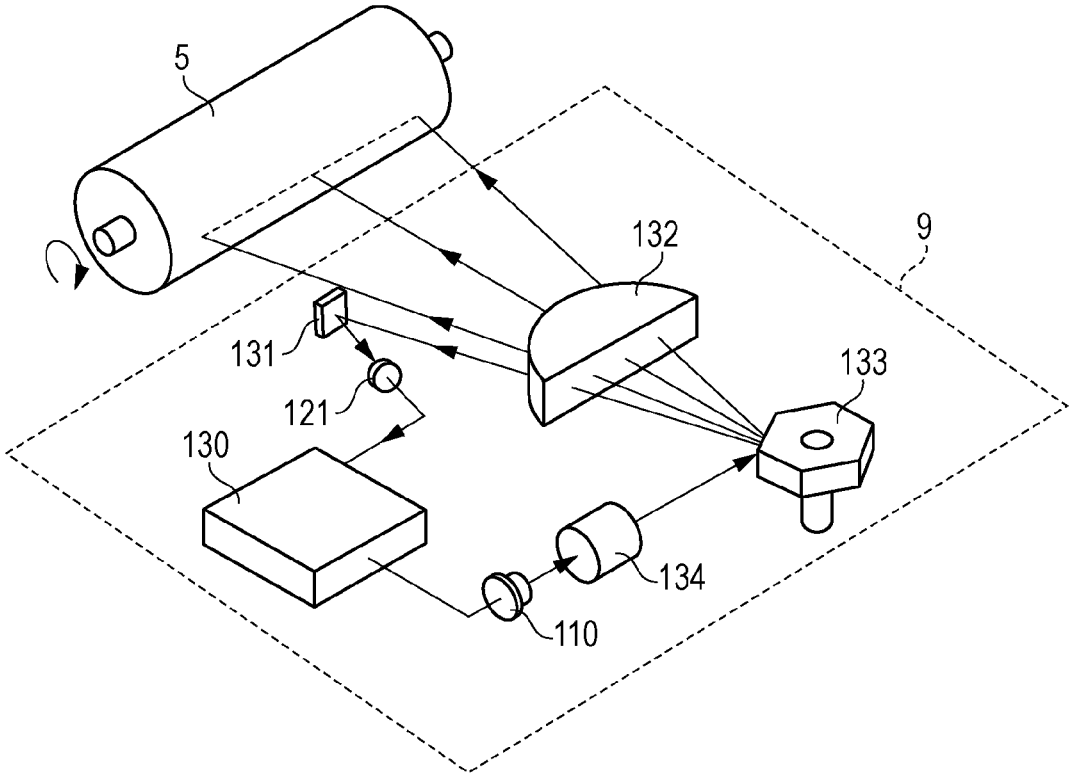
FIG. 1 is a schematic perspective view of an optical scanning device.

FIG. 1 illustrates a schematic view of the optical scanning device 9 serving as a light irradiating device. Note that, since the optical scanning devices 9Y, 9M, 9C, and 9K have the same configuration, description will be made below regarding a representing optical scanning device 9. Driving current is applied to a laser diode element 110 which is a light emitting element by a laser driving circuit 130. The laser diode element 110 emits laser light of light quantity according to the applied driving current. The laser driving circuit 130 is a circuit electrically connected to an engine controller 122 and a video controller 123, and is a circuit for driving the laser diode element 110, which will be described later.

The laser light emitted from the laser diode element 110 of which the beam shape is shaped and converted into parallel light by a collimator lens 134, and then input to a rotating polygon mirror 133. The laser light is reflected at the polygon mirror 133 and transmits through an fθ lens 132, and forms an image on the photosensitive drums 5 as a dot-shaped spot. The polygon mirror 133 is rotated, whereby the laser light is deflected, and the spot of the laser light moves in the rotation axial direction of the photosensitive drums 5. In addition to the deflection of the laser light due to the rotation of the polygon mirror 133, the photosensitive drums 5 themselves are rotated, whereby the laser light scans on the photosensitive drums 5, and forms a latent image.

On the other hand, when assuming that a portion where the laser light reflected at the polygon mirror 133 passes through at the time of being irradiated on the photosensitive drums 5 is a scan region, a mirror 131 is provided adjacent to one end portion of the scan region in the scan direction (the rotation axial direction of the photosensitive drums 5) of the laser light. A beam detect (BD) sensor 121 is disposed on the optical path of the laser light reflected at the mirror 131, and when detecting input of the laser light, the BD sensor 121 outputs a signal. Thus, the laser light is detected by the BD sensor 121, whereby the rotated phase of the polygon mirror 133 can be detected. In order to start scanning by the laser light from a desired position on the photosensitive drums 5, the emission start timing of the laser light for starting scanning is determined based on the output from the above BD sensor 121.

While rotating the polygon mirror 133 to scan a latent image, in order to obtain the output from the BD sensor 121 for each reflecting surface of the polygon mirror 133 by inputting the laser light to the BD sensor 121, the laser diode element 110 is forced to emit light for a certain period of time from predetermined timing. The predetermined timing is timing of the polygon mirror 133 rotating a predetermined angle to enable the laser light to be input to the BD sensor 121 with timing of obtaining the output from the BD sensor 121 last time as a reference. This predetermined angle generally corresponds to an angle range where one reflecting surface of the multiple reflecting surfaces of the polygon mirror 133 reflects laser light. As illustrated in FIG. 1, in the case that the polygon mirror 133 is a 6-surface polygon mirror, an angle range that is scanned by one reflecting surface is 60 degrees (360/6 degrees), and the above predetermined angle is set to 60 degrees or less. Accordingly, the laser diode element 110 is forcibly made to emit light for a certain period of time at predetermined timing after obtaining the output from the BD sensor 121, whereby the next output can be obtained from the BD sensor 121.

While the laser diode element 110 is forced to emit light, auto power control (APC) which is automatic light quantity control for adjusting the amount of laser emission is performed at the same time. This APC will be described later in detail.

Laser Driving Circuit Diagram

Figure 3:
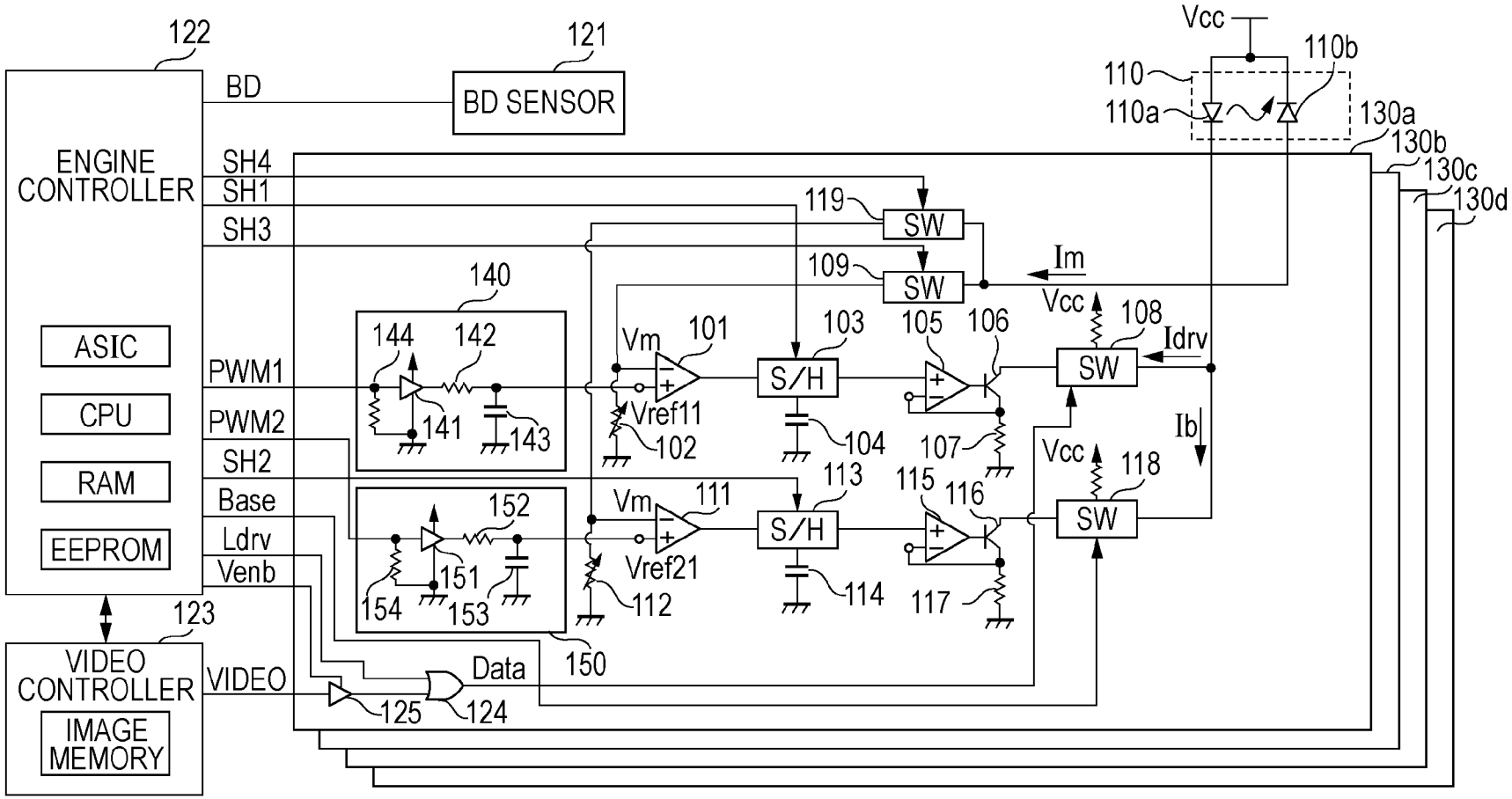
FIG. 3 is a diagram illustrating a laser driving circuit.

FIG. 3 is a diagram illustrating laser driving circuits and connection relations thereof. Laser driving circuits 130*a*, 130*b*, 130*c*, and 130*d* illustrated in FIG. 3 are equivalent to representative the laser driving circuit 130 described by way of FIG. 1, and these are all of the same circuit configuration. Therefore, the laser driving circuit 130*a* will be described below representatively.

The laser driving circuit 130*a* is a circuit serving as an adjusting device capable of adjusting the amount of light of the laser diode element 110 at the time of performing minute emission so as not to adhere toner on the surfaces of the photosensitive drums 5. The laser driving circuit 130*a* is connected with the laser diode element 110, engine controller 122, and video controller 123. A synchronous signal detecting element (BD detecting element) 121 is connected to the laser driving circuit 130*a* via the engine controller 122.

The laser driving circuit 130*a* includes comparator circuits 101 and 111, variable resistors 102 and 112, sampling-and-hold circuits 103 and 113, hold capacitors 104 and 114, operational amplifiers 105 and 115, and transistors 106 and 116. Also, the laser driving circuit 130*a* includes switching current setting resistors 107 and 117, switching circuits 108, 109, 118, and 119, inverters 141 and 151, resistors 142 and 152 configured to smooth PWM1 and PWM2 signals, capacitors 143 and 153 configured to smooth PWM1 and PWM2 signals, and pull-down resistors 144 and 154. The portions 101 to 109 and 141 to 144 are equivalent to a light quantity adjustment device of a first emission level, and the portions 111 to 119 and 151 to 154 are equivalent to a light quantity adjustment device of a second emission level, which will be described later in detail.

The laser diode element 110 includes a laser diode 110*a* (hereinafter, referred to as LD 110*a*) serving as a light source, and a photodiode 110*b* (hereinafter, referred to as PD 110*b*) serving as a light receiving element. The light emitted from the front of the LD 110*a* chip transmits through the above collimator lens 134, reaches on the surfaces of the photosensitive drums 5 via the polygon mirror 131 and fθ lens 132, and forms an image. On the other hand, the light emitted from behind the LD 110*a* chip is received at the PD 110*b*.

The engine controller 122 houses an application specific integrated circuit (ASIC), a central processing unit (CPU), random access memory (RAM), and electrically erasable programmable read-only memory (EEPROM), and controls the printer engine. Also, the engine controller 122 also performs communication control with the video controller 123. An OR circuit 124 is connected to a Ldrv signal of the engine controller 122 and a VIDEO signal from the video controller 123 at input terminals thereof, and an output signal Data therefrom is connected to the switching circuit 108. Note that the VIDEO signal is generated based on print data transmitted from an external device such as an externally connected reader scanner, host computer, or the like.

The VIDEO signal output from the video controller 123 is input to a buffer 125 with an enable terminal, and output of the buffer 125 is connected to the above OR circuit 124. At this time, the enable terminal is connected to a Venb signal from the engine controller 122. Also, the engine controller 122 is connected to the video controller 123 so as to output a later-described SH1 signal, SH2 signal, SH3 signal, SH4 signal, and Base signal, and the Ldrv signal and Venb signal.

A first reference voltage Vref11 and a second reference voltage Vref21 are input to the positive-electrode terminals of the comparator circuits 101 and 111 respectively, and outputs thereof are input to the sampling-and-hold circuits 103 and 113 respectively. The reference voltage Vref11 is set as target voltage to cause the LD 110*a* to emit light with the amount of light for normal emission (first emission level). Also, the reference voltage Vref21 is set as target voltage of the amount of light for minute emission (second emission level lower than the first emission level). The PWM1 signal (duty value) and PWM2 signal (duty value) which are reference values for setting the reference voltage Vref11 and reference voltage Vref21 are each input from the engine controller 122. The hold capacitors 104 and 114 are connected to the sampling-and-hold circuits 103 and 113, respectively. The outputs of the hold capacitors 104 and 114 are input to the positive-electrode terminals of the operational amplifiers 105 and 115, respectively.

The negative-electrode terminal of the operational amplifier 105 is connected with the resistor 107 for setting switching current, and the emitter terminal of the transistor 106, and output thereof is input to the base terminal of the transistor 106. The negative-electrode terminal of the operational amplifier 115 is connected with the resistor 117 for setting switching current, and the emitter terminal of the transistor 116, and output thereof is input to the base terminal of the transistor 116. Also, the collector terminals of the transistors 106 and 116 are connected with the switching circuits 108 and 118, respectively. According to the operational amplifiers 105 and 115, transistors 106 and 116, and resistors 107 and 117 for setting current, there are determined the driving current Idrv and Ib of the LD 110*a* according to the output voltages of the sampling-and-hold circuits 103 and 113.

The switching circuit 108 is turned on/off by a pulse modulation data signal Data. The switching circuit 118 is turned on/off by an input signal Base.

The output terminals of the switching circuits 108 and 118 are connected with the cathode of the LD 110*a*, and supply the driving currents Idrv and Ib thereto. The anode of the LD 110*a* is connected with power supply Vcc. The cathode of the PD 110*b* configured to monitor the amount of light of the LD 110*a* is connected with the power supply Vcc, and the anode of the PD 110*b* is connected with the switching circuits 109 and 119. Monitor current Im is applied to the variable resistors 102 and 112 at the time of APC control, thereby converting the minor current Im into monitor voltage Vm. This monitor voltage Vm is input to the negative-electrode terminals of the comparator circuits 101 and 111.

Note that, though FIG. 3 separately illustrates the engine controller 122 and video control 123, the present invention is not restricted to this mode. For example, part or all of the engine controller 122 and video controller 123 may be constructed by the same controller. Also, part or all of the laser driving circuits 130*a*, 130*b*, 130*c*, and 130*d* may also be housed in the engine controller 122, for example.

APC for Minute Emission

Description will be made regarding a case where APC control is performed with the amount of light for minute emission, with reference to FIG. 3. The engine controller 122 sets the sampling-and-hold circuit 103 to a hold state according to the instruction of the SH1 signal, and also sets the switching circuit 108 to an off operating state according to the input signal Data. The engine controller 122 sets, regarding the input signal Data, the Venb signal connected with the enable terminal of the buffer 125 with an enable terminal to a disabled state, and controls the Ldrv signal to turns off the input signal Data. Also, the engine controller 122 sets the sampling-and-hold circuit 113 to during sampling operation according to the instruction of the SH2 signal, and turns off the switching circuit 109 according to the instruction of the SH3 signal. Also, the engine controller 122 turns on the switching circuit 119 according to the instruction of the SH4 signal, and turns on, according to the input signal Base, the switching circuit 118, and sets the LD 110*a* to a minute emission state.

In this state, upon the LD 110*a* being set to the minute emission state, the PD 110*b* receives light emitted to behind the LD 110*a* chip, and generates the monitor current Im proportional to the amount of the received light (outputs a signal). Here, substantially the same light is emitted in front of and behind the LD 1110*a*, so the monitor current Im becomes current proportional to the amount of light emitted from the front of the LD 110*a* chip. The monitor current Im is applied to the variable resistor 112, thereby converting the monitor current Im into monitor voltage Vm2. Also, the comparator circuit 111 adjusts the driving current Ib of the LD 110*a* via the operational amplifier 115 and so forth so that the monitor voltage Vm2 agrees with the reference voltage Vref21 set by the reference value PWM2. Further, the comparator circuit 111 charges or discharges the capacitor 114. During non-APC operation, that is, at the time of normal image formation, the sampling-and-hold circuit 113 goes into the hold state, thereby maintaining voltage charged in the capacitor 114, and applying the fixed driving current Ib, thereby maintaining the amount of light emitted from the LD 110*a* so as to obtain the minute emission state of the desired amount of light. This desired amount of light (minute emission level) P (Ib) means the amount of light for setting the potentials of the surfaces of the photosensitive drums 5 to a potential sufficient for preventing toner from being adhered on the photosensitive drums 5 by preventing normal fogging, reverse fogging, and so forth.

APC for Normal Emission

Next, description will be made regarding a case where APC control is performed with the amount of light for normal emission, with reference to FIG. 3. When causing the LD 110*a* to emit light with the amount of light for normal emission, the circuits in FIG. 3 are operated as follows. The engine controller 122 sets the sampling-and-hold circuit 103 to the sample state and the sampling-and-hold circuit 113 to the hold state, and turns on the switching circuit 109 according to the instruction of the SH3 signal, and also turns off the switching circuit 119 according to the instruction of the SH4 signal. The engine controller 122 causes the switching circuits 108 and 118 to perform on operation. In this state, upon the LD 110*a* going into the normal emission state, the PD 110*b* monitors the amount of light emitted from the LD 110*a*, and generates monitor current Im proportional to the amount of light thereof. The monitor current Im is applied to the variable resistor 102, thereby converting the minor current Im into monitor voltage Vm1. Also, the comparator circuit 101 controls the driving current of the LD 110*a* via the operational amplifier 105 and so forth so that the monitor voltage VM1 agrees with the reference voltage Vref11 set by the reference value PWM1. Further, the comparator circuit 101 charges or discharges the capacitor 104. During non-APC operation, that is, at the time of image formation, the sampling-and-hold circuits 103 and 113 go into the hold state, thereby maintaining voltage charged in the capacitor 104, and maintaining the amount of light emitted from the LD 110*a*. That is to say, the driving current Idrv+Ib is supplied to the LD 110*a*. Thus, the amount of light emitted from the LD 110*a* is set so as to emit light with the desired amount of light (normal emission level) P (Idrv+Ib). This normal emission level means the amount of light for setting the potentials of the surfaces of the photosensitive drums 5 to a potential sufficient for adhering toner on the surfaces of the photosensitive drums 5 by irradiating the light of the emission level thereof thereupon.

The engine controller 122 causes the laser driving circuit 130 to operate as described above, thereby performing APC for minute emission and APC for normal emission to enable the LD 110*a* to emit light with the amount of light in two levels of minute emitted light quantity P (Ib) and normal emitted light quantity P (Idrv+Ib).

Operation During Image Formation

Next, description will be made further in detail regarding the operation of the laser driving circuit 130 at the time of image formation. At the time of image formation, a pulse modulation data signal Data serving as a VIDEO signal is transmitted from the video controller 123 to the switching circuit 108 of the laser driving circuit 130 based on the output from the BD sensor 121. According to this pulse modulation data signal Data, the switching circuit 108 switches on/off. This switches whether or not the driving current Idrv is supplied to or not supplied to the LD 110*a*. The switching circuit 108 turns on as to an image portion which is a portion of the surfaces of the photosensitive drums 5 where toner is adhered, and turns off as to a non-image portion which is a portion of the surfaces of the photosensitive drums 5 where no toner is adhered, and the LD 110*a* to which the driving current Idrv is not supplied and the driving current Ib alone is supplied emits light with minute emitted light quantity P (Ib), and irradiates the light.

Thus, according to minute emission, the potential of a portion of the surfaces of the photosensitive drums 5 where no toner is adhered (non-image portion) can be optimized, and image defects can be suppressed, such as normal fogging, reverse fogging, thinning of a toner adhering region due to involvement of an electric field of an edge portion of the image portion, and so forth.

Problem Regarding Minute Emission

There is individual difference regarding the laser diode element 110, the laser driving circuit 130*a* thereof, the optical parts (collimator lens 134, polygon mirror 133, fθ lens 132, etc.) and so forth, and also, there is also error regarding a relative position of these. Therefore, in the case of performing minute emission, light quantity to be irradiated on the photosensitive drums 5 at the time of causing the laser diode chip to perform minute emission may differ for each of the optical scanning devices 9. Accordingly, image defects may occur since, in some cases, minute emission is performed with unsuitable light quantity, and the potential of a portion of the photosensitive member where minute emission has been performed is not normalized.

In particular, minute emission is small in light quantity in comparison with normal emission, and the driving current Ib flowing to the LD 110*a* is small. Therefore, the error of the driving current Ib greatly influences the light quantity, so the driving current Ib has to be set at the optical scanning devices 9 with high precision.

Figures 4, 5:
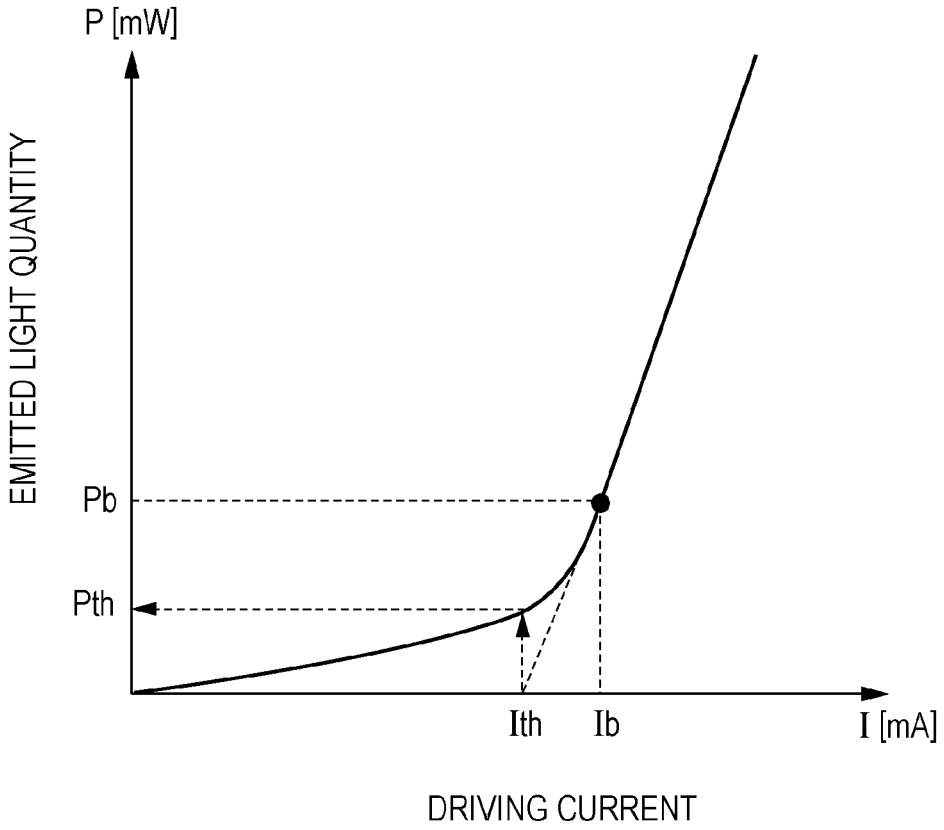
FIG. 4 is a diagram illustrating relationship between current flowing into a laser diode and the amount of emitted light.
FIG. 5 is a diagram illustrating a used light quantity range in minute emission.

Also, FIG. 4 is a diagram illustrating relationship between driving current I supplied to a laser diode, and the amount of light P of the laser diode driven by the driving current I. In general, the laser diode performs LED emission in a low-current area with a threshold value Ith as a boundary and performs laser emission in a high-current area. The driving current Ib at the time of causing the laser diode to emit light with minute emitted light quantity Pb of a minute emission level is set greater than the threshold current Ith.

However, in the case of causing the laser diode to emit light with minute emission using the driving current Ib approximate to the threshold current Ith, the light emitted from the LD 110*a* is approximate to LED emission, the spread angle of light emitted from the emission point of the laser diode to in front of and behind the chip increases. The greater the spread angle increases, the less readily the light emitted from the front of the chip is condensed at the collimator lens 134 or the like, and finally, the ratio of light to reach the surfaces of the photosensitive drums 5 and to form an image decreases in comparison with that when the spread angle is small.

On the other hand, a ratio for the light emitted from behind the chip reaching and received at the PD 110*b* even when the spread angle increases does not change so much in comparison with that when the spread angle is small. Therefore, as the driving current Ib decreases to be approximate to the threshold current Ith, a proportional relation between the amount of light reaching the PD 110*b* and the amount of light reaching on the surfaces of the photosensitive drums 5 collapses. That is to say, in the case of performing APC for minute emission, even when adjusting the driving current Ib so that the amount of received light at the PD 110*b* becomes the desired amount of received light, the amount of light to form an image on the surfaces of the photosensitive drums 5 might actually be lower than the desired amount of light.

Light Quantity Adjustment Process

Next, a process for adjusting the light quantity on the surfaces of the photosensitive drums 5 will be described. The light quantity adjustment process on the surfaces of the photosensitive drums 5 is a process to be implemented in a manufacturing and assembly process of the light scanning device. This light quantity adjustment process is performed by disposing the optical scanning device 9 on a dedicated jig (not illustrated). This jig includes a light receiving element, which is capable of receiving light emitted from the optical scanning device 9 disposed on the jig. The light receiving element is disposed so that position relationship between the optical scanning device 9 disposed on the jig and the light receiving element becomes the same relationship as position relationship between the optical scanning device 9 attached in the color laser printer 50 and a laser light irradiation position on the surfaces of the photosensitive drums 5. Accordingly, detecting the laser light from the optical scanning device 9 at the light receiving element in the jig is the same as detecting the laser light from the optical scanning device 9 at the laser light irradiation position on the surfaces of the photosensitive drums 5. FIG. 5 illustrates the maximum used light quantity and minimum used light quantity on the surfaces of the photosensitive drums 5 at the time of minute emission that are used at the color laser printer 50.

In the light quantity adjustment process, the engine controller 122 first sets the duty value of the PWM2 signal which is a reference value of the amount of light for minute emission to 0%, and implements APC. At this time, the engine controller 122 measures light quantity at the light receiving element of the jig, and adjusts the variable resistor 112 (see FIG. 3) so that the light quantity thereof becomes greater than the maximum used light quantity of 45 μW on the surface of the photosensitive drum 5 in FIG. 5 described above.

Figure 6:
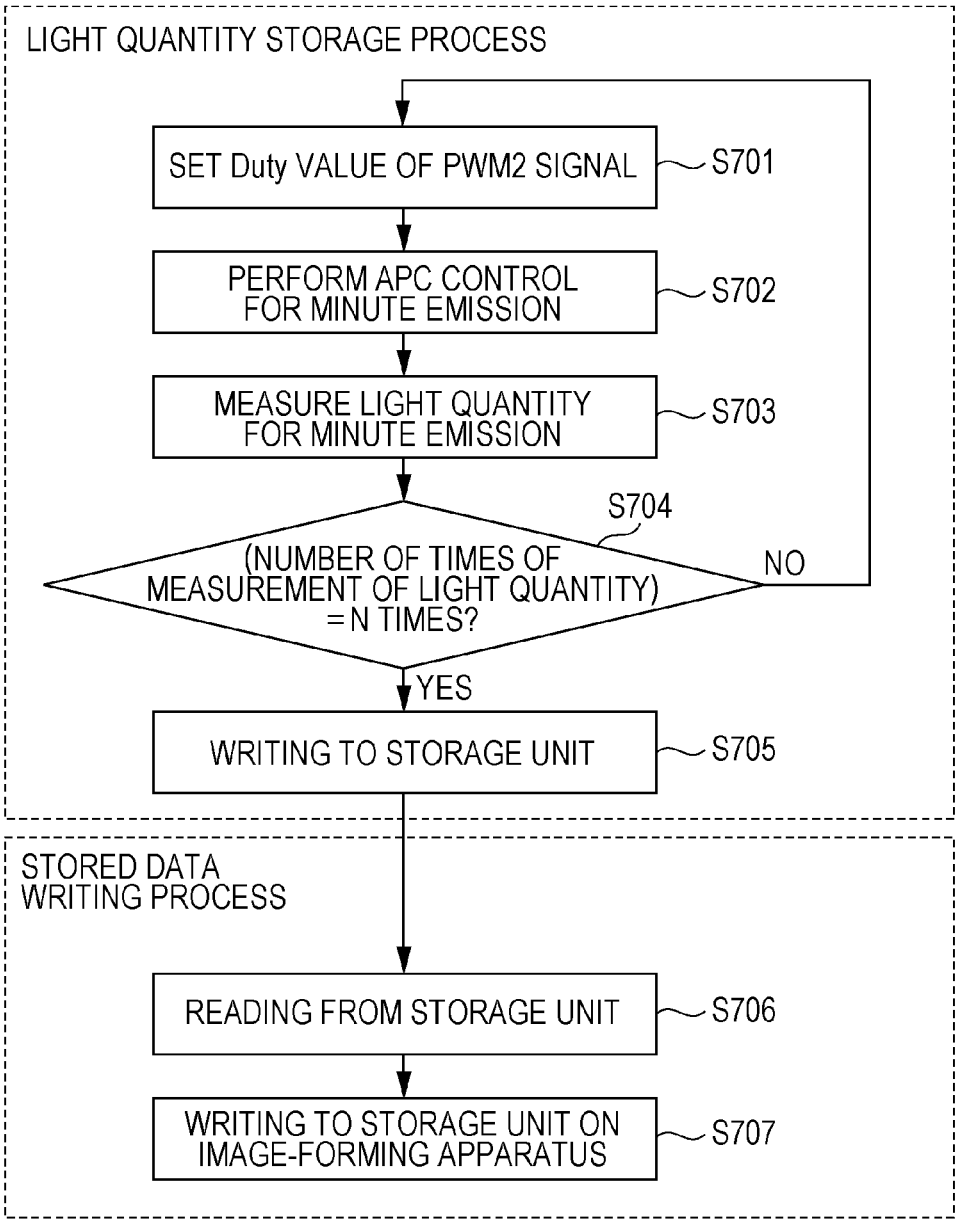
FIG. 6 is a flowchart of a light quantity adjustment process.

Next, description will be made regarding a process to measure a correspondence relation between the duty value of the PWM2 signal and the light quantity on the surfaces of the photosensitive drums 5, and finally to store this in the color laser printer 50. This process is, as illustrated in the flowchart in FIG. 6, divided principally into the following two processes. (1) A light quantity storing process to measure light quantity in minute emission on the surfaces of the photosensitive drums 5, and to store this in the optical scanning device 9, and (2) a stored data writing process to write data stored in the optical scanning device 9 in a storage device of the color laser printer 50.

First, (1) Light quantity storing process will be descried. The light quantity storing process is a process to be implemented in the manufacturing and assembly process of the optical scanning device 9. In S701 to set the duty value of the PWM2 signal in the light quantity storing process, the engine controller 122 outputs multiple PWM2 signals serving as different predetermined reference values, on each of which the engine controller 122 executes processing in S701 to S703.

In the case that the duty value of the PWM2 signal which is a predetermined reference value for minute emission has been set to 60% in S701, upon the PWM2 signal being output, the reference voltage Vref21 (see FIG. 3) is smoothed to 0.5 V. In S702, in a state of the Vref21 set in S701, the engine controller 122 implements APC to perform laser emission. In S703, in the APC operating state implemented in S702, the engine controller 122 measures light quantity at the light receiving element of the jig to obtain a measurement result of 1.92 μW.

Figures 7, 8:
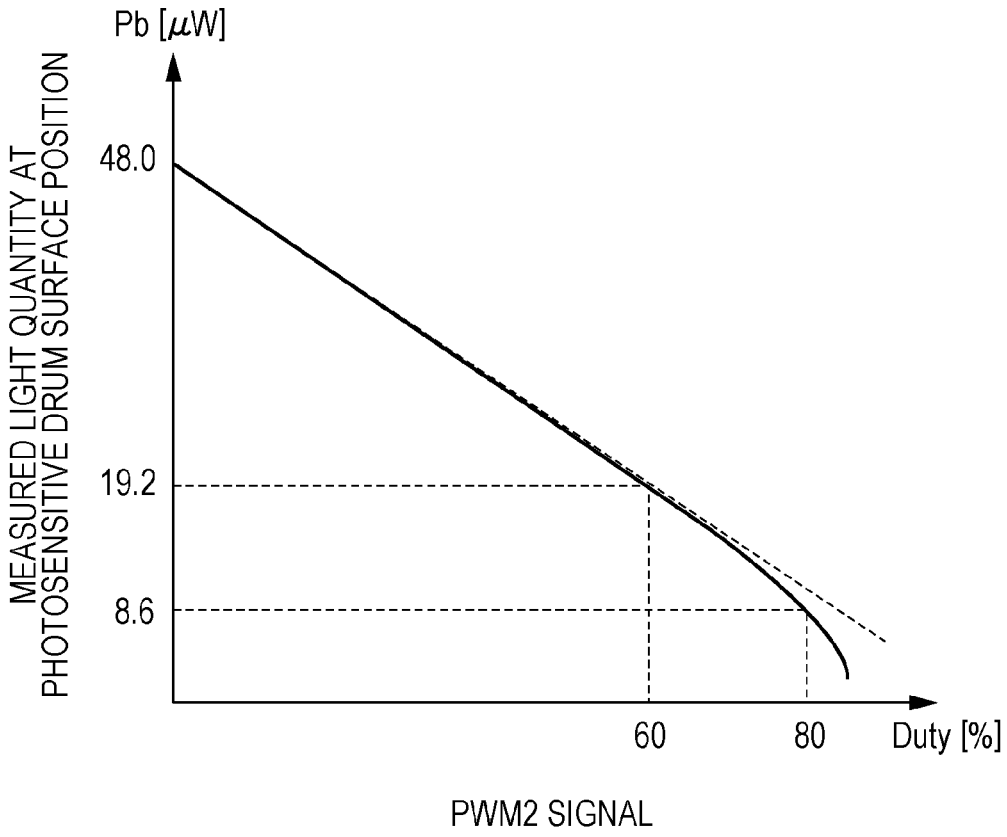
FIG. 7 is a diagram illustrating relationship between the duty value of a PWM2 signal and measured light quantity.
FIG. 8 is a graph illustrating relationship between the duty value of a PWM2 signal and measured light quantity.

The engine controller 122 implements the processing in S701 to S703 so that N=3 is satisfied in S704 in the same way regarding other duty values 80% and 0% of the PWM2 signal which is a predetermined reference value for minute emission, and measures light quantity at the light receiving element of the jig, and obtains measurement results of 8.6 μW and 48.0 μW, respectively. FIG. 7 is a table indicating correspondence between the duty value of the PWM2 signal for minute emission, the reference voltage Vref21, and the light quantity in a position corresponding to on the surfaces of the photosensitive drums 5 (photosensitive drum surface position) measured at the light receiving element in the jig. FIG. 8 is a graph illustrating a relation between the duty value of the PWM2 signal for minute emission, and the light quantity in the position corresponding to on the surfaces of the photosensitive drums 5 (photosensitive drum surface position) measured at the light receiving element in the jig. The following duty values of the PWM2 signal are set in the present embodiment as multiple predetermined reference values. (1) duty value (60%) corresponding to the driving current Ib whereby the proportional relationship between the amount of received light at the PD 110*b* and the light quantity of light reaching on the surfaces of the photosensitive drums 5 collapses, (2) duty value (0%) corresponding to light quantity equal to or greater than the maximum used light quantity for minute emission (on the surfaces of the photosensitive drums 5), and (3) duty value (80%) corresponding to light quantity equal to or smaller than the minimum used light quantity for minute emission (on the surfaces of the photosensitive drums 5).

In S704, the engine controller 122 confirms whether or not the processing in S701 to S703 has been performed on the multiple duty value of the PWM2 signal for minute emission determined beforehand, in S705 temporarily stores the duty values (0%, 60%, and 80%) measured in S703, and light quantity data (48.0 μW, 19.2 μW, and 8.6 μW) corresponding thereto in a barcode label which is a storage medium, and the barcode label thereof is applied onto the optical scanning device 9.

Next, description will be made regarding (2) stored data writing process to write data stored in a storage device of the color laser printer 50. This process is implemented in the manufacturing and assembly process of the color laser printer 50.

In S706, the engine controller 122 reads the light quantity data stored in the barcode label in S705 using a barcode reader which is a reading device. In S707, the engine controller 122 writes the light quantity read in S706 in EEPROM within the engine controller 122 serving as a final storage device, whereby the stored data writing process is ended.

Setting Method of Duty Value of PWM2 Signal

Next, description will be made regarding a method for setting the duty value of the PWM2 signal when the optical scanning device 9 performs minute emission. At the time of executing image formation, the engine controller 122 sets the light quantity Pb of minute emission according to various conditions. Examples of the conditions for determining the light quantity Pb of minute emission include the usage amount of the photosensitive drums 5, and the rotation speed (process speed) of the photosensitive drums 5.

The engine controller 122 calculates the duty value of the PWM2 signal for irradiating laser light on the surfaces of the photosensitive drums 5 with the light quantity Pb of desired minute emission using the light quantity data written in the EEPROM in the above S701. Specifically, the engine controller 122 calculates this by calculation of the CPU serving as a calculator within the engine controller 122.

For example, in the case that desired minute emitted light quantity Pb is 19.2 μW, a condition of Pb<9.2 μW is satisfied, so the engine controller 122 calculates the duty value of the PWM2 signal for obtaining light quantity Pb=15 μW using the primary linear interpolation of two points (60%, 19.2 μW) and (80%, 8.6 μW).

Specifically, calculation is performed as follows. (duty value of PWM2 signal)=(15 μW−19.2 μW)×(60%-80%)/(19.2 μW−8.6 μW)+60=67.92%

Also, in the case that the desired minute emitted light quantity Pb satisfies the condition of Pb>19.2 μW, the engine controller 122 calculates the duty value of the PWM2 signal using the primary linear interpolation of two points (0%, 48.0 μW) and (60%, 19.2 μW).

As described above, the engine controller 122 determines the duty value of the PWM2 signal which is a reference value to be input to the optical scanning device 9 based on information relating to relationship between the predetermined reference values (duty values: 0%, 60%, and 80%), and the light quantities (48.0 μW, 19.2 μW, and 8.6 μW) in the positions of the photosensitive drums 5 at the time of causing the light source (LD 110*a*) to emit light based on the predetermined reference values. That is to say, the engine controller 122 is a determining unit configured to determine the duty value of the PWM2 signal which is a reference value to be input to the optical scanning device 9.

As described above, according to the present embodiment, the engine controller 122 emits light using the predetermined duty value of the PWM2 signal, measures light quantity in a position corresponding to on the surfaces of the photosensitive drums 5, and stores this in the color laser printer 50. The engine controller 122 sets the duty value of the PWM2 signal for obtaining desired minute emitted light quantity, whereby minute emission with desired light quantity can be performed on the surfaces of the photosensitive drums 5.

Note that, though the engine controller 122 has calculated the primary linear interpolation based on the light quantity data of light quantities measured regarding the three duty values of the PWM signal for minute emission, the duty values of the PWM signal for minute emission used for measuring light quantities are not restricted to three values. Specifically, light quantity data may be created by measuring light quantities using multiple duty values according to necessary accuracy, light quantities may be measured using four or more duty values if more accuracy is needed, or light quantities may be measured using two duty values alone if a certain level of accuracy is needed.

Also, a method for calculating light quantity data and duty values is not restricted to the primary linear interpolation. Another method may be employed in which a function to approximate relationship between duty values and light quantities such as illustrated in FIG. 8 (a value corresponding to a duty value, and a value corresponding to a light quantity are variables) is stored, a constant of this function is determined from relationship between predetermined one point or multiple duty values and measured light quantities, the constant thereof is written in the storage device of the color laser printer 50, and the duty values are calculated based on this function.

Also, though light quantity data has been created with the duty values of a PWM signal for minute emission which are values relating to the driving current Ib, and light quantities as parameters to set the light quantities of minute emission in the present embodiment, the parameters are not restricted to these. Specifically, data may be created from a value relating to the driving current Ib, and a value relating to the light quantity of minute emission on the surfaces of the photosensitive drums 5 actually measured at the time of emitting light based on that value, and the light quantity of minute emission may be set based on that data. For example, the value relating to the light quantity of minute emission on the surfaces of the photosensitive drums 5 actually measured may be difference between the measured light quantity and light quantity serving as a reference.

Also, light quantity data has been stored in a barcode label, and has been written in the EEPROM within the engine controller 122, thereby finally storing the light quantity data in the color laser printer 50. However, the method for storing light quality data is not restricted to this. For example, non-volatile memory, which is not illustrated, serving as a storage device is provided to the inside of the optical scanning device 9, and light quantity data is stored in the non-volatile memory within the optical scanning device 9 in the manufacturing and assembly process of the optical scanning device 9. At the time of actually setting the duty values of the PWM2 signal, light quantity data may be read out from the non-volatile memory within the optical scanning device 9 to calculate the duty values. In this case, the above light quantity adjustment process is ended in S705 of the flowchart in FIG. 6. Thus, at the time of calculating the duty values, in the case of reading out light quantity data from the storage device provided to the optical scanning device 9, there is no need to read out the light quality data in the manufacturing and assembly process of the color laser printer 50 to be written in another final storage device. Therefore, the manufacturing and assembly process of the color laser printer 50 can be simplified.

Second Embodiment

While the light quantity corresponding to the duty value of the PWM2 signal for minute emission determined beforehand has been measured and stored in the first embodiment, a second embodiment differs from the first embodiment in that the duty value of the PWM2 signal for minute emission corresponding to predetermined light quantity is obtained and stored. In the following description, only points different from the first embodiment will be described, and other description will be denoted with the same reference symbols, and description thereof will be omitted.

Figure 9:
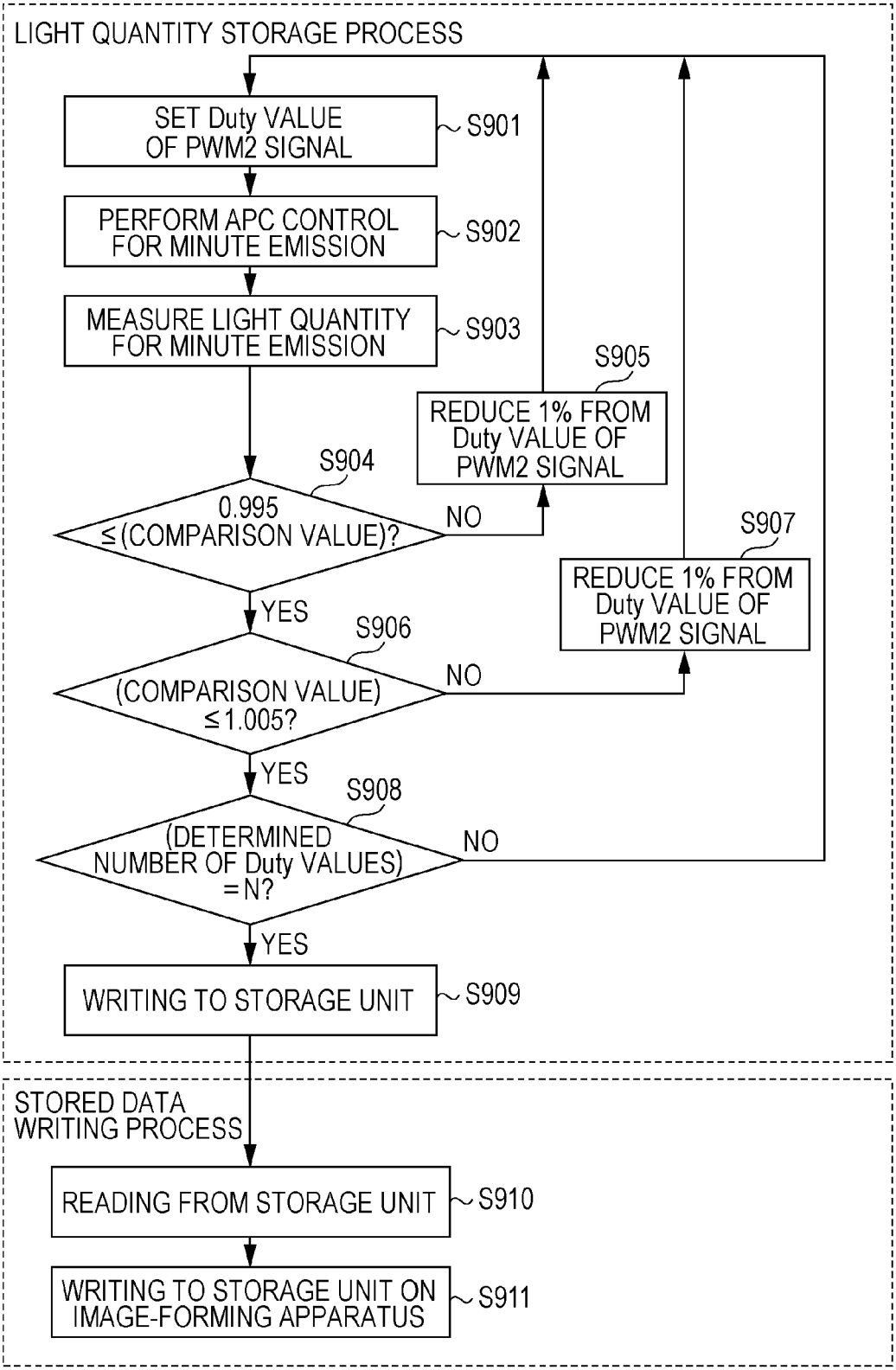
FIG. 9 is a flowchart of a light quantity adjustment process.

FIG. 9 is a flowchart illustrating a light quantity adjustment process according to the second embodiment. In (1) light quantity storing process, the engine controller 122 determines the duty values of the PWM2 signal so that light quantity to be detected at the light receiving element of the jig becomes a predetermined light quantity. Predetermined target light quantities are set to three values of 45.0 μW, 19.2 μW, and 8.6 μW in the present embodiment.

In S901, the engine controller 122 sets the duty values of the PWM2 signal. In the case of obtaining a duty value of which the target light quantity becomes 19.2 μW, it is known that the target light quantity becomes 19.2 μW around the duty value 60%, so we will say that a duty value of 61% has been set as an initial value. In the case of the duty value 61%, the reference voltage Vref21 (see FIG. 3) is smoothed to 0.4875 V. In S902, the engine controller 122 implements APC in the state of the reference voltage Vref21 set in S901 to perform laser emission. In S903, light quantity is measured at the light receiving element of the jig in the APC operating state implemented in S902. In this case, suppose that the measurement result of 18.8 μW has been obtained.

In S904, the engine controller 122 takes a division result between the target light quantity (19.2 μW) on the surfaces of the photosensitive drums 5 illustrated in FIG. 10 and the light quantity on the surfaces of the photosensitive drums 5 measured in S903 as a comparison value, and confirms whether or not this comparison value is 0.995≤(comparison value). In this case, (comparison value)=(light quantity measured in S903)/(target light quantity (19.2 μW))=18.8 μW/19.2 μW=0.979>0.995 holds. Therefore, the result in S904 is NO, the engine controller 122 proceeds to S905 to lower the duty value of the PWM2 signal by 1%.

When setting the duty value of the PWM2 signal to 60% in S901, the reference voltage Vref21 is smoothed to 0.5 V. In S902, the engine controller 122 implements APC in the state of the Vref21 set in S901 to perform laser emission. In S903, the engine controller 122 measures light quantity on the surfaces of the photosensitive drums 5 after passing through the collimator lens 134 and so forth within the optical scanning device 9 in the APC operating state implemented in S902 to obtain a measurement result of 19.2 μW.

In S904, (comparison value)=(light quantity on the surfaces of the photosensitive drums 5 measured in S903)/(target light quantity (19.2 μW) on the surfaces of the photosensitive drums 5 illustrated in FIG. 10)=19.2 μW/19.2 μW=1 holds, so 0.995≤(comparison value) is satisfied. Therefore, the engine controller 122 proceeds to S906. In S906, (comparison value)=1≤1.01 is satisfied. Therefore, the engine controller 122 proceeds to S908, where the duty value of the PWM2 signal of which the light quantity on the surfaces of the photosensitive drums 5 becomes the target light quantity (19.2 μW) is determined to be 60%. Next, the engine controller 122 repeats the above process in S901 to S908 until the duty value (reference value) of the PWM2 signal corresponding to each of the three target light quantities 45.0 μW, 19.2 μW, and 8.6 μW (until N=3 holds) is found. As a result thereof, the engine controller 122 determines the duty values (reference value) of the PWM2 signal of which the target light quantities become 45.0 μW and 8.6 μW to be 6% and 80%, respectively.

FIG. 10 is a table of target light quantity and the duty values of the PWM2 signal obtained corresponding thereto. In the same way as the first embodiment, the engine controller 122 sets predetermined target quantities in the present embodiment, such as light quantity (19.2 μW) for proportional relationship between the amount of received light at the PD 110*b*, and the light quantity of light reaching on the surfaces of the photosensitive drums 5 collapsing, the maximum used light quantity for minute emission (on the surfaces of the photosensitive drums 5) (45.0 μW), and the minimum used light quantity for minute emission (on the surfaces of the photosensitive drums 5) (8.6 μW).

In S908, the engine controller 122 confirms whether or not the duty values of the PWM2 signal for the LD 110*a* emitting light have been determined regarding all predetermined target light quantities (45.0 μW, 19.2 μW, and 8.6 μW), respectively. Next, in S909 the engine controller 122 stores the duty value data of the PWM2 signal (6%, 60%, and 80%) in the barcode label, and the barcode label thereof is adhered on the optical scanning device 9. Since the subsequent S910 and S911 in the stored data writing process to the recording medium of the color laser printer 50 are the same as S706 and S707 in the first embodiment, description thereof will be omitted. Also, the method for setting the duty value of the PWM2 signal within the color laser printer 50 is also the same as that in the first embodiment, so detailed description will be omitted.

In either case, the engine controller 122 determines a reference value (duty value of the PWM2 signal) to be input to the optical scanning device 9 based on information relating to relationship between the predetermined light quantities (45.0 μW, 19.2 μW, and 8.6 μW), reference values (6%, 60%, and 80%) to cause the light source (LD 110*a*) to emit light in the present embodiment so that the light quantities in the positions of the photosensitive drums 5 become a predetermined light quantity.

As described above, the same advantage as the advantage of the first embodiment may be obtained even when obtaining and storing the duty value of the PWM2 signal for minute emission corresponding to a predetermined light quantity. Specifically, a light quantity in a position corresponding to the surfaces of the photosensitive drums 5 is actually measured, the duty value of the PWM2 signal corresponding to a predetermined light quantity is obtained and stored in the color laser printer 50. The duty value of the PWM2 signal for obtaining a desired minute emitted light quantity is set based on the stored duty value, whereby minute emission can be performed on the surfaces of the photosensitive drums 5 with the desired light quantity.

Also, though duty value data has been created with the target light quantities and the duty values of a PWM signal for minute emission which are values relating to the driving current Ib as parameters to set the light quantities for minute emission in the present embodiment, the parameters are not restricted to these. Specifically, the parameters do not have to be the duty value of the PWM signal for minute emission as long as a value corresponding to the driving current Ib, and the duty values may be a value corresponding to difference between a reference duty value and an obtained duty value instead of the obtained duty value itself.

Third Embodiment

When employing a laser light source, there may be a case where a droop phenomenon occurs in which the amount of light thereof deviates due to the temperature characteristic and so forth of the laser light source, and it takes time until the amount of light emitted by the laser light source is stabilized. In particular, there is a tendency in which the smaller the driving current is, the more time it takes time until the amount of light emitted is stabilized. Therefore, in the case of performing irradiation of laser light with a minute emission level to obtain a potential sufficient for preventing toner from being adhered on the photosensitive member, in order to cause the laser light source to emit light using relatively small driving current, it takes longer time until the amount of light emitted is stabilized. Therefore, of a portion corresponding to a marginal portion of a recording material of the photosensitive member where not image is formed, when attempting to perform irradiation of laser light with a minute emission level (second emitted light quantity) on a portion positioned further upstream (hereinafter, referred to as upstream marginal region) than an image formation portion in the scanning direction of the laser light, it takes time until the amount of light emitted by the laser light source is stabilized. Therefore, the potential of the upstream marginal region of the photosensitive member is not readily stabilized, and image defects such as fogging (normal fogging, reverse fogging) or the like may occur.

In Japanese Patent Laid-Open No. 2012-137743, adjustment operation (APC) for approximating the amount of light emitted from a laser light source to a target value of a minute emission level (second emitted light quantity) during a period corresponding to the upstream marginal region. During this adjustment operation (APC), the amount of light emitted by the laser light source is not readily stabilized, so the potential of the upstream marginal region of the photosensitive member is still not readily stabilized, and image defects such as fogging or the like may occur.

Therefore, it has been found to be desirable to stabilize the potential of a portion positioned further upstream than an image formation portion in the scanning direction of laser light of a portion corresponding to a marginal portion of a recording material of the photosensitive member where not image is formed to suppress occurrence of image defects such as fogging or the like.

First, the configuration of the image forming apparatus (color image forming apparatus) according to the present embodiment will be described with reference to FIGS. 11A to 16C in the present embodiment. Next, description will be made regarding control operation relating to change in a manner correlating the target level of the emitted light quantity P (Idrv+Ib) for normal emission with the life of the photosensitive drum. Next, APC control and the overall of an emission sequence will be described with reference to FIG. 9, and the droop of the laser light source and control relating thereto will be described with reference to FIGS. 20 to 24. Note that the same portions as those in the first embodiment will be denoted with the same reference symbols, and description thereof will be omitted.

Image Forming Apparatus

Figure 11A:
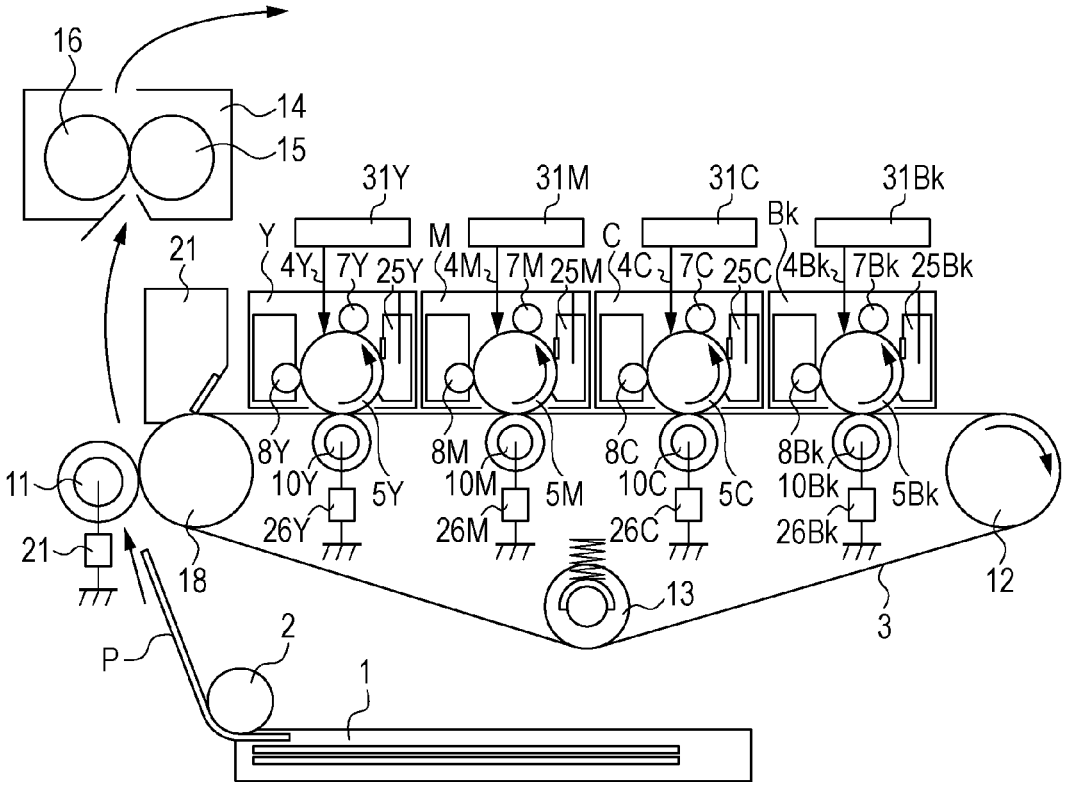
FIG. 11A is a schematic cross-sectional view of an image-forming device.

FIG. 11A is a schematic cross-sectional view of the image forming apparatus according to the present embodiment. The configuration and operation of the image forming apparatus according to the present embodiment are basically the same as those in the first embodiment except for optical scanning devices 13 (13Y, 13M, 13C, and 13K).

Note that the present embodiment is not restricted to the image forming apparatus including the intermediate transfer belt 3. For example, the present embodiment may be implemented on an image forming apparatus, which includes a recording material conveying belt (recording material bearing member), employing a method for directly transferring a toner image developed on the photosensitive drum on a recording material to be conveyed by the recording material conveying belt. Hereinafter, the image forming apparatus including the intermediate transfer belt 3 will be described as an example.

Cross-Section of Photosensitive Drum

Figure 11B:
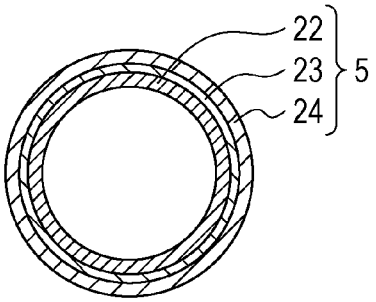
FIG. 11B is a cross-sectional view of a photosensitive drum.

FIG. 11B illustrates an example of the cross-section of the photosensitive drum 5. The photosensitive drum 5 includes a charge generating layer 23 and a charge conveying layer 24 which are laminated on a conductivity support substrate 22. The conductivity support substrate 22 is an aluminum cylinder with an outer diameter of 30 mm and thickness of 1 mm, for example. The charge generating layer 23*a* is phthalocyanine pigment with thickness of 0.2 μm, for example. The charge conveying layer 24*a* has thickness of 20 μm, polycarbonate is used as a binding resin, into which an amine compound has been blended as a charge transport material. It goes without saying that FIG. 11B is only an example of the photosensitive drum 5, and dimensions and a material and so forth are not restricted to those described here.

Sensitivity Characteristic of Photosensitive Drum

Figure 12:
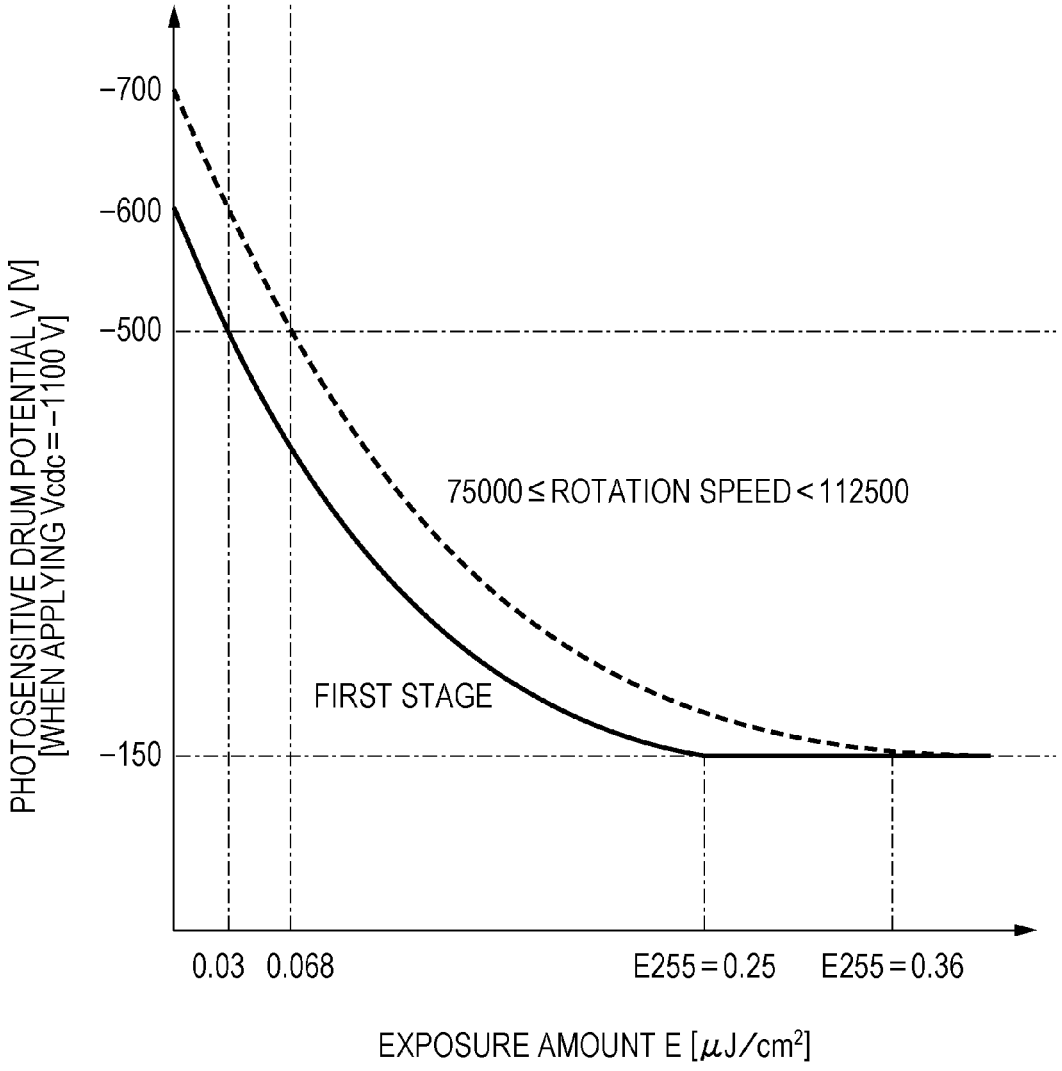
FIG. 12 is a diagram illustrating an example of a sensitivity characteristic (EV curve) of the photosensitive drum.

FIG. 12 is an example of an EV curve indicating the photosensitivity characteristic of the photosensitive drum 5, and is a graph where the horizontal axis denotes exposure amount E (μJ/cm2), and the vertical axis denotes the potential of the photosensitive drum 5 (photosensitive drum potential) (V). FIG. 12 illustrates the potential of the photosensitive drum at the time of exposing the photosensitive drum so that total exposure amount per unit area of the photosensitive drum surface becomes the exposure amount E (μJ/cm2) after charging the photosensitive drum 5 by applying −1100 V to the photosensitive drum 5 as charging voltage Vcdc. This EV curve indicates that greater potential attenuation is obtained by increasing the exposure amount E. Also, a high potential portion has a strong electric field environment, and recoupling of charge carriers (electronic-positive hole pair) generated due to exposure is not readily generated, and consequently, even small exposure amount exhibits great potential attenuation. On the other hand, generated carriers are readily recoupled at a low potential portion, and a phenomenon is observed in which potential attenuation is small even for exposure at great exposure amount.

Also, in FIG. 12, an EV curve at an early stage in which the photosensitive drum begins to be used, and an EV curve at the time of continuing to use the photosensitive drum are illustrated respectively. In FIG. 12, a dashed curve is an EV curve of 75000≤r<112500 (r: the number of rotations of the photosensitive drum), for example. Note that the sensitivity characteristic of the photosensitive drum illustrated in FIG. 12 is an example, and application of a photosensitive drum having various EV curves can be assumed in the present embodiment.

Optical Scanning Device External Appearance View

Figure 13:
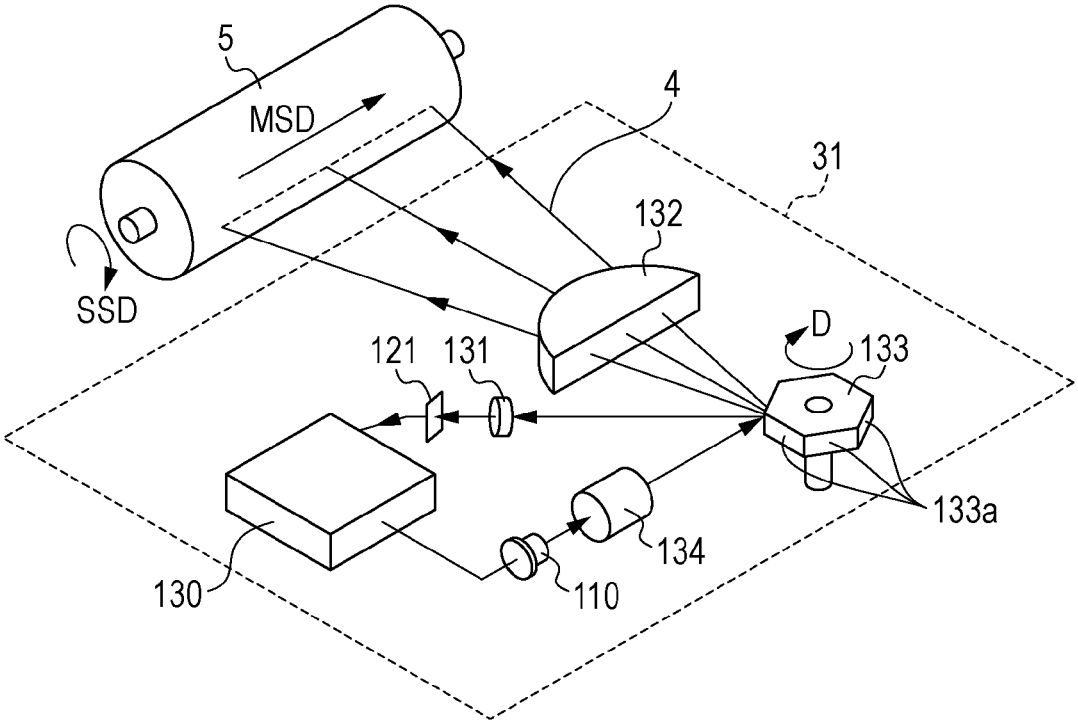
FIG. 13 is a schematic perspective view of an optical scanning device.

FIG. 13 illustrates a perspective view of an optical scanning device 31 serving as an example. Note that, since optical scanning devices 31Y, 31M, 31C, and 31Bk have the same configuration, the optical scanning device 31 will be described representatively. Driving current flows into a laser diode element 110 which is an emission element according to activation of a laser driving system circuit 130. The laser diode element 110 emits laser light at a strong level according to the driving current. The laser driving system circuit 130 (hereinafter, referred to as LD driver 130) is a circuit for drive the laser diode element 110 electrically connected with later-described engine controller 122 and video controller 123.

Laser light 4 emitted from the laser diode element 110 is input to a polygon mirror 133 including multiple reflecting surfaces 133*a* in the circumferential surface after the beam shape is shaped by the collimator lens 134 and also converted into parallel beams. Since the polygon mirror 133 is rotating around the axis of rotation (D direction), the reflecting direction of the laser light 4 reflected at the polygon mirror 133 consecutively changes. When the rotated phase of each reflecting surface 133*a* of the polygon mirror 133 is included in a predetermined range, the laser light reflected at the polygon mirror 133 passes through the fθ lens 132, and provides an image on the surface of the photosensitive drum 5 to form a dot-shaped spot.

The polygon mirror 133 rotates, whereby a position where the spot of the laser light 4 on the photosensitive drum 5 is formed moves to the main scanning direction MSD. At the same time, the photosensitive drum 5 rotates with the axis of rotation as the center, a surface thereof moves to a sub scanning direction SSD which is a direction intersecting the main scanning direction MSD. Thus, according to the rotation of the polygon mirror 133 and the rotation of the photosensitive drum 5, the position where the spot of the laser light 4 on the photosensitive drum 5 is formed moves to the main scanning direction and sub scanning direction relatively as to the surface of the photosensitive drum 5 to form a two-dimensional latent image on the photosensitive drum 5.

Also, in order to form a latent image in a desired position on the surface of the photosensitive drum 5 in the main scanning direction MSD, the optical scanning device 31 has to detect the reflecting direction of the laser light 4 reflected at the polygon mirror 133 during rotation of the polygon mirror 133. Therefore, the optical scanning device 31 includes a BD sensor (horizontal synchronizing signal output device) 121 configured to detect the reflecting direction of the laser light 4, and a lens 131 configured to condense the laser light 4 so as to suitably detect the laser light 4 at the BD sensor 121. These lens 131 and BD sensor 121 are provided in a position such that the laser light 4 of which the reflecting direction at the reflecting surface 133*a* consecutively changes input to the lens 131 and BD sensor 121 before inputting to the fθ lens 132. In other words, the lens 131 and BD sensor 121 are provided upstream of the fθ lens 132 in a direction corresponding to the main scanning direction MSD (direction where the reflecting direction of the laser light 4 changes).

The LD driver 130 forcibly emits the laser light 4 during a period including timing estimated that the laser light 4 inputs to the BD sensor 121 in order to detect the laser light 4 at the BD sensor 121. Next, the BD sensor 121 receives (detects) the forcibly emitted laser light 4 and outputs a BD signal (horizontal synchronizing signal). According to timing of this BD signal being output, there can be identified the reflecting direction at the reflecting surface 133*a* of the laser light 4 (the rotated phase of the reflecting surface 133*a* where the laser light 4 inputs). Next, determining the scanning start timing of the laser light with the timing of the BD signal being output as a reference enables a latent image to be formed in a desired position on the surface of the photosensitive drum 5 in the main scanning direction MSD.

Here, the LD driver 130 performs Auto Power Control (APC) serving as control for setting the light quantity of the laser light 4 to a desired value by adjusting the emission level of the laser diode element 110. The LD driver 130 executes the above APC at the time of forcibly emitting the laser light 4 to detect the laser light 4 at the BD sensor 121.

The optical scanning devices 31 perform normal exposure for adhering toner serving as a developing agent on an image portion of the corresponding photosensitive drum 5, where toner is to be adhered. The normal exposure means to set the surface potential of the photosensitive drum 5 to a potential sufficient for saturating charge adhesion of toner to the surface of the photosensitive drum 5 by irradiating light emitted (normal emitted) at the first emission level (first emitted light quantity) on the photosensitive drum 5.

Further, the optical scanning devices 31 perform minute exposure for suppressing toner from being adhered due to so-called normal fogging or reverse fogging or the like, on a non-image portion of the corresponding photosensitive drum 5 where not toner is adhered. The minute exposure means to set the surface potential of the photosensitive drum 5 to a potential sufficient for preventing charge adhesion of toner (not visualized) and also preventing toner from being adhered on the surface of the photosensitive drum 5 due to normal fogging, reverse fogging, or the like, by irradiating light emitted (minute emitted) at the second emission level (second emitted light quantity) on the photosensitive drum 5. Here, the second emission level is smaller than the first emission level. Note that the emission level means the intensity of light, and is the amount of light per unit time emitted from the chip surface (light emitting surface) of the laser diode element 110 (hereinafter, simply referred to as the amount of light). That is to say, the emission level of the laser diode element 110 is substantially the same meaning as the emission intensity or emission luminance of the laser diode element 110.

Also, minute exposure is performed on the non-image portion of the photosensitive drum 5, whereby a toner image can be suppressed from thinning due to involvement of an electric field in a boundary portion between the non-image portion and the image portion.

Laser Driving System Circuit Diagram

Figure 14:
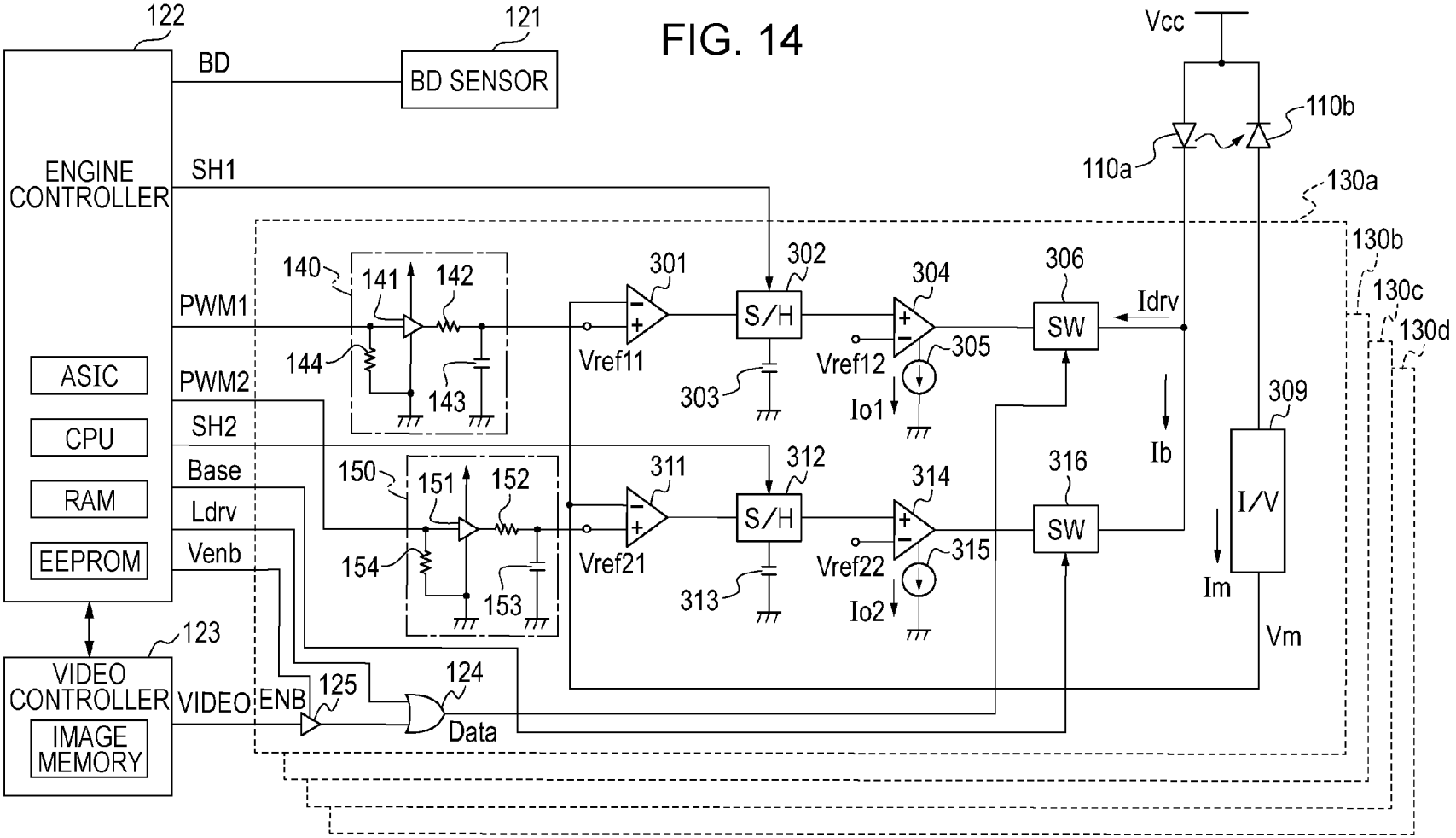
FIG. 14 is a diagram illustrating an example of a laser driving circuit having 2-level light intensity adjustment function.

FIG. 14 is a diagram illustrating a laser driving system circuit configured to perform normal emission on the image portion of the photosensitive drum and to perform minute emission on the non-image portion. The laser diode element 110 includes a laser diode 110*a* (hereinafter, referred to as LD 110*a*) serving as a light source, and a photodiode 110*b* (hereinafter, referred to as PD 110*b*) The laser driving system circuit can automatically adjust the emission level of the normal emission (first emission level) of the LD 110*a* and the emission level of minute emission (second emission level).

In FIG. 14, the LD drivers 130*a*, 130*b*, 130*c*, and 130*d* (a portion within a dotted-line frame in FIG. 14) are provided in the optical scanning devices 31Y, 31M, 31C, and 31Bk, respectively. The LD drivers 130*a*, 130*b*, 130*c*, and 130*d* are LD drivers configured to emit laser light 4Y, 4M, 4C, and 4Bk to be irradiated on the corresponding photosensitive drum 5, respectively. Note that the LD driver 130 illustrated in FIG. 13 is equivalent to one of the LD drivers 130*a*, 130*b*, 130*c*, and 130*d* in FIG. 14. Hereinafter, though description will be made regarding the configuration of the LD driver 130*a*, the other LD drivers 130*b* to 130*d* also have the same configuration, so description thereof will be omitted.

As illustrated in FIG. 14, the LD driver 130*a* includes PWM smoothing circuits 140 and 150 (dashed dotted line), comparator circuits 301 and 311, sampling-and-hold circuits 302 and 213, and hold capacitors 303 and 313. Also, the LD driver 130*a* includes current amplifier circuits 304 and 314, reference current sources (constant current circuits) 305 and 315, switching circuits 306 and 316, and a current-voltage conversion circuit 309. Note that, hereafter, a photodiode 110*b* will be referred to as a PD 110*b*. Also, the portions 301 to 306 are equivalent to a first light intensity adjuster, and the portions 311 to 316 are equivalent to a second light intensity adjuster, which will be described later in detail. A later-described emission level for normal print and emission level for minute emission can be controlled independently by the first light intensity adjuster and second light intensity adjuster, respectively.

The engine controller 122 houses an ASIC, CPU, RAM, and EEPROM. Also, the engine controller 122 performs not only control of the printer engine but also communication control with the video controller 123.

Also, the engine controller 122 outputs a PWM signal PWM1 to the PWM smoothing circuit 140. The PWM smoothing circuit 140 includes an inverter circuit 141, resistors 142 and 144, and a capacitor 143. The inverter circuit 141 inverts the PWM signal PWM1. The output of the inverter circuit 141 charges the capacitor 143 via the resistor 142, and is smoothed by the capacitor 143 to become a voltage signal. The smoothed voltage signal is input to the terminal of the comparator circuit 301 as a reference voltage Vref11. Thus, the reference voltage Vref11 is determined by the signal pulse width of the PWM signal PWM1, and is controlled by the engine controller 122.

The engine controller 122 outputs the PWM signal PWM2 to the PWM smoothing circuit 150. The PWM smoothing circuit 150 includes an inverter circuit 151, resistors 152 and 154, and a capacitor 153. The inverter circuit 151 inverts the PWM signal PWM2. The output of the inverter circuit 151 charges the capacitor 153 via the resistor 152, and is smoothed by the capacitor 153 to become a voltage signal. The smoothed voltage signal is input to the terminal of the comparator circuit 311 as a reference voltage Vref21. Thus, the reference voltage Vref21 is determined by the signal pulse width of the PWM signal PWM2, and is controlled by the engine controller 122. Note that both of the reference voltages Vref11 and Vref21 may directly be output without instructing a PWM signal from the engine controller 122.

The OR circuit 124 is connected to the Ldrv signal input from the engine controller 122 and the VIDEO signal input from the video controller 123 at input terminals, and the Data signal therefrom is output to a later-described switching circuit 306. Note that the VIDEO signal is a signal based on the print data transmitted from an external device such as an externally connected reader scanner, host computer, or the like. Now, the VIDEO signal will be described in detail. The VIDEO signal is a signal driven by image data of, for example, 8-bit (256 gradations) multi-value signal (0 to 255), and is configured to determine laser emission time. The pulse width when the image data is (background portion) is PWMIN (e.g., 0.0% equivalent to one pixel), the pulse width when the image data is 255 is one pixel worth (PW255) at full exposure. Also, the image data of which the value is 1 to 254 is generated with a pulse width (PWn) proportional to a gradation value between the PWMIN to PW255, and is represented by Expression (1).

$$PWn = n \times (PW255 - PWMIN)/255 + PWMIN \quad (1)$$

Note that, though the above image data for controlling the laser diode element 110 has 8 bits (256 gradations), this is an example. The image data may be a O-bit (16 gradations) or 2-bit (four gradations) multi-value signal after halftone processing, for example. Also, the image data after halftone processing may be a binarized signal.

The VIDEO signal output from the video controller 123 is input to the buffer 125 with an enable terminal, and output of the buffer 125 is input to the OR circuit 124. At this time, the enable terminal is connected to a signal line from which the Venb signal from the engine controller 122 is output.

Also, the engine controller 122 outputs a later-described SH1 signal, SH2 signal, SH3 signal, and Base signal, and the Ldrv signal and Venb signal. The Venb signal is a signal for subjecting the Data signal based on the VIDEO signal to mask processing. Changing this Venb signal to a disabled state (off state) enables timing for an image mask region (image mask period) to be created.

The first reference voltage Vref11 and second reference voltage Vref21 are input to the positive-electrode terminals of the comparator circuits 301 and 311 respectively. The outputs of the comparator circuits 301 and 311 are input to the sampling-and-hold circuits 302 and 312 respectively. The reference voltage Vref11 is set as target voltage corresponding to a target value to cause the LD 110*a* to emit light with the normal emission level (first emission level) for performing normal exposure for print. Also, the reference voltage Vref21 is set as target voltage corresponding to a target value of the minute emission level (second emission level) for minute exposure. The hold capacitors 303 and 313 are connected to the sampling-and-hold circuits 302 and 312, respectively. The outputs of the sampling-and-hold circuits 302 and 312 are input to the positive-electrode terminals of the current amplifier circuits 304 and 314, respectively.

The current amplifier circuits 304 and 314 are connected with the reference current sources 305 and 315, and outputs thereof are input to the switching circuits 306 and 316, respectively. On the other hand, the negative-electrode terminals of the current amplifier circuits 304 and 314 are input to third reference voltage Vref12 and fourth reference voltage Vref22, respectively. Here, current Io1 (first driving current) is determined according to difference between the output voltage of the sampling-and-hold circuit 302 and the reference voltage Vref12 described above. Also, current Io2 (second driving current) is determined according to difference between the output voltage of the sampling-and-hold circuit 312 and the reference voltage Vref22. That is to say, the Vref12 and Vref22 are voltage settings for determining current.

The switching circuit 306 is turned on/off by the Data signal which is a pulse modulation data signal. The switching circuit 316 is turned on/off by an input signal Base. The output terminals of the switching circuits 306 and 316 are connected with the cathode of the LD 110*a*, and supply the driving currents Idrv and Ib thereto. The anode of the LD 110*a* is connected with the power supply Vcc. The cathode of the photodiode 110*b* configured to monitor the amount of light emitted from the LD 110*a* is connected with the power supply Vcc, and the anode of the PD 110*b* is connected with the current-voltage conversion circuit 309, and applies monitor current Im to the current-voltage conversion circuit 309. Thus, the current-voltage conversion circuit 309 converts the minor current Im into monitor voltage Vm. This monitor voltage Vm is input to the negative-electrode terminals of the comparator circuits 301 and 311 in a non-feedback manner.

Note that, though FIG. 14 separately illustrates the engine controller 122 and video controller 123, the present invention is not restricted to this mode. For example, part or all of the engine controller 122 and video controller 123 may be constructed by the same controller. Also, part or all of the LD driver 130 enclosed by dashed lines in FIG. 14 may also be housed in the engine controller 122, for example.

APC of Emitted Light Quantity P (Idrv)

Next, APC of the emitted light quantity P (Idrv) will be described. Note that the emitted light quantity P (Idrv) means the amount of light emitted from the LD 110*a* which emits light by the driving current Idrv being supplied. The engine controller 122 sets the sampling-and-hold circuit 312 to the hold state (during a non-sampling period) according to the instruction of the SH2 signal, and also sets the switching circuit 316 to an off operating state according to the input signal Base. Also, the engine controller 122 sets the sampling-and-hold circuit 302 to the sampling state according to the instruction of the SH1 signal, and also sets the switching circuit 306 to on according to the Data signal. More specifically, at this time, the engine controller 122 controls (instructs) the Ldrv signal to set the Data signal so that the LD 110*a* transitions to the emission state. Note that a period while this sampling-and-hold circuit 302 is in the sampling state is equivalent to during APC operation.

In this state, when the LD 110*a* transitions to a full-surface emission state, the PD 110*b* receives the light emitted from the LD 110*a*, and applies monitor current Im1 proportional to the received light quantity to the current-voltage conversion circuit 309. The current value of this monitor current Im1 is a value correlated with (proportional to) the emission level of the LD 110*a*.

Next, when receiving the monitor current Im1, the current-voltage conversion circuit 309 converts the monitor current Im1 into monitor voltage Vm1. Also, the current amplifier circuit 304 controls the driving current Idrv based on the current Io1 applied to the reference current source 305 so that this monitor voltage Vm1 agrees with the first reference voltage Vref11 which is a target value.

Note that, during a period other than the APC period, the sampling-and-hold circuit 302 is in the hold state (non-sampling state). During a period for performing normal emission to perform image formation, the switching circuit 306 is turned to on/off according to the Data signal to perform pulse width modulation for supplying the driving current Idrv to the LD 110*a* with a time interval according to the pulse duty thereof.

APC of Emitted Light Quantity P (Ib)

Next, APC of the emitted light quantity P (Ib) will be described. Note that the emitted light quantity P (Ib) means the amount of light emitted from the LD 110*a* which emits light by the driving current Ib being supplied. The engine controller 122 sets the sampling-and-hold circuit 302 to the hold state (during a non-sampling period) according to the instruction of the SH1 signal, and also sets the switching circuit 306 to an off operating state according to the Data signal. According to this Data signal, the engine controller 122 sets the Venb signal connected to the enable terminal of the buffer 125 with an enable terminal to a disabled state, and also controls the Ldrv signal to turn off the Data signal. Also, the engine controller 122 sets the sampling-and-hold circuit 312 to the sampling state according to the instruction of the SH2 signal, that is, during APC operation, and sets the switching circuit 316 to on by the input signal Base so that the LD 110*a* transitions to the minute emission state.

When the LD 110*a* is in the full-surface minute emission state (lighting maintained state) with weak light quantity, the PD 110*b* monitors the emission intensity of the LD 110*a*, and applies monitor current Im2 (Im1>Im2) proportional to the emission intensity thereof to the current-voltage conversion circuit 309. When receiving the monitor current Im2, the current-voltage conversion circuit 309 converts the monitor current Im2 into monitor voltage Vm2. Also, the current amplifier circuit 314 controls the driving current Ib based on the current Io2 applied to the reference current source 315 so that this monitor voltage Vm2 agrees with the second reference voltage Vref21 which is a target value.

Note that, during a period other than the APC period, the sampling-and-hold circuit 312 is in the hold state (non-sampling state). During a period for performing normal emission to perform image formation, at least the Base signal is set to on to turn on the switching circuit 316, thereby supplying the driving current Ib to the LD 110*a*.

Note that, when permitting normal fogging, reverse fogging, or the like of toner, the emission level of minute emission (second emission level) may be set a level in which the surface potential (minus potential) of the photosensitive drum 5 after minute exposure is equal to or greater than the absolute value of the developing potential (minus potential). However, in order to obtain further high image quality, occurrence of normal fogging, reverse fogging, or the like of toner has to be suppressed, and to that end, the emitted light quantity P (Ib) has to be stabilized during image formation.

Relationship Between Driving Current I and Emitted Light Quantity P

Next, relationship between the driving current I supplied to the LD 110*a* and the emitted light quantity P of the LD 110*a* which emits light by the driving current I being supplied, will be described.

Figure 15:
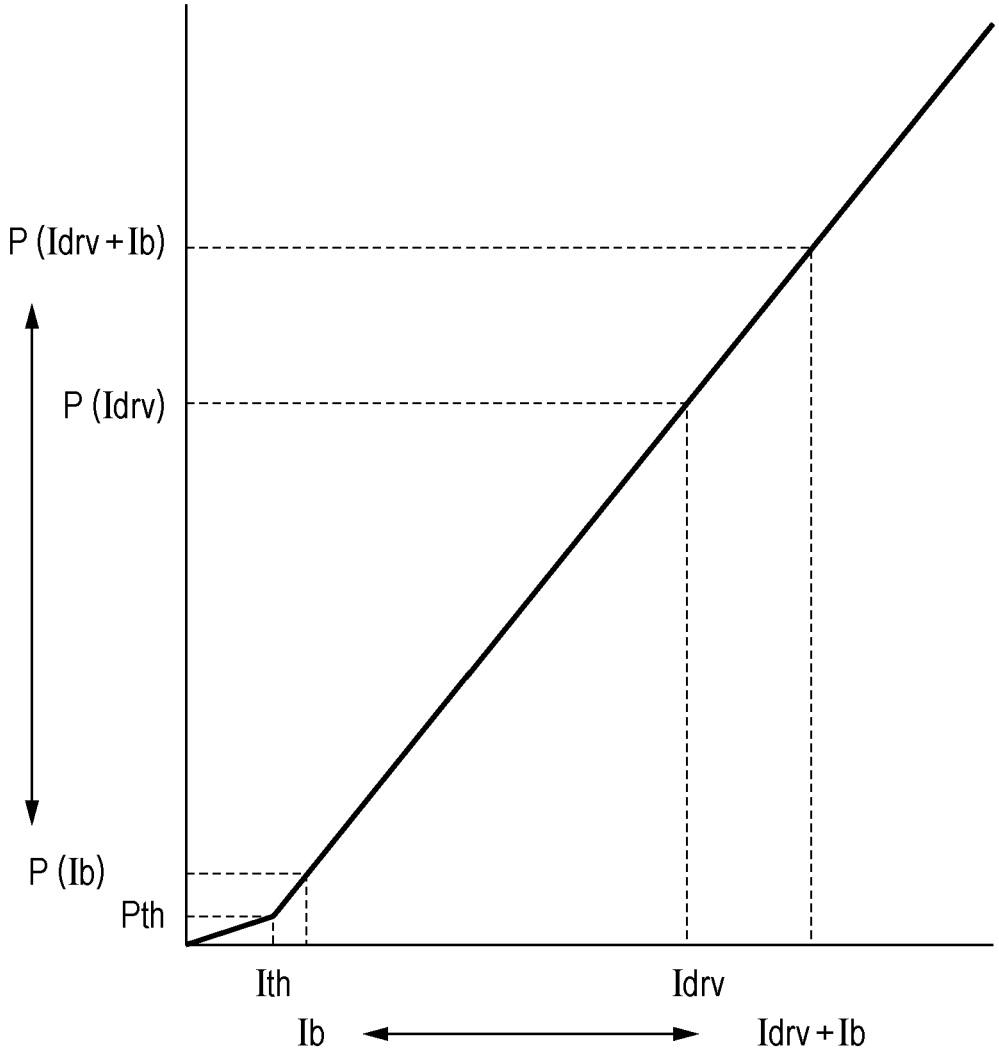
FIG. 15 is a diagram illustrating relationship between current flowing into a laser diode and emission intensity.

FIG. 15 is a graph illustrating relationship between the laser emission intensities and the current values. The driving current Ib is set to driving current sufficient to cause the LD 110*a* to emit light with the emitted light quantity P (Ib) serving as the emission level for minute emission (second emission level) for performing minute exposure on the photosensitive drum 5 by the above APC operation of the emitted light quantity P (Ib).

Now, in the case that the driving current I supplied to the LD 110*a* is smaller than threshold current Ith, the LD 110*a* emits LED, and in the case that the driving current I supplied to the LD 110*a* is greater than threshold current Ith, the LD 110*a* emits laser light. As illustrated in FIG. 15, the driving current Ib is set to a value greater than the threshold current Ith, and the LD 110*a* receives the driving current Ib to emit laser light, thereby emitting light with the emitted light quantity P (Ib) which is the second emission level.

If the driving current Ib is smaller than the threshold current Ith, the LD 110*a* emits LED, and the light emitted from the LD 110*a* of which the spectrum wavelength distribution spreads greatly becomes light having a wide wavelength distribution as to the rated wavelength of laser. On the other hand, there are irregularities in sensitivity relating to the wavelength of light to be irradiated on the photosensitive drum, as light having a wide wavelength distribution is irradiated on the photosensitive drum, so irregularities in the surface potential of the photosensitive drum after irradiation are prominent. Therefore, in order to cause the LD 110*a* to emit laser light, the driving current Ib is set to driving current greater than the threshold current Ith.

On the other hand, the driving current Idrv+Ib is set driving current sufficient to cause the LD 110*a* to emit light with the emitted light quantity P (Idrv+Ib) serving as the emission level for normal emission (first emission level) for performing normal exposure on the photosensitive drum 5 by the above-described APC operation of the emitted light quantity P (Idrv+Ib). As can also be understood from FIG. 15, the driving current Idrv+Ib is greater than the threshold current Ith and driving current Ib, so the LD 110*a* is driven to emit laser light by the driving current Idrv+Ib. The emitted light quantity P (Idrv+Ib) is greater than the emitted light quantity P (Ib).

Description of Laser Emitted Light Quantity (Normal Exposure Emission); P (Ib+Idrv)

When causing the LD 110*a* to emit light with the emission level for normal print, the circuit in FIG. 15 is operated as follows. Specifically, the engine controller 122 sets the sampling-and-hold circuit 312 to the hold period, turns on the switching circuit 316, and also sets the sampling-and-hold circuit 302 to the hold period, and turns on the switching circuit 306. Thus, the driving current Idrv+Ib is supplied to the LD 110*a*. Also, the emitted light quantity P (Ib) of the minute emission level of the driving current Ib can be realized in the off state of the switching circuit 306.

At the time of image formation, in the case that the SH2 and SH1 signals are set to the hold period, the Base signal is set to on, and also the engine controller 122 sets the Venb signal to the enabled state, the switching circuit 306 is turned on/off according to the Data signal (VIDEO signal). Thus, driving current in which the driving current Idrv supplied in a time interval in accordance with the pulse duty of a pulse subjected to pulse width modulation based on the Data signal is superimposed on (added to) the driving current Ib serving as the base is supplied to the LD 110*a*. That is to say, the LD driver 130*a* operates so that when the switching circuit 306 is off, the driving current Ib is supplied to the LD 110*a*, and when the switching circuit 306 is on, the driving current Ib+Idrv is supplied to the LD 110*a*. Thus, the LD 110*a* emits light with two levels of emitted light quantity of the emitted light quantity P (Ib) and emitted light quantity P (Idrv+Ib).

As described above, the LD driver 130 is controlled by the engine controller 122, thereby enabling the LD 110*a* to emit light with the emitted light quantity P (Ib+Idrv) of the first emission level for normal emission, and the emitted light quantity P (Ib) of the second emission level for minute emission, and also enabling APC control (adjustment operation) for setting these emitted light quantities P to a desired value to be performed.

Change of Emitted Light Quantity P

The emitted light quantity P (Ib) for minute emission and the emitted light quantity P (Idrv+Ib) for normal exposure emission of the LD 110*a* of each of the optical scanning devices 31 are changed in a manner correlated with the life of the corresponding photosensitive drum in the present embodiment.

Hereinafter, this will be described. Note that description will be made below with the configuration and operation of the optical scanning device 31Y in a first image formation station Y serving as a representative as the center. The optical scanning devices 31M, 31C, and 31Bk in second to fourth image formation stations (M, C, and Bk) have the same configuration as that of the first image formation station Y, and perform the same operation, and accordingly, description thereof will be omitted.

Necessity to Change Emitted Light Quantity P

First, problems relating to difference in the photosensitive drum film thickness will be described with reference to FIG. 16A. When usage of the photosensitive drum 5 advances, the photosensitive drum surface is deteriorated due to discharging of the charging roller 7, and also the photosensitive drum surface is scraped by being rubbed with a cleaning device 5, and the film thickness thereof is reduced.

The image forming apparatus according to the present embodiment has a configuration in which a high-voltage power source is shared by the multiple image formation stations, whereby each of the charging voltage Vcdc and developing potential Vdc to be applied to the multiple photosensitive drums substantially becomes the same value. Substantially the same includes error of output values due to error of the electric devices and circuits and so forth such as power circuits. Also, the photosensitive drum of each image formation station can individually be replaced in the image forming apparatus according to the present embodiment.

Therefore, there may be a case where photosensitive drums having different film thickness coexist in the multiple image formation stations. In such a case, the charging potential Vd of the photosensitive drum surface may differ for each image formation station. Specifically, while a photosensitive drum of which the cumulative number of rotations is small has a great film thickness, and the absolute value of the charging potential Vd of the photosensitive drum surface is small, a photosensitive drum of which the cumulative number of rotations is great has a small film thickness, and the absolute value of the charging potential Vd of the photosensitive drum surface is great.

Next, for example, in the case of the photosensitive drum having a great film thickness, the developing potential Vdc and charging potential Vd are set so that back contrast Vback (Vd−Vdc) which is contrast between the developing potential Vdc and charging potential Vd is in a desired state.

Figure 16A:
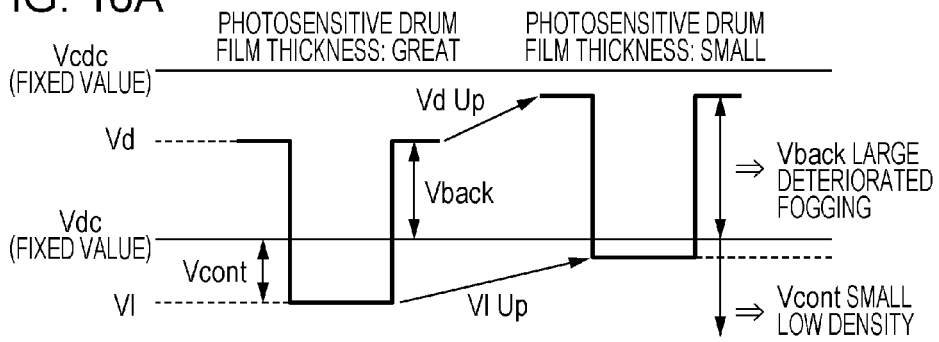
FIGS. 16A to 16C are diagrams for describing relationship between the film thickness, charging potential, developing potential of the photosensitive drum, and exposure potential.

Thus, as illustrated in FIG. 16A, there is the following problem. Specifically, in the case of an image formation station including a photosensitive drum having a small film thickness, the absolute value of the charging potential Vd increases (Vd Up), and the back contrast Vback increases. When the back contrast Vback increases, toner which failed to be charged with regular polarity (in the case of reverse development such as the present embodiment, toner charged with 0 to positive polarity instead of negative polarity) is transferred from the developing roller to the non-image portion, and reverse fogging readily occurs.

Also, in the case of an image formation station including a photosensitive drum having a small film thickness, the absolute value of the charging potential Vd increases, so when the exposure amount to the image portion of the photosensitive drum where toner is adhered is constant, the absolute value of an exposure potential V1 (VL) which is the potential of the image portion also increases (V1 Up). Therefore, developing contrast Vcont (Vdc−V1) which is a difference value between the developing potential Vdc and exposure potential V1 (VL) decreases. Accordingly, toner is insufficiently transferred from the developing roller to the photosensitive drum in an electrostatic manner, and toner density of the image portion where toner is adhered readily becomes smaller.

Figure 16B:
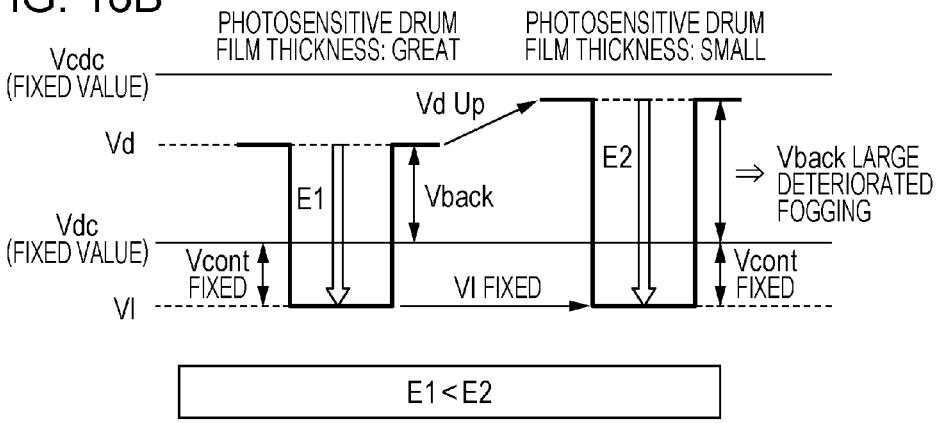

Therefore, as illustrated in FIG. 16B, with the developing potential Vdc and charging voltage Vcdc constant, the exposure amount is changed from E1 to E2 (>E1). Specifically, the exposure amount of the each photosensitive drum is individually changed according to the film thickness thereof. Thus, the developing contrast Vcont which is a difference value between the developing potential Vdc and exposure potential V1 (VL) can be controlled in a generally constant manner at each photosensitive drum regardless of the film thickness of the photosensitive drum. Accordingly, the toner density of the image portion can be kept in a generally constant manner.

However, the back contrast Vback which is contrast between the developing potential Vdc and charging potential Vd is not controlled, and changes according to the film thickness of the photosensitive drum, so there remains a problem of occurrence of fogging as described above.

Therefore, as described above, not only normal exposure is performed on the image portion of the photosensitive drum where toner is adhered, but also minute exposure is performed on the non-image portion of the photosensitive drum where no toner is adhered in the present embodiment. Next, with the developing potential Vdc and charging voltage Vcdc constant, according to the film thickness of each photosensitive drum at each image formation station, the exposure amount of normal exposure is changed in a range of E1 to E2 (>E1), and also the exposure amount of minute exposure is changed in a range of Ebg1 to Ebg2 (>Ebg1). The change of the exposure amount is performed by changing the emitted light quantity of the LD 110*a* in the present embodiment.

Figure 16C:
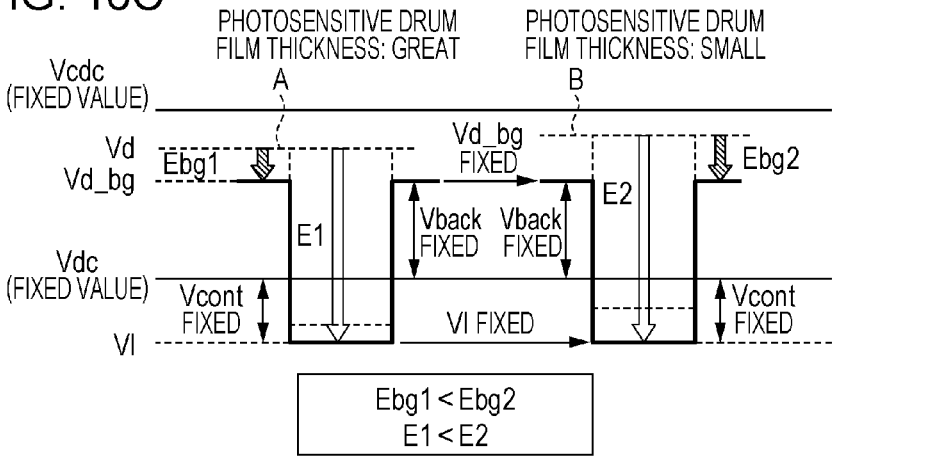

Thus, as illustrated in FIG. 16C, the developing contrast Vcont and back contrast Vback can be controlled in a generally constant manner regardless of the film thickness of the photosensitive drum, and fogging of the non-image portion can be suppressed while keeping the toner density of the image portion in a generally constant manner.

Note that, specifically, it is desirable that the charging potential Vd is −700 V to −600 V, the charging potential Vd_bg is −550 V to −400 V, the developing potential Vdc is −350 V, and the exposure potential V1 is −150 V.

Description will be made regarding a case where the developing potential Vdc and charging potential Vd have been set so that the back contrast Vback which is contrast between the developing potential Vdc and charging potential Vd (Vd−Vdc) is in a desired state, with a drum of which the film thickness is thin. When the exposure amount is constant regardless of the film thickness of the photosensitive drum, in the case of an image formation station including a photosensitive drum having a great film thickness, the back contrast Vback decreases. Therefore, the toner discharged with regular polarity readily transfers from the developing roller to the non-image portion, and fogging readily occurs. Also, the developing contrast Vcont increases, the toner density of the image portion readily becomes greater. Even in such a case, as described above, the exposure amount of normal exposure and the exposure amount of minute exposure are changed according to the film thickness of the photosensitive drum, whereby the developing contrast Vcont and back contrast Vback can be controlled in a generally constant manner regardless of the film thickness of the photosensitive drum.

Also, the image forming apparatus according to the present embodiment has a configuration in which a high-voltage power source is shared by the multiple image formation stations, whereby each of the charging voltage Vcdc and developing potential Vdc to be applied to the multiple photosensitive drums substantially becomes the same value. However, the above configuration in which the exposure amounts of normal exposure and minute exposure are changed according to the film thickness is also effective for the following configuration. Specifically, the above configuration is effective for a configuration in which substantially the same value of the charging voltage Vcdc or developing voltage Vdc is applied due to some sort of device configuration restraints at least at two image formation stations including a photosensitive drum having a different film thickness.

Correction Method of Emitted Light Quantity

Next, description will be made regarding a method for changing the emitted light quantity P (Idrv+Ib) and emitted light quantity (Ib) of each of the LDs 110*a* in a manner correlated with the remaining lives of the photosensitive drums 5Y to 5Bk, with reference to the flowchart illustrated in FIG. 17. Note that the emitted light quantities are changed while keeping the scanning speed of the optical scanning device 31 constant.

First, in step (hereinafter, referred to S) 101, the engine controller 122 reads information of the cumulative number of rotations of the photosensitive drum 5 from the storage material of each image formation station as information relating to the remaining life of the photosensitive drum 5. Note that the storage material of each image formation station means a memory tag (not illustrated) provided to the image formation stations a to d. Here, a storage unit configured to store information relating to the remaining life of each photosensitive drum 5 is not restricted to the storage material of each image formation station. For example, an arrangement may be made in which the information read from the storage material of each image formation station is temporarily stored in another storage unit, and the information stored in the other storage unit is hereinafter read and also updated. In this case, the information in the other storage unit is reflected in the storage unit of each image formation station at the time of power off of the main body of the apparatus or at the time of completion of a print job.

Also, the information relating to the remaining life of the photosensitive drum 5 is information relating to the film thickness of the photosensitive drum 5, which can be restated as information relating to a state of usage regarding how much the photosensitive drum 5 has rotated or how much the photosensitive drum 5 has been used. Also, as described in FIG. 12, this can also be restated as information relating to the sensitivity characteristic (EV curve characteristic) of the photosensitive drum 5. Both mean the same. Also, modifications of the information relating to the remaining life of the photosensitive drum may include other information correlated with the film thickness of the charge conveying layer 24*a* of the photosensitive drum in addition to the information of the cumulative number of rotations of the photosensitive drum. Examples of the information correlated with the film thickness of the charge conveying layer 24*a* of the photosensitive drum include information of the cumulative number of rotations of the intermediate transfer belt, the cumulative number of rotations of the charging roller, and the cumulative number of prints (image formation quantity) to which a paper size is added. Also, an arrangement may be made in which a device configured to directly detect the film thickness of the photosensitive drum 5 is provided corresponding to each photosensitive drum 5, and a detection result thereof is taken as information relating to the remaining life of each photosensitive drum 5 or information relating to the film thickness of the photosensitive drum 5. Also, a charging current value flowing into the charging roller 7, motor driving time of a motor configured to drive the photosensitive drum 5, driving time of a motor configured to drive the charging roller 7, or the like may be taken as information relating to the remaining life of the photosensitive drum 5 or information relating to the film thickness of the photosensitive drum 5.

In S102, the engine controller 122 references a table in which correspondence relationship between the cumulative number of rotations of the photosensitive drum 5 (state of usage of photosensitive drum) and a parameter relating to normal exposure is defined. An example of such a table is illustrated in FIG. 18. In the present embodiment, the parameter relating to normal exposure is the emitted light quantity (mW) for normal emission serving as the target value of the emitted light quantity for normal emission. The engine controller 122 references the table for each photosensitive drum. Since the film thickness may differ for each photosensitive drum, the information obtained in S101 may differ. Next, the engine controller 122 selects an exposure parameter for normal exposure of LDs 110*a* based on the information of the cumulative number of rotations obtained in S101. Specifically, the engine controller 122 sets a value equivalent to the Vref11 at each LD driver 130 (see FIG. 14) based on the selected exposure parameter for normal exposure. According to the processing in S102, the engine controller 122 obtains laser emission settings for setting the exposure potential V1 (VL) of each photosensitive drum to a target potential or potential in a permissible range regardless of the sensitivity characteristic (EV curve characteristic) of each photosensitive drum 5. Causing the LDs 110*a* to perform normal emission based on the obtained settings enables at least irregularities of the exposure potential V1 (VL) after normal exposure at each of the multiple photosensitive drums 5 to be reduced. Note that, though the target exposure potential of each photosensitive drum 5 is basically the same or generally the same, the target exposure potential may individually be set according to the characteristic of each photosensitive drum 5 in some cases. Also, in the case of using a term of "exposure" regarding the parameter, the term thereof is used in the light of exposure to be performed at each photosensitive drum. On the other hand, when exposure is performed at the photosensitive drum, there is an emission side corresponding thereto. Accordingly, in the case of the term of "exposure" being used regarding the parameter, the parameter thereof can also be said to be the parameter relating to "emission".

The operation in S102 by the engine controller 122 will be described further in detail. First, the engine controller 122 sets the emitted light quantity value (mW) corresponding to the obtained cumulative information of each photosensitive drum 5 to Vref11a to Vref11d in accordance with a PWM signal instruction. Note that, in practice, the engine controller 122 sets a voltage value or signal equivalent to the emitted light quantity value (mW) as the Vref11a to Vref11d in accordance with the PWM signal instruction. Also, the engine controller 122 sets a normal exposure (density: 0%) PWM value as the PWMIN, and sets a normal exposure (100%) PWM value as the PW255. Next, the engine controller 122 sets a pulse width as to the image data of an optional gradation value n (0 to 255) using the following Expression (1).

$$PWn = n \times (PW255 - PWMIN)/255 + PWMIN \quad (1)$$

According to Expression (1), at the time of n=0, the pulse width becomes PW0, that is, PWMIN, and at the time of n=255, becomes PW255. Hereinafter, when emission by the image data of an optional gradation value n is externally instructed, the engine controller 122 instructs the voltage value or signal equivalent to the corresponding pulse width (PWn) set here, as a VIDEO signal a. This can also be applied to VIDEO signals b to d. Also, though a 8-bit multi-value signal is assumed in Expression (1), as described above, in the case of optional m bits such as four bits, two bits, one bit (binary), or the like, a pulse width to be allocated may be determined as follows. Specifically, when the image data is 0, the pulse width at the time of the PWMIN may be allocated, and when the image data is the gradation value ($2^m-1$), the pulse width at the time of the PWMAX may be allocated.

In the next step, that is, in S103, the engine controller 122 sets parameters relating to the exposure amount for minute exposure based on the cumulative number of rotations. In S103 as well, the engine controller 122 references the table illustrated in FIG. 18 for each photosensitive drum. The parameters relating to minute exposure in this table is the emitted light quantity (mW) for minute emission serving as the emitted light quantity of minute emission, and a preceding emission period. Since the preceding emission period will be described later in detail, description will be omitted here. The engine controller 122 selects the emitted light quantity for minute emission corresponding to the cumulative information obtained in S101 for each photosensitive drum, and sets the Vref21 value (PWM value) at each LD driver 130 based on the selected emitted light quantity for minute emission. According to the processing in S103, the engine controller 122 can obtain a setting for setting the charging potential Vd of each photosensitive drum to a target potential (the value of the charging potential Vd_bg after correction) or potential in a permissible range regardless of the sensitivity characteristic (EV curve characteristic) of the photosensitive drum 5. Next, the LD driver 130 performs APC in accordance with the obtained setting, and causes the laser diodes 110*a* to perform minute emission under the control thereof, whereby at least irregularities of the charging potential after correction of the non-image portion at each of the multiple photosensitive drums 5 can be reduced. Note that the target exposure potential (corresponding to the Vref11 value) of each photosensitive drum is basically the same or generally the same, but the target exposure potential may individually be set according to the characteristic of each photosensitive drum 5 in some cases.

Thus, according to the processing in S102 and S103, as illustrated in FIG. 16C, setting of the exposure amounts of minute exposure (minute emission) and normal exposure (normal emission) can suitably be performed for each photosensitive drum in a manner correlated with the remaining life thereof. Note that, though description has been made that the engine controller 122 references the table in FIG. 18 in S102 and S103, the present invention is not restricted to this mode. For example, the CPU in the engine controller 122 may compute a computation expression. Thus, the CPU may perform computation to obtain desired setting values (Vref11a to Vref11d or Vref21a to Vref21d) from the parameters relating to the remaining life of the photosensitive drum 5 (e.g., the cumulative number of rotations of the photosensitive drum 5). Alternatively, an arrangement may be made where all values computer by Expression (1) are stored and held in a table beforehand, with the engine controller 122 referencing this table each time. Also, such as illustrated in FIG. 12, multiple EV curves each of which corresponds to each state of usage of the photosensitive drum 5 may be stored and held in a memory tag which is not illustrated. In this case, the engine controller 122 identifies the EV curve according to the obtained information relating to the state of usage of the photosensitive drum 5, and further computes necessary exposure amount (μJ/cm2) from the identified EV curve and desired photosensitive drum potential. Next, the engine controller 122 further computes emission luminance, the pulse width at the time of minute exposure, and the pulse width at the time of normal exposure from the exposure amount (μJ/cm2) obtained each time, and sets results thereof as parameters corresponding to S102 and S103.

Figure 17:
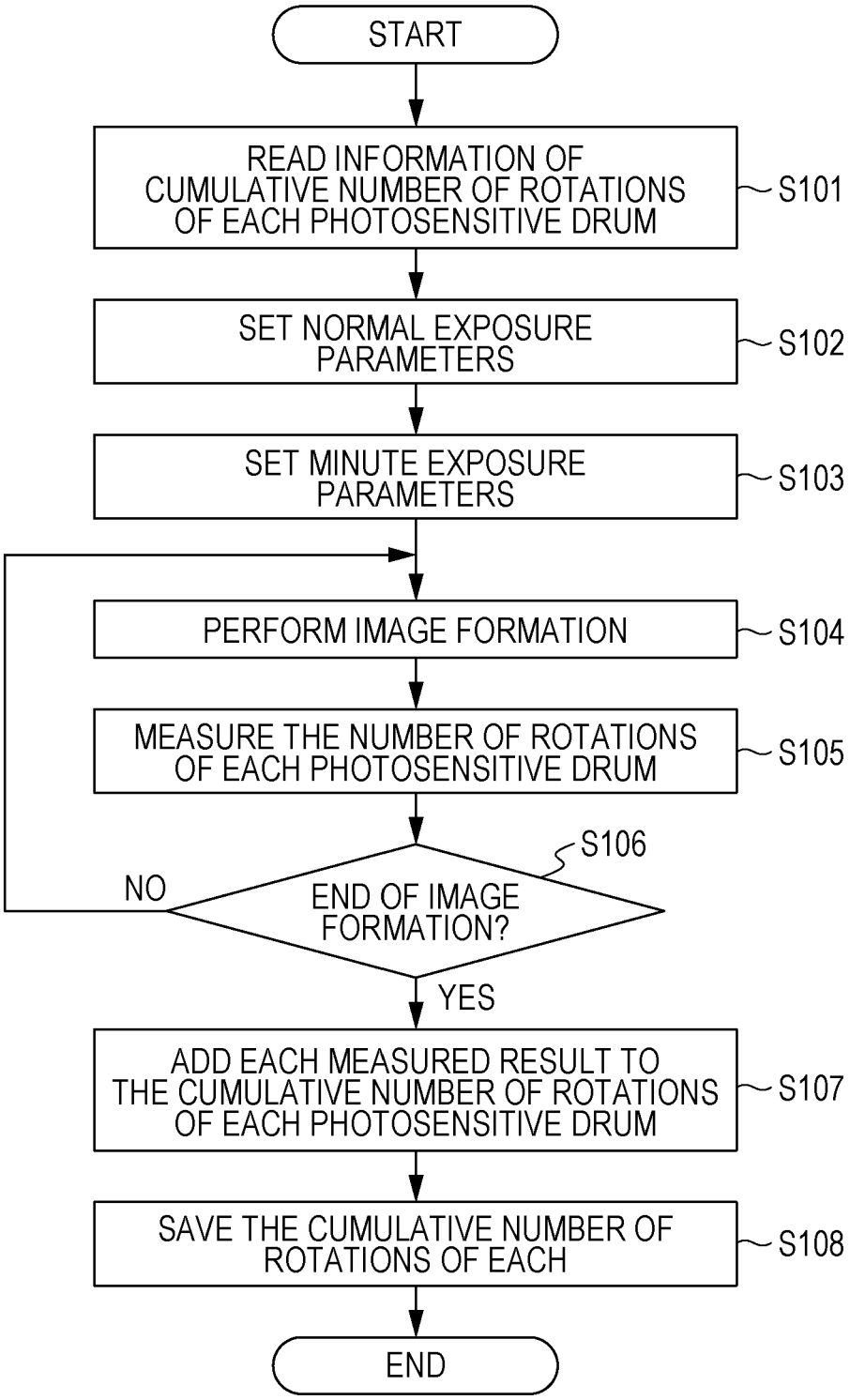
FIG. 17 is a flowchart illustrating setting processing of normal light exposure parameters and minute light exposure parameters, image formation processing, and updating processing of state of usage of a photosensitive drum.

Now, returning to the description of FIG. 17, in S104 the members execute the series of image formation operation and control described in FIG. 11A under control instructions by the engine controller 122. Also, in S105, the engine controller 122 measures the number of rotations of each of the photosensitive drums a to d which are rotated in the series of image formation. Note that this measurement processing is performed to update the state of usage of the photosensitive drum 5. Also, in practice, this processing in S105 is performed in parallel with the processing in S104.

In S106, the engine controller 122 determines whether or not the image formation is completed, and when determination is made in S106 that the image formation is completed, proceeds to S107. In S107, the engine controller 122 adds the measurement result of each photosensitive drum 5 measured in S105 to the corresponding cumulative number of rotations, and in S108 saves the cumulative number of rotations after updating to the non-volatile memory tag (not illustrated) of the corresponding image formation station. According to the processing in S108, the information relating to the remaining life of the photosensitive drum 5 is updated. Note that the save destination mentioned here may be another storage unit different from the memory tag (not illustrated) as described in S101.

Operation Sequence of LD Driver 130 During Image Formation

Figure 19:
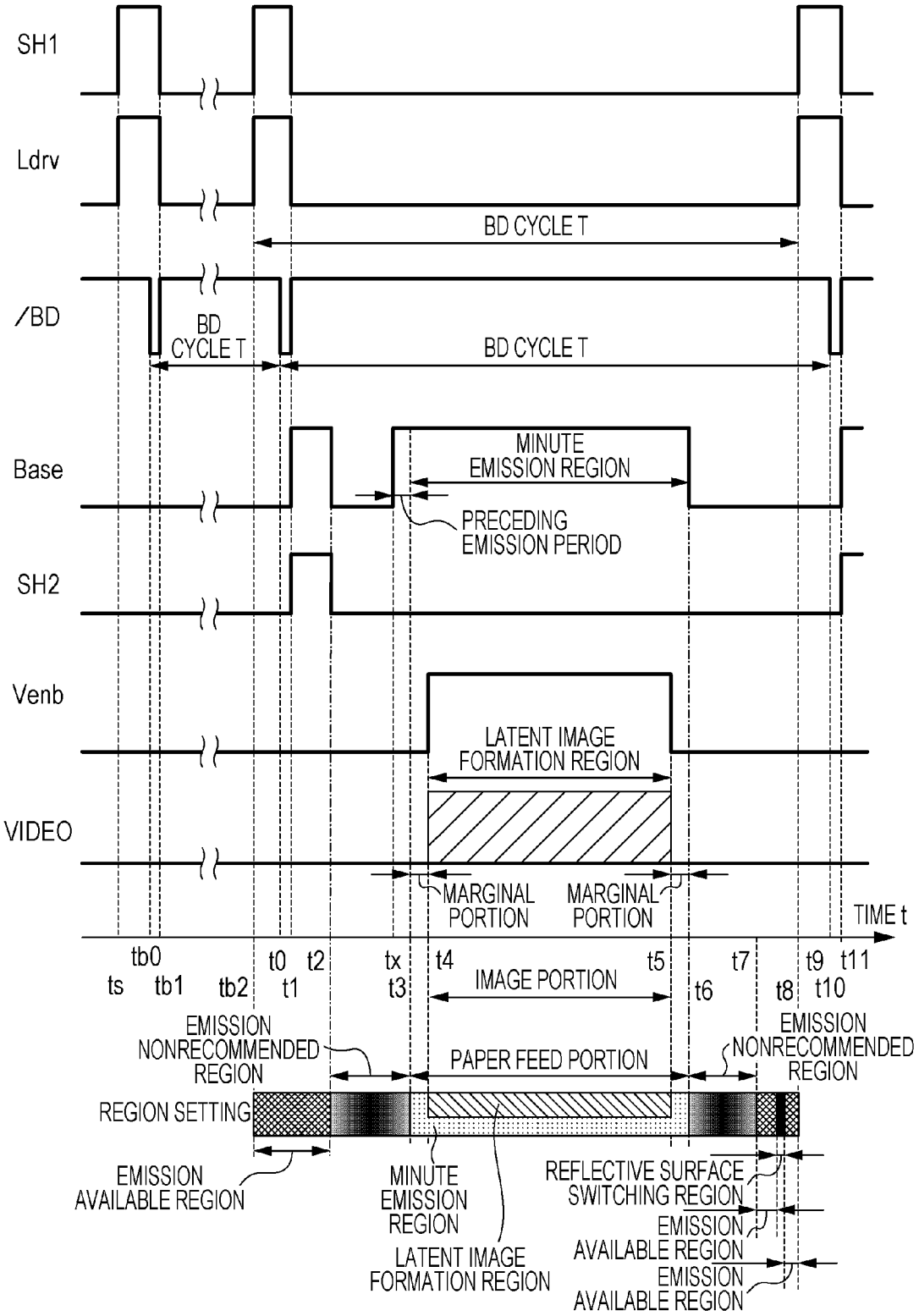
FIG. 19 is a timing chart relating to the optical scanning device at the time of image formation.

Next, the operation sequence of the LD driver 130 at the time of image formation will be described. FIG. 19 is an example of a timing chart illustrating the operation sequence of the LD driver 130 at the time of image formation. The lowermost row in FIG. 19 indicates a region setting (classification) within one scanning period. At the time of image formation, the polygon mirror 133 is rotating at speed sufficient for laser scanning of the photosensitive drum 5 (substantially, fixed speed). Note that one scanning period means a period equivalent to one BD cycle T.

First, suppose that the disable instruction has similarly been input even in the last APC at timing ts. The engine controller 122 turns on the SH1 and Ldrv signals, and turns on the switching circuit 306. Note that, hereinafter, description such as "timing ts" will simply be written as "ts". The output of the BD sensor 121 is output at tb0 as a horizontal synchronizing signal/BD. At tb0, upon the horizontal synchronizing signal/BD being detected by the engine controller 122, at tb1 the engine controller 122 turns off the SH1 and Ldrv signals, and turns off the switching circuit 306. Thus, the engine controller 122 ends the above APC of the emitted light quantity P (Idrv). Upon the APC of the emitted light quantity P (Idrv) ending, a sequence from tb1 to tb2 is performed, but this sequence is the same as a sequence from t1 to t8 described below, so description and drawing in FIG. 19 will be omitted here. Note that the engine controller 122 causes the LD 110*a* to emit light with emitted light quantity and timing according to the VIDEO signal to form a latent image principally according to the VIDEO signal between tb1 to tb2.

Next, the engine controller 122 executes APC of the emitted light quantity P (Idrv) again with output timing of the horizontal synchronizing signal/BD corresponding to the previous scanning line as a reference to perform adjustment of the Io1 (first driving current). More specifically, at tb2 after predetermined time has elapsed (before detection of the next horizontal synchronizing signal/BD), the engine controller 122 turns on the SH1 and Ldrv signals and turns on the switching circuit 306 with the output timing (tb0 or tb1) of the horizontal synchronizing signal/BD as a reference, thereby starting the APC of the emitted light quantity P (Idrv) again. Also, in response to start of the APC, the engine controller 122 turns off the Venb signal, and inputs a disable instruction to the enable terminal of the buffer 125. Thus, even when receiving error output (including noise or the like) from the video controller 123, a control instruction from the engine controller 122 relating to APC can be reflected in the control.

Next, the output from the BD sensor 121 is output at t0 as the horizontal synchronizing signal/BD. Upon the horizontal synchronizing signal/BD being detected by the engine controller 122 at to, at t1 the engine controller 122 turns off the SH1 and Ldrv signals, and turns off the switching circuit 306, and ends APC in the print level again.

Subsequently, at t1 after detection of the horizontal synchronizing signal/BD, the engine controller 122 turns on the SH2 and Base signals to start the above APC of the emitted light quantity P (Ib). Next, at t2 after predetermined time has elapsed, the engine controller 122 turns off the SH2 and Base signals to end APC of the emitted light quantity P (Ib) with the output timing (t0 or t1) of the horizontal synchronizing signal/BD as a reference. Thereafter, at tx after predetermined time has elapsed, the engine controller 122 turns on the Base signal to start supply of the driving current Ib to the LD 110*a* with the output timing (t0 or t1) of the horizontal synchronizing signal/BD as a reference. The driving current Idrv is not supplied to the LD 110*a* until later-described t4, and the LD 110*a* emits laser light using the driving current Ib. This state is kept until t6 after predetermined time has elapsed with the output timing (t0 or t1) of the horizontal synchronizing signal/BD as a reference. At t6 after predetermined time has elapsed, the engine controller 122 turns off the switching circuit 316 using the Base signal with the output timing (t0 or t1) of the horizontal synchronizing signal/BD as a reference, and ends minute emission.

The timing t3 is timing of the spot of the laser light 4 on the photosensitive drum 5 reaching a position corresponding to one edge portion in the main scanning direction (direction orthogonal to the conveying direction) of the recording material P, and tx is timing earlier than t3. The LD 110*a* performs later-described preceding emission during a period (tx to t3).

The timing t6 is timing of the spot of the laser light 4 on the photosensitive drum 5 leaving from a position corresponding to the other edge portion in the main scanning direction of the recording material P.

The engine controller 122 inputs an enable signal instruction to the enable terminal of the buffer 125 using the Venb signal from t4 after predetermined time has elapsed with the output timing (t0 or t1) of the horizontal synchronizing signal/BD as a reference. Thus, the image mask is released. Also, in response to the enable signal instruction to the enable terminal, the VIDEO signal is output from t4 after predetermined time has elapsed from the video controller 123 with the output timing (t0 or t1) of the horizontal synchronizing signal/BD as a reference. The LD driver 130 turns on/off the switching circuit 306 according to the VIDEO signal (Data signal), and the driving current Idrv subjected to pulse width modulation is superimposed on the driving current Ib. Accordingly, the LD 110*a* performs laser emission with the emitted light quantity P (Ib+Idrv) for normal emission to form a latent image on the photosensitive drum 5. This state is kept until t5 after predetermined time has elapsed (t5 is earlier timing than t6) with the output timing (t0 or t1) of the horizontal synchronizing signal/BD as a reference. The engine controller 122 inputs a disable signal instruction to the enable terminal of the buffer 125 using the Venb signal at t5 after predetermined time has elapsed with the output timing (t0 or t1) of the horizontal synchronizing signal/BD as a reference. Thus, the release period of the image mask is ended. In other words, other than that corresponds to an image mask period.

Accordingly, during a period (t4 to t5), the engine controller 122 performs normal exposure on the image portion of the photosensitive drum 5 and performs minute exposure on the non-image portion.

Also, during image formation, from t7 after predetermined time has elapsed, the engine controller 122 repeatedly executes the processing previously described at tb2 and thereafter each time the horizontal synchronizing signal/BD is output with the output timing (t0 or t1) of the horizontal synchronizing signal/BD as a reference. That is to say, t7 corresponds to tb2, and t8 and t9 correspond to t0 and t1 respectively. The operation sequence of the LD driver 130 at the time of image formation has been described so far.

Here, a period (t3 to t6) is a minute emission region where the optical scanning device 31 emits light with the minute emission level. The minute emission region is a period while the spot of the laser light 4 moves in the main scanning direction from one end to the other end of a portion (referred to as "paper feed portion") corresponding to the recording material P of the photosensitive drum 5 where image formation can be performed, and length thereof corresponds to the width in the main scanning direction of the recording material P. In the case of forming an image on the recording material P having the maximum width where an image can be formed, the paper feed portion of the photosensitive drum 5 agrees with the effective region of the photosensitive drum 5.

Also, a period (t4 to t5) is a latent image formation region where the optical scanning device 31 emits light based on the VIDEO signal. The period (t4 to t5) is a period while the spot of the laser light 4 moves in the main scanning direction from one end to the other end of a portion (referred to as "image portion") corresponding to the recording material P of the photosensitive drum 5 where image formation can be performed. The length of the period (t4 to t5) corresponds to the width in the main scanning direction of the portion of the recording material P surface where image formation can be performed.

Also, the period (t3 to t6) includes the period (t4 to t5). The period (t3 to t4) and period (t5 to t6) are of the paper feed portion of the photosensitive drum 5, a portion that is not the image portion (referred to as "marginal portion") corresponding to the marginal portion of the recording material P of the photosensitive drum 5. The optical scanning device 31 emits light to the marginal portion of the photosensitive drum 5 at a minute emission level. Thus, minute exposure is performed even on the marginal portion of the photosensitive drum 5, whereby normal fogging or reverse fogging can be suppressed from occurrence on the marginal portion.

Region Setting within Period while Performing One Scanning

Figure 20:
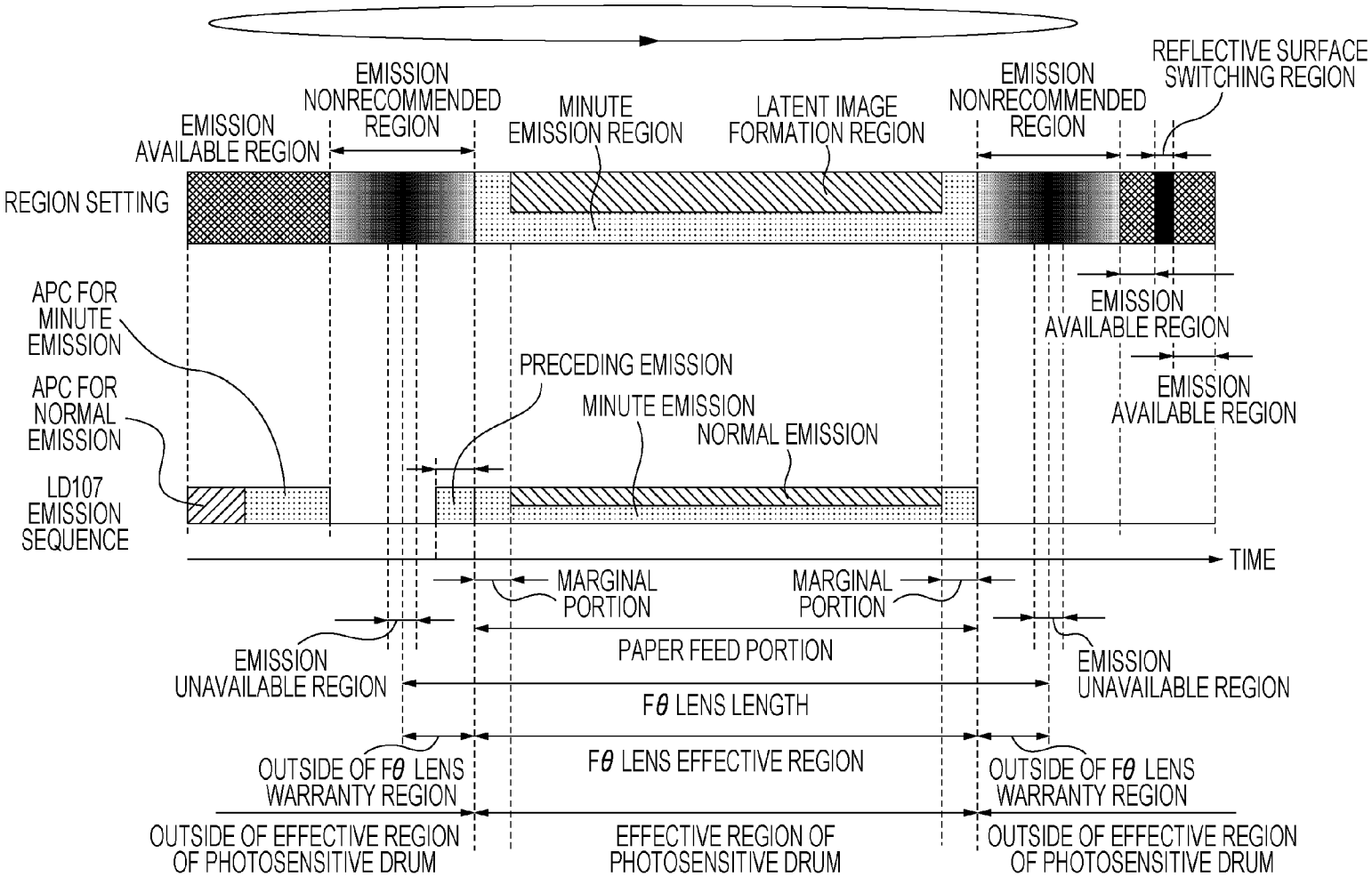
FIG. 20 is a diagram for describing region setting within a period for performing one scanning operation, and the corresponding emission sequence.
Figure 21:
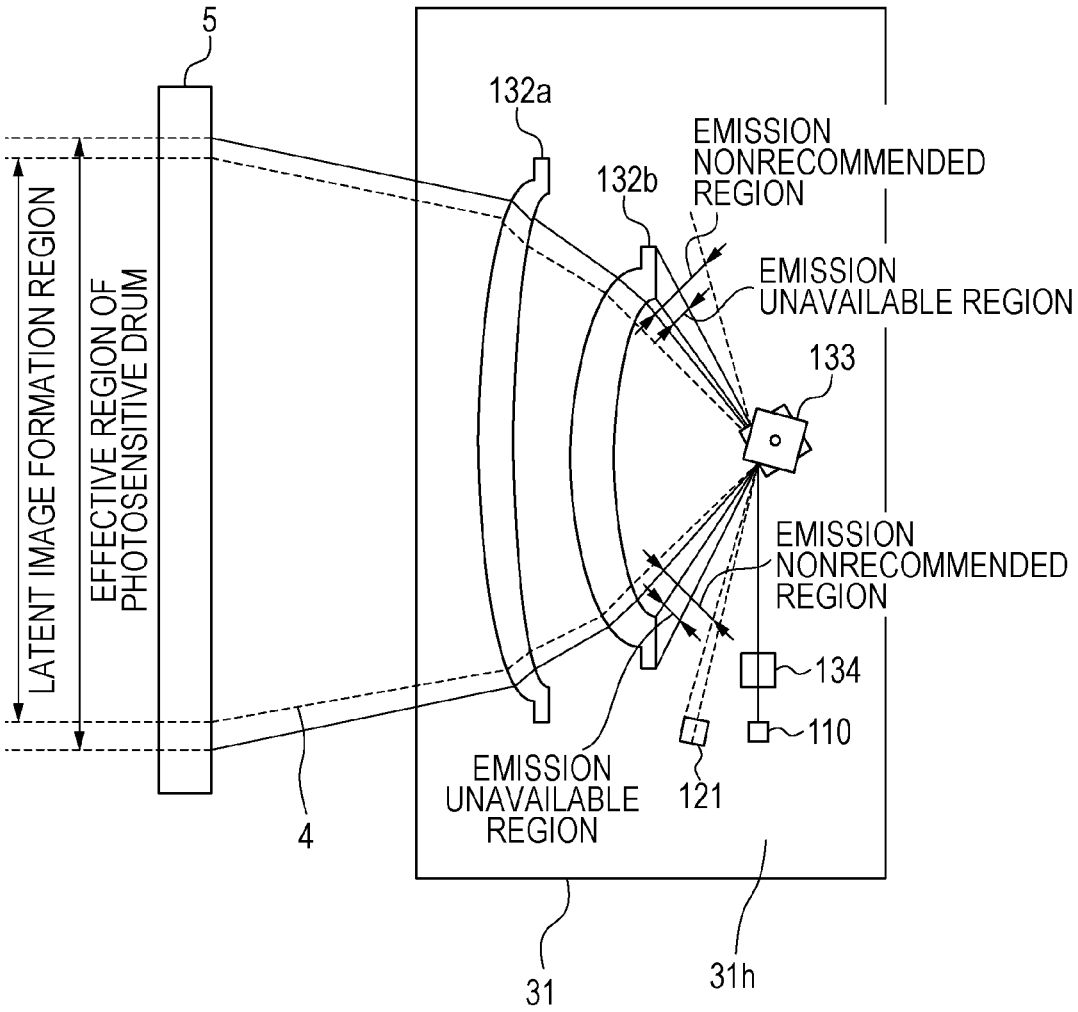
FIG. 21 is a diagram illustrating correspondence between the optical scanning device and the region setting.

Next, region setting within a period while performing one scanning will further be described with reference to FIGS. 20 and 21. The first row in FIG. 20 describes region setting, and the second row describes the actual emission sequence of the LD 110*a*. A direction from the left to the right in the lateral axis in FIG. 20 is referred to as a scanning direction. The scanning direction means a virtual direction where time elapses in one scanning, and corresponds to the main scanning direction MSD (see FIG. 13) which is the moving direction of the spot of the laser light 4 on the photosensitive drum 5. FIG. 21 is a diagram of the optical scanning device 31 as viewed from the rotation axial direction of the polygon mirror 133.

During the period while performing one scanning, there are set an emission available region, an emission non-recommended region, and a reflecting surface switching region other than the above minute emission region and latent image formation region. These are set to suppress occurrence of image defects such as ghosting according to stray light due to the shapes of the fθ lens 132 and polygon mirror 133.

Next, the emission available region, emission non-recommended region, and reflecting surface switching region will be described. As described above, the optical scanning device 31 includes the fθ lens 132. The one or more fθ lenses 132 are provided to each photosensitive drum 5. FIG. 21 illustrates an example in which the two fθ lenses 132*a* and 132*b* are provided. The fθ lens 132 includes an attachment portion configured to attach and fix two lens portions to an optical box (lens support member which is not illustrated) of the optical scanning device, and these are integrally molded by a resin which transmits light as one member.

The emission non-recommended region is a period around a period while the regular spot of the laser light 4 which is not stray light is formed in an effective region of the photosensitive drum. This emission non-recommended region is a period while laser light may be input to a portion other than an effective region of the lens portion of the fθ lens 132 (region where desired lens performance is assured as to input light, referred to as "fθ lens effective region").

The portion other than the fθ lens effective region includes, of the lens portion of the fθ lens 132, a portion which is not an effective region (referred to as "an ineffective region of the lens portion") and the attachment portions. A square-shaped corner is formed at the attachment portion of the fθ lens 132. This attachment portion is a portion where stray light generated when the laser light 4 is input readily causes image defects. Also, there is a pressing member (not illustrated) configured to fix the fθ lens 132 to the optical box by pressing the attachment portion is in contact with the attachment portion. In the case of the laser light 4 being input to this pressing member, stray light also readily causes image defects. Therefore, of the emission non-recommended region, a period while the laser light 4 may be input to the attachment portion or pressing member is set as an emission unavailable region. The LD driver 130 performs control for inhibiting emission of the LD 110*a* in this emission unavailable region in the present embodiment.

Of the emission non-recommended region, a region adjacent to the emission unavailable region and fθ lens effective region is a portion where the laser light 4 is input to the ineffective region of the lens portion of the fθ lens 132. The ineffective region of the lens portion of the fθ lens 132 has desired lens performance as the ineffective region comes closer to the fθ lens effective region. Therefore, the ineffective region of the lens portion of the fθ lens 132 is not a portion having no lens performance but a portion having a lens shape but of which the lens performance is not assured. Therefore, the ineffective region of the lens portion of the fθ lens 132 is a portion having little possibility of an image defect occurring even in the case of the laser light 4 being input thereto, in comparison with the above attachment portion and pressing member of the fθ lens 132.

Also, of the emission non-recommended region, a region adjacent to the emission unavailable region and emission available region is a portion where the laser light 4 is input to a housing 31*h* of the optical scanning device 31. The housing 31*h* has little possibility of an image defect occurring even in the case of the laser light 4 being input thereto in comparison with the above attachment portion and pressing member of the fθ lens 132. This is because input light is generally not easily reflected at the housing 31*h*, and also, even when the light is reflected at the housing 31*h*, the housing 31*h* has a trap shape which prevents the reflected light from becoming stray light.

Also, the reflecting surface switching region is set between the emission available regions, which is a period while the laser light 4 can input to a joint portion between the reflecting surfaces 133*a* of the polygon mirror 133 (see FIG. 13). Stray light generated in the case that the laser light 4 has input to the joint portion readily causes image defects. Therefore, the LD driver 130 also performs control for inhibiting emission of the LD 110*a* in this reflecting surface switching region in the same way as the emission unavailable region in the present embodiment.

As described above, region setting is performed within a period for performing one scanning, and the emission sequence of the laser light 4 is set in the light of this region setting. The above region setting is defined by allocating the period for performing one scanning to each region. Here, the period for performing one scanning (BD signal one cycle), and the phase (angle) of the laser light 4 reflected at the polygon mirror 133 during the period for performing one scanning have a relation of one-to-one correspondence. Therefore, the region setting within the above period may be read as setting for allocating the phase (angle) of the laser light 4 reflected at the polygon mirror 133 in the period for performing one scanning.

Problem in Emission Sequence of Laser Light

Next, a problem in the emission sequence of laser light will be described. When employing a laser light source such as the LD 110*a*, a droop phenomenon occurs in which the amount of light thereof deviates due to the temperature characteristic and so forth of the laser light source. Influence of this droop phenomenon may cause it to take time until the amount of light emitted from the laser light source is stabilized. In particular, there is a tendency that the smaller the driving current is, the longer time it takes until the amount of light emitted is stabilized. Therefore, in the case of causing the LD 110*a* to emit light with the second emitted light quantity which is the minute emission level to obtain a potential sufficient for preventing toner from being adhered on the photosensitive drum 5, it takes longer time until the amount of light emitted from the LD 110*a* is stabilized since emission of the LD 110*a* is performed by relatively small driving current.

Figure 22A:
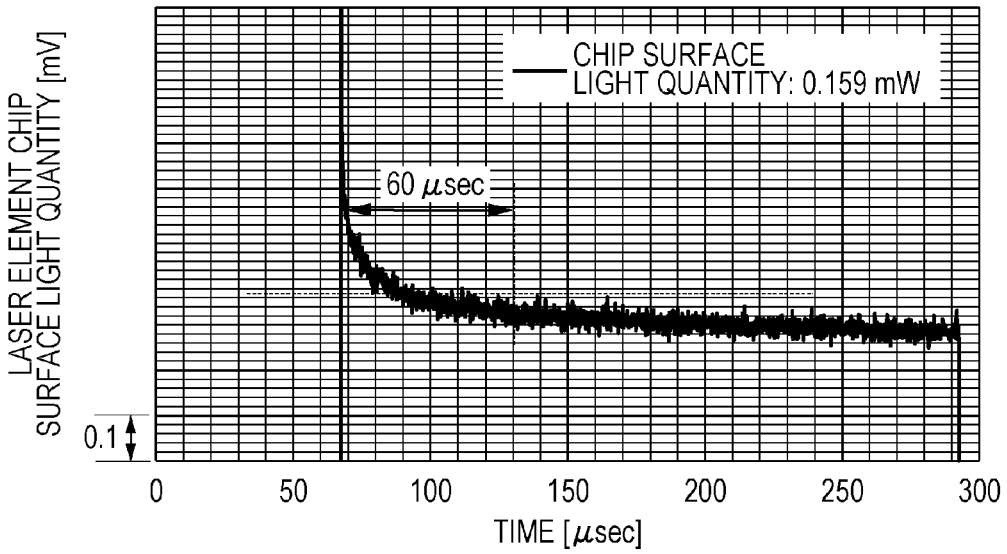
FIGS. 22A and 22B are diagrams illustrating the droop characteristic of a semiconductor laser at the time of minute emission.
Figure 22B:
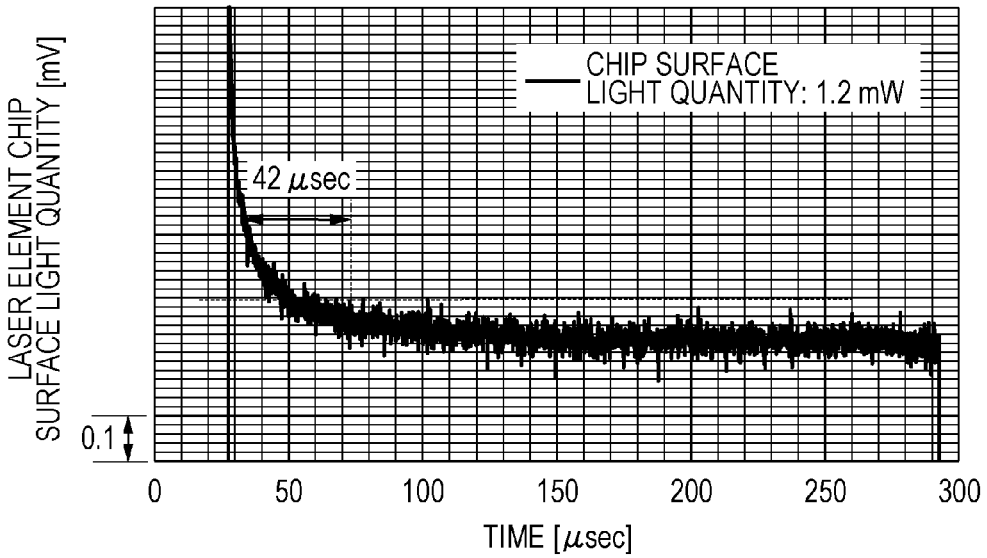

FIGS. 22A and 22B are graphs illustrating the amount of light emitted from of the LD 110*a* (the amount of light at the laser element chip surface). FIG. 22A illustrates a case where the target value of the amount of light emitted from the LD 110*a* is set to 0.159 mW, and FIG. 22B illustrates a case where the target value of the amount of light emitted from the LD 110*a* is set to 1.2 mW.

As illustrated in FIGS. 22A and 22B, in the case that the target value of the amount of light emitted is 0.159 mW, the droop stabilization time (time to substantially converge on desired emitted light quantity) is approximate 60 μsec. In the case that the target value of the amount of light emitted is 1.2 mW, the droop stabilization time is approximate 42 μsec. Thus, according to difference of the target value of the amount of light emitted, the droop stabilization time differs, and there is a tendency that the smaller the target value of the amount of light emitted is, the longer the droop stabilization time is.

Therefore, in the case that timing t3 (see FIG. 19) when the spot of the laser light 4 reaches an edge portion of a paper feed portion of the photosensitive drum 5 is set as timing to start minute emission, there is a possibility that unsuitable minute exposure is performed due to the influence of the above droop stabilization time. That is to say, there occurs a period while light of which the amount deviates from the permissible range of the target value of the amount of light emitted which is the minute emission level is irradiated on at least the marginal portion of the photosensitive drum 5, and there is a possibility that image defects such as fogging or the like will occur on a portion on which the light is irradiated during that period.

Preceding Emission

Figure 23:
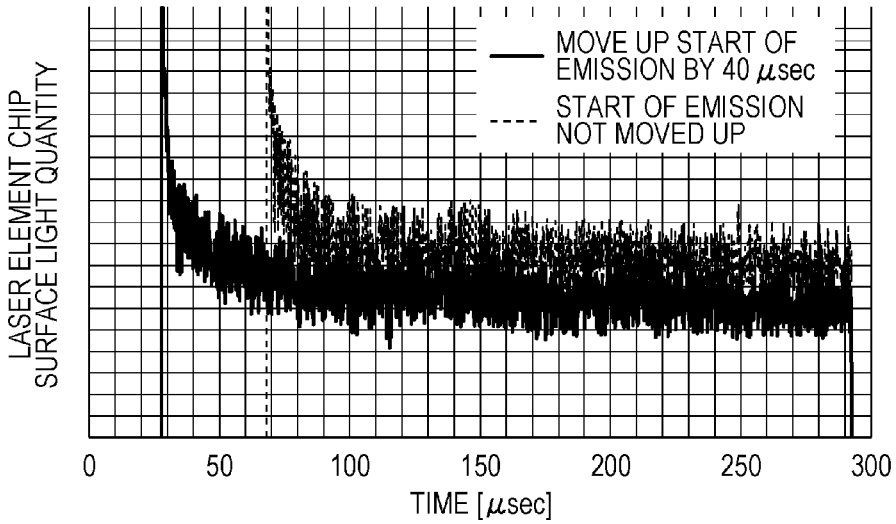
FIG. 23 is a diagram illustrating moving up the start time of minute emission.

Therefore, timing to start emission is moved up beforehand in the present embodiment. FIG. 23 is a graph illustrating the amount of light emitted (emitted light quantity at the laser element chip surface) of the LD 110*a*. FIG. 23 illustrates a sample (dashed line) when starting emission at predetermined timing, and a sample (solid line) when starting emission at earlier timing than the predetermined timing by approximate 40 μsec together. The target values of these emitted light quantities are both 1.2 mW. As described above, the droop stabilization time is approximate 42 μsec. Thus, the emission start timing is moved up by a level equivalent to the droop stabilization time, preceding emission is performed prior to the predetermined timing, whereby desired emitted light quantity can be obtained at a predetermined timing.

Specifically, as illustrated in FIGS. 19 and 20, the start timing of the minute emission region is set to tx earlier than t3, preceding emission is performed between a period (tx to t3). That is to say, control is performed so that the emission start position of minute emission is positioned further upstream than the paper feed portion in the main scanning direction.

According to such control, the amount of light emitted by the LD 110*a* is in a stabilized state at the time of t3, so image defects such as fogging or the like in the marginal portion of the photosensitive drum 5 can be suppressed.

Also, the timing tx to start preceding emission is set as timing within a region adjacent to the emission unavailable region and fθ lens effective region of the emission non-recommended region in the present embodiment. In the case of starting emission during this period, even when stray light occurs due to preceding emission, there is a relatively low possibility that an image defect will occur. Also, the target value of the amount of light emitted at the time of preceding emission is the amount of light emitted in the minute emission level for setting the surface potential of the photosensitive drum 5 to a potential sufficient for preventing toner from being adhered. Accordingly, even when stray light is irradiated on the photosensitive drum 5, a latent image having a level sufficient to influence the image is not formed. Therefore, occurrence of image defects due to stray light can be suppressed.

Change of Start Timing of Preceding Emission

Next, change of the start timing of preceding emission will be described. As described above, the target value of the emitted light quantity (second emitted light quantity) of minute light is changed in connection with the film thickness of the photosensitive drum 5 in the present embodiment. Therefore, the droop stabilization time is also changed according to the target value of the second emitted light quantity.

Therefore, in the present embodiment the period of preceding emission can be changed, and is changed in accordance with change of the target value of the second emitted light quantity. Specifically, in S101 in the flowchart illustrated in FIG. 17, the engine controller 122 obtains the information relating to the remaining life of the photosensitive drum 5 or the information relating to the film thickness of the photosensitive drum 5. Thereafter, in S103, the engine controller 122 references the table illustrated in FIG. 18 in which correspondence relationship between the cumulative number of rotations of the photosensitive drum 5 (state of usage photosensitive drum) and the parameters relating to minute exposure is defined. In addition to the emitted light quantity (target value) (mW) of minute light, the length of a preceding emission period is defined in this table as a parameter relating to minute exposure.

A preceding emission period ΔT is the length of a period from the start timing tx of a minute emission region to timing t3 when the spot of the laser light 4 reaching an edge portion of the paper feed portion of the photosensitive drum 5, a relation of ΔT t3−tx is satisfied. The start timing tx of the minute emission region is decided and set based on this preceding emission period.

Specifically, t3 is defined as timing in which a predetermined period (ΔTe) determined based the size of a recording material S has elapsed from the output timing (t0 or t1) of the horizontal synchronizing signal/BD. The engine controller 122 subtracts the above preceding emission period (ΔT) from the predetermined period (ΔTe), and holds a value (ΔTe−ΔT) thereof in memory which is not illustrated. Thus, the engine controller 122 completes setting of the start timing (the start timing of the preceding emission period) tx of the minute emission region.

At the time of image formation, the engine controller 122 counts time from the output timing (t0 or t1) of the horizontal synchronizing signal/BD, and sets timing of elapse of the period (ΔTe−ΔT) as tx. However, in one scan the start timing of the preceding emission period is positioned later than the above emission unavailable region, and the position of the laser light 4 at the time of starting preceding emission is positioned further downstream in the main scanning direction than the emission unavailable region.

Figure 24:
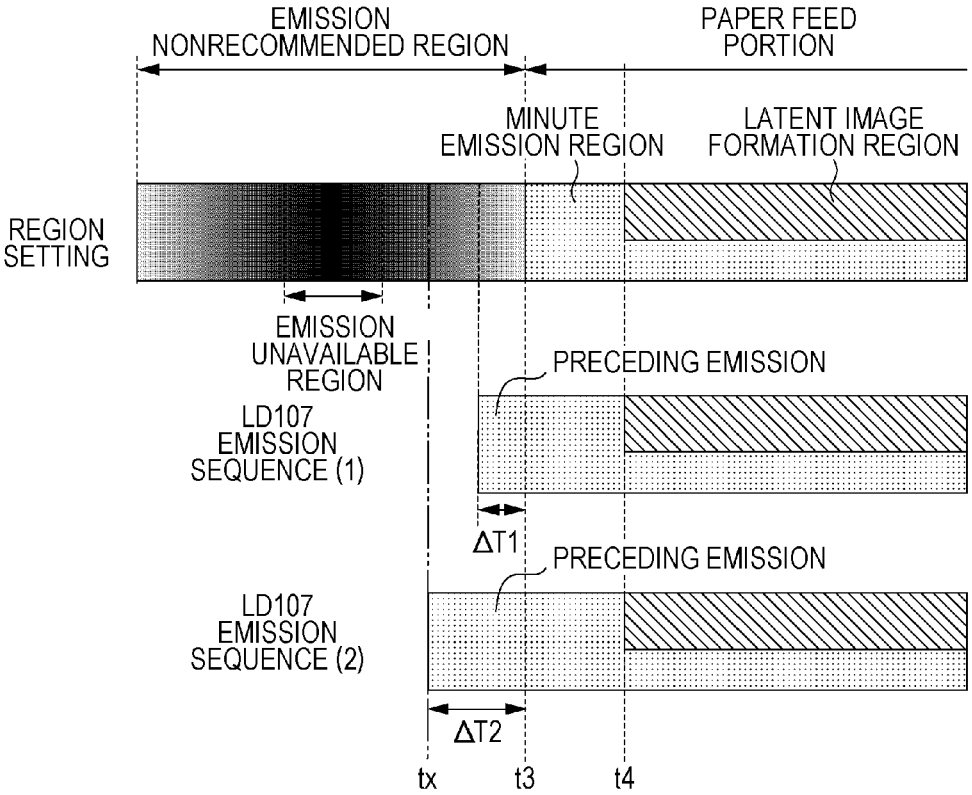
FIG. 24 is a diagram illustrating an example for changing emission start time according to the light quantity of minute emitted light quantity.

FIG. 24 is a diagram illustrating two emission sequences of the LD 110*a* to which different preceding emission periods are set in connection with the target value of the emitted light quantity of minute emission. LD 110*a* emission sequence (1)

indicates a case where 1.68 mW is set as the target value of the emitted light quantity, and LD 110*a* emission sequence (2) indicates a case where 0.42 mW is set as the target value of the emitted light quantity. According to the table illustrated in FIG. 18, a preceding emission period ΔT1 in (1) is 13.5 μsec, and a preceding emission period ΔT2 in (2) is 60.0 μsec.

Thus, the preceding emission period is changed based on the information relating to the remaining life of the photosensitive drum 5, or the information relating to the film thickness of the photosensitive drum 5, whereby preceding emission does not have to be performed for an unnecessary long period in a state in which the film thickness of the photosensitive drum 5 is reduced, and the target value of the emitted light quantity is relatively increased. Thus, while suppressing fogging of the marginal portion of the photosensitive drum 5 utilizing preceding emission, the emission period of the LD 110*a* is prevented from unnecessarily long emission, and unnecessary reduction of the life of the LD 110*a* is prevented.

Note that, though description has been made regarding the paper feed portion in the case of forming an image on the recording material P capable of image formation at the maximum width in the above embodiments, when the width of the recording material P is smaller than the maximum width, the paper feed portion is also smaller in accordance therewith. In this case, the emission start position may be set so as to secure a predetermined preceding emission period further upstream in the scanning direction than the smaller paper feed portion thereof.

As described above, according to the present embodiment, of a portion corresponding to the marginal portion of the recording material of the photosensitive member where no image formation is performed, the potential of a portion positioned further upstream than the image formation portion in the scanning direction of laser light can be stabilized so as to suppress occurrence of image defects such as fogging or the like. In addition, unnecessary emission can be suppressed to suppress unnecessary reduction of the life of the laser light source.

Also, the following configuration may be employed as another mode of the present embodiment. Instead of the optical scanning devices 31Y, 31M, 31C, and 31Bk provided corresponding to the photosensitive drums 5Y, 5M, 5C, and 5Bk, one or two optical scanning devices configured to irradiate laser beams 4Y, 4M, 4C, and 4Bk may be provided.

In this case, the optical scanning devices include four LDs 110*a* corresponding to the laser beams 4Y, 4M, 4C, and 4Bk, and are configured so that at least two of the laser beams 4Y, 4M, 4C, and 4Bk are reflected at a common polygon mirror, and are transmitted through a common fθ lens. In such a configuration in which the polygon mirror and fθ lens are shared, when stray light occurs, there is a possibility that the stray light is input to a photosensitive drum which is incapable of handling such a configuration. For example, there may be a case where the laser beam 4M is reflected at the fθ lens and becomes stray light, which is input to the photosensitive drum 5C.

In such a configuration, there may be a case where the film thicknesses of the photosensitive drums 5 differ, and the target values of the first emitted light quantity and second emitted light quantity differ from one image formation station to another. In such a case, when stray light occurs, there is a high possibility that the stray light is input to another photosensitive drum 5. However, as described above, the preceding emission period is changed based on the information relating to the remaining life of the photosensitive drum 5 or the information relating to the film thickness of the photosensitive drum 5, thereby suppressing preceding emission for an unnecessary long period. Thus, the probability of occurrence of stray light can be reduced, and the probability of influencing another image formation station can be reduced.

According to the present embodiment, of a portion corresponding to the marginal portion of the recording material of the photosensitive member where no image formation is performed, the potential of a portion positioned further upstream than the image formation portion in the scanning direction of laser light can be stabilized to suppress occurrence of image defects such as fogging or the like. In addition, unnecessary emission can be suppressed to suppress unnecessary reduction of the life of the laser light source. Also, image defects due to stray light can be suppressed from occurring at other image formation stations.

Fourth Embodiment

Japanese Patent Laid-Open No. 2012-137743 discloses performing APC for adjusting the emitted light quantity in two levels of the first emitted light quantity and second emitted light quantity to stabilize the first emitted light quantity (first emission level) and second emitted light quantity (second emission level). In general, APC control is performed by causing a laser to emit light. Accordingly, APC control is generally performed during a period after one line scanning on the photosensitive member until the next line is scanned. However, the period after one line scanning on the photosensitive member until the next line is scanned includes timing at which there is a possibility that when emitting laser light, stray light will occur. Specifically, this is timing of laser light being input to a boundary portion of the reflecting surfaces of a rotating polygonal mirror, or a corner portion of the fθ lens.

Here, in the case of emitting light in two levels of emitted light quantities of the first emitted light quantity and second emitted light quantity, such as Japanese Patent Laid-Open No. 2012-137743, time to perform APC control needs two levels worth of time. However, image formation speed has been increased in recent years, scanning speed of laser light is being increased, and the period after one line scanning on the photosensitive member until the next line is scanned is short. Therefore, in order to secure a period for executing APC control, APC control has to be executed at timing in which there is a possibility of stray light occurring. Consequently there is a possibility that stray light generated at the time of APC control will be irradiated on the photosensitive member and form an unintended latent image, which would disturb the image. Description will be made in the present embodiment regarding a configuration to suppress occurrence of image defects due to stray light generated at the time of APC control while performing APC control of the emitted light quantities in two levels. Note that the same portions as those in the first embodiment are denoted with the same reference symbols, and description thereof will be omitted.

Image Forming Apparatus

Figure 25:
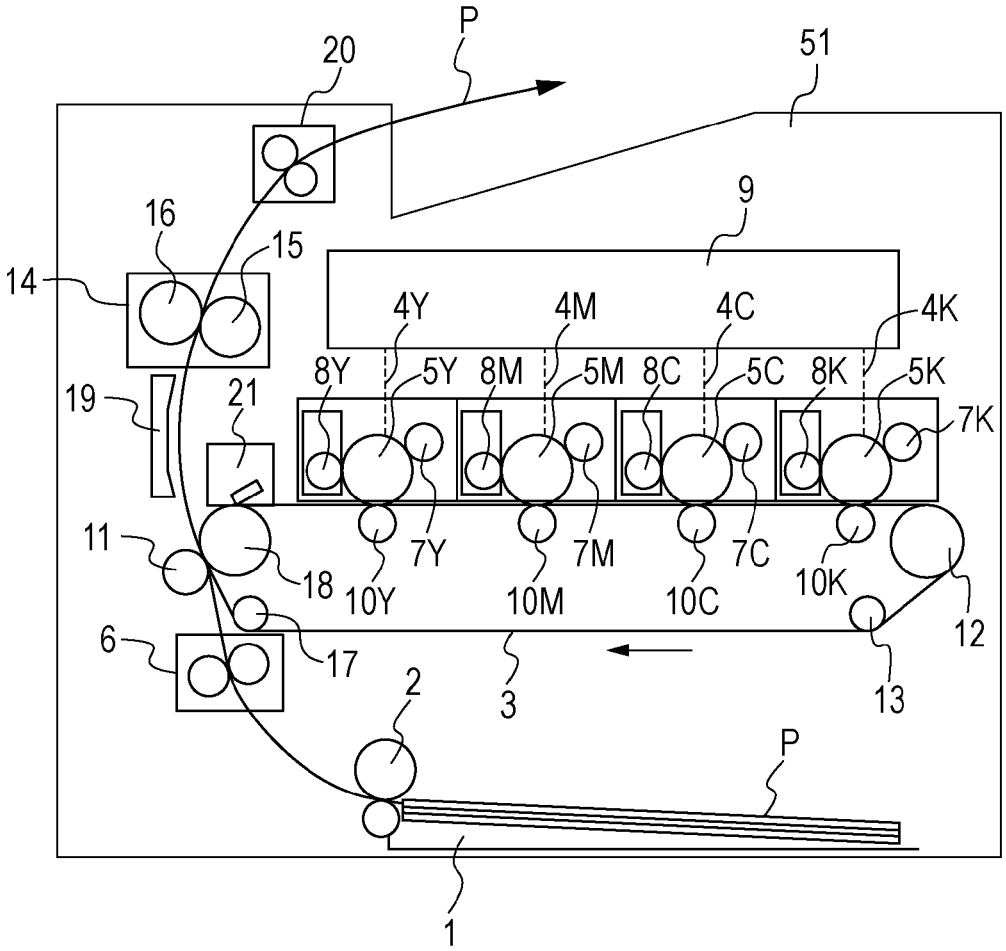
FIG. 25 is a schematic cross-sectional view of an image-forming device.

FIG. 25 is a schematic cross-sectional view of a color image forming apparatus 51. The configuration and operation of the color image forming apparatus 51 are basically the same as those in the first embodiment except for the optical scanning device 9.

Optical Scanning Device

Figure 26:
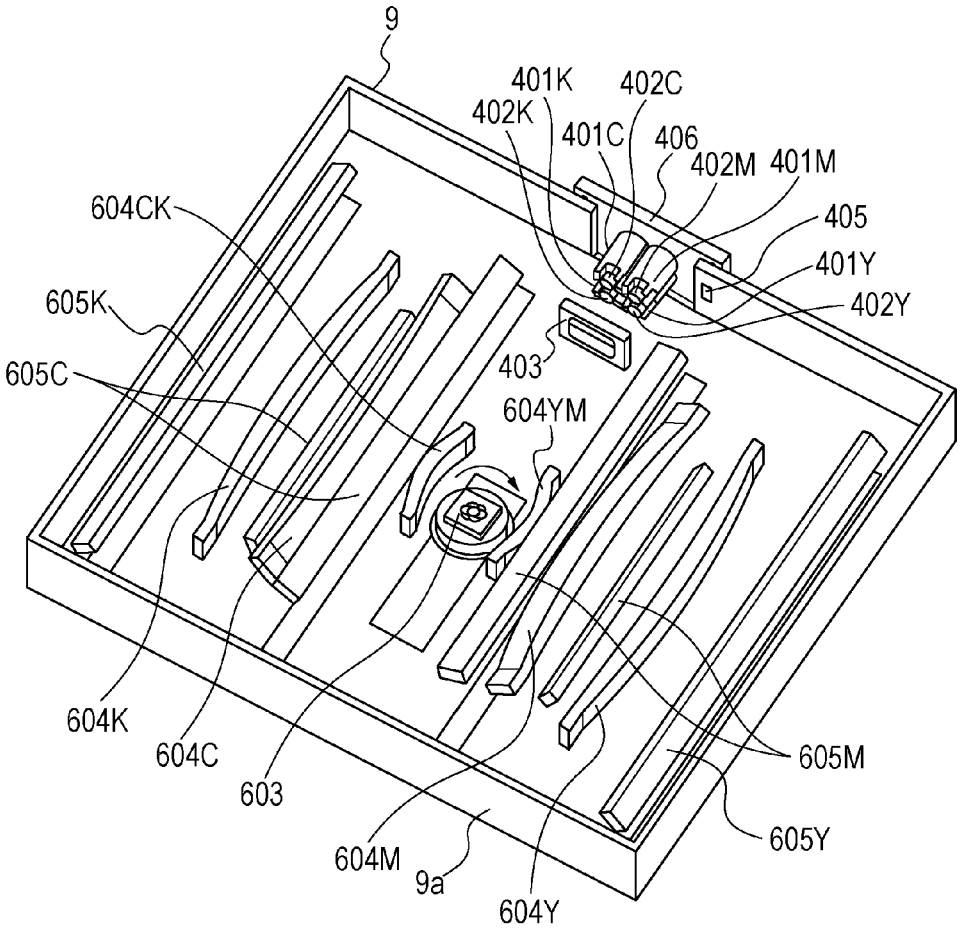
FIG. 26 is a schematic perspective view of an optical scanning device.

Next, the optical scanning device 9 serving as a light irradiating device will be described in detail. FIG. 26 is a schematic perspective view of the optical scanning device 9. The optical scanning device 9 irradiates laser beams 4Y to 4K on four photosensitive drums 5Y to 5K. The optical scanning device 9 houses light sources 401 (401Y, 401M, 401C, and 401K) which are semiconductor lasers, collimator lenses 402

(402Y, 402M, 402C, 402K), an anamorphic lens 403, a rotating polygon mirror 603, fθ lenses 604 (604YM and 604CK), mirrors 605 (605Y, 605M, 605 C, and 605K), and a BD sensor 405 in one optical box 9*a*. Also, the optical scanning device 9 includes a laser driving circuit 406 configured to cause the light sources 401 to emit light.

Figure 27A:
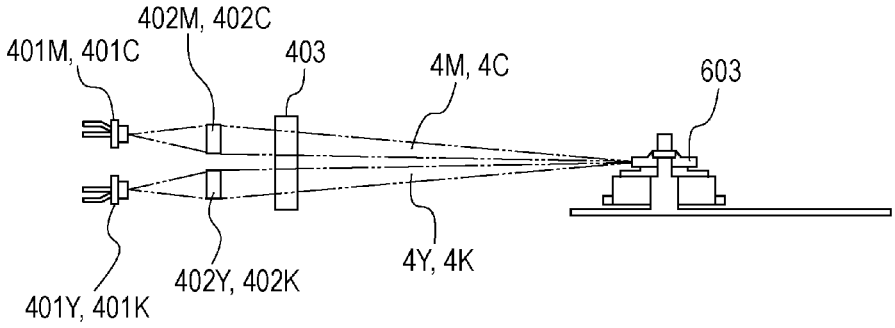
FIG. 27A is a diagram illustrating an optical path from a light source to a rotating polygon mirror.
Figure 27B:
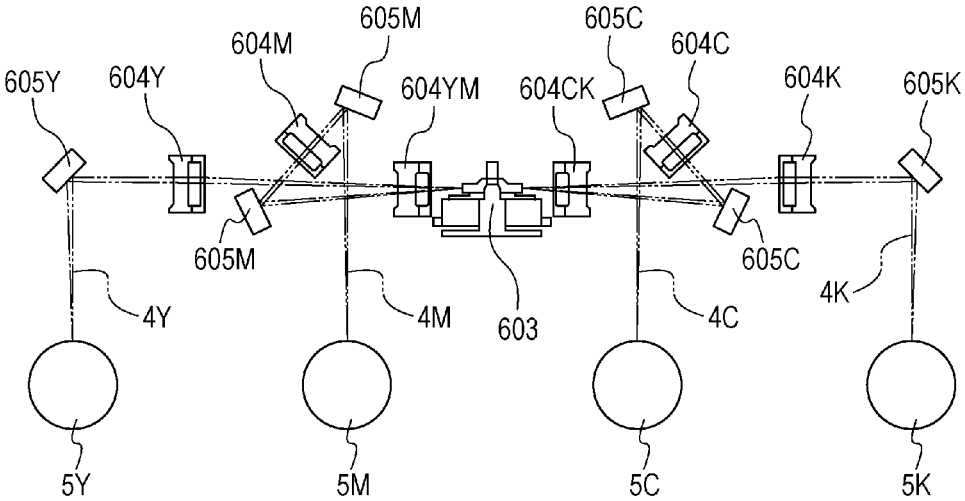
FIG. 27B is a diagram illustrating an optical path from the rotating polygon mirror to each photosensitive drum.

Next, the optical paths of the laser beams 4 emitted from the light sources 401 will be described with reference to FIGS. 27A and 27B. FIG. 27A is a diagram illustrating optical paths from the light sources 401 to the rotating polygon mirror 603. The laser beams 4 emitted from the light sources 401 transmit through the corresponding collimator lens 402 and become parallel light, and pass through the anamorphic lens 403 and are input to the reflecting surface of the rotating polygon mirror 603 in a predetermined shape, and form an image. FIG. 27B is a diagram illustrating optical paths from the rotating polygon mirror 603 to multiple photosensitive drums 5. The laser beams 4Y and 4M reflected at the rotating polygon mirror 603 each transmit through the fθ lenses 604YM, 604Y, and 604M, and are also reflected at the mirrors 605Y and 605M in a predetermined direction, and finally irradiated on the photosensitive drums 5Y and 5M, and form an image. The laser beams 4C and 4K reflected at the rotating polygon mirror 603 each transmit through the fθ lenses 604CK, 604C, and 604K, and are also reflected at the mirrors 605C and 605K in a predetermined direction, and finally irradiated on the photosensitive drums 5C and 5K, and form an image.

The rotating polygon mirror 603 rotates in an arrow direction in FIG. 26, thereby moving the spots where image formation is performed by the laser beams 4, in the main scanning direction (rotational direction of the photosensitive drum 5) on the photosensitive drums 5 to form a scanning line on the photosensitive drums 5. Thus, moving the spots on the photosensitive drums 5 to form a scanning line while the laser beams 4 are reflected at the rotating polygon mirror 603 is called deflection scanning (main scanning). Also, rotating the photosensitive drums 5 to form a new scanning line on the photosensitive drums 5 is called sub scanning.

The BD sensor 405 is provided in a position where the laser beam emitted from the light source 401Y and reflected at the rotating polygon mirror 603 can be received, which is a position outside a later-described image formation region in (a) in FIG. 33. The BD sensor 405 receives the laser beam emitted from the light source 401Y and reflected at the rotating polygon mirror 603 to generate a BD signal based thereon at timing before the laser beam 4Y performs one line main scanning next after completing one line main scanning. Timing for starting irradiation of the laser beams 4Y to 4M on the photosensitive drums 5 to form a scanning line is determined based on this BD signal.

The optical scanning device 9 irradiates, on the image portion of each photosensitive drum 5 where toner is adhered, the light emitted with the first emitted light quantity (normal emission) for changing the surface potential of the photosensitive drum 5 to a potential sufficient for adhering toner according to the gradation of an image. Further, the optical scanning device 9 performs minute emission on the non-image portion to optimize the potential of the non-image portion of the photosensitive drum 5 where no toner is adhered. Specifically, the optical scanning device 9 irradiates, on the non-image portion of each photosensitive drum 5, the light emitted with the second emitted light quantity (minute emission) smaller than the first emitted light quantity for changing the surface potential of the photosensitive drum 5 to a potential sufficient for adhering no toner. Thus, the optical scanning device 9 performs minute emission on the non-image portion of the photosensitive drum 5, whereby the potential of the non-image portion of the photosensitive drum 5 can be changed to a potential sufficient for suppressing normal fogging or reverse fogging of toner, involvement of an electric field of the image portion, and so forth. Specifically, the charging potential Vd is preferably set to −700 V to −600 V, the charging potential Vd_bg is preferably set to −550 V to −400 V, and the exposure potential Vi is preferably set to −150 V.

Also, the number of mirrors 605 provided to the optical paths of the laser beams 4M and 4C, and the optical paths of the laser beams 4Y and 4K differs so that the optical length from each light source 401 to the corresponding photosensitive drum 5 has the same length. Specifically, the double mirrors 605M and 605C are provided as to the laser beams 4M and 4C which are irradiated on the photosensitive drums 5M and 5C a short distance from the rotating polygon mirror 603 respectively, and the single mirrors 605Y and 605K are provided as to the laser beams 4Y and 4K respectively. Here, in general, at the time of reflecting a laser beam at a mirror, the light quantity is slightly attenuated. Therefore, the greater the number of the mirrors 605 is, the more the light quantity is attenuated until the light beams reaches the corresponding photosensitive drum 5. Accordingly, in the case of irradiating light of the same light quantity on each photosensitive drum 5, the emitted light quantities of the light sources 401Y to 401K are set so that the emitted light quantities of the light sources 401M and 401C are greater than those of the light sources 401Y and 401K.

Laser Driving Circuit

Figure 28:
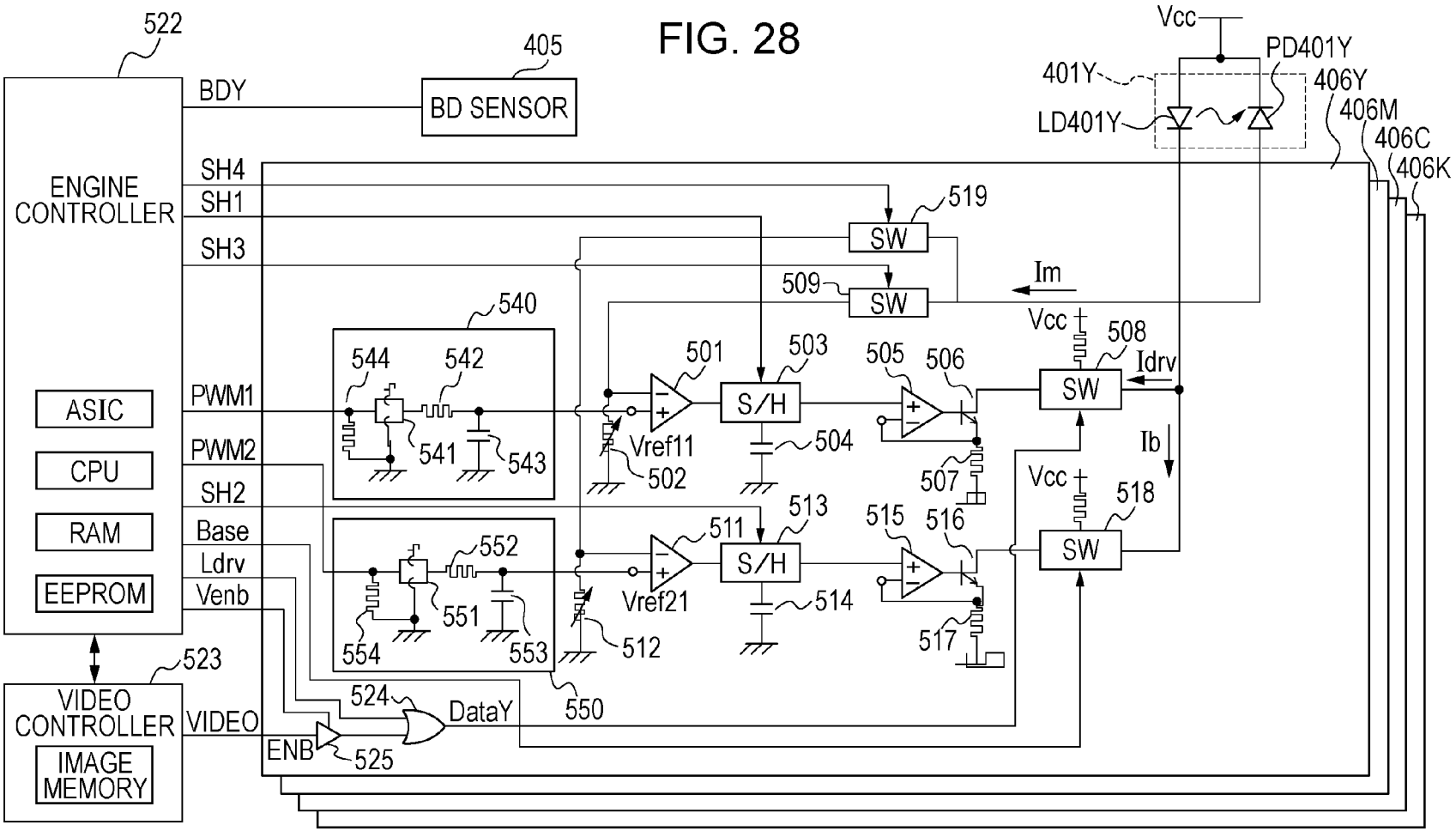
FIG. 28 is a diagram illustrating a laser driving circuit system.

Next, description will be made regarding the laser driving circuits 406 (406Y, 406M, 406C, and 406K) configured to cause the light sources 401 of the optical scanning device 9 to emit light. FIG. 28 is a diagram illustrating the laser driving circuits 406. Though the laser driving circuits 406Y to 406K are provided to the light sources 401Y to 401K, the laser driving circuits 406Y to 406K have the same configuration and operation, so the light source 401Y and the laser driving circuit 406Y which drives the light source 401Y will be described as an example, and description regarding others will be omitted. The laser driving circuits 406Y to 406K are provided on a single substrate, and FIG. 26 illustrates a substrate on which the laser driving circuits 406Y to 406K are provided as the laser driving circuit 406.

The laser driving circuit 406Y is connected with the light source 401Y, engine controller 522, and video controller 523.

The light source 401Y includes a laser diode (hereinafter, LD 401Y) which is a light emitting element, and a photodiode (hereinafter, PD 401Y) which is a light receiving element.

The engine controller 522 houses an ASIC, CPU, RAM, and EEPROM, in a connected manner, and controls operation of each portion of the image forming apparatus including the optical scanning device 9. Also, the engine controller 522 is connected with the BD sensor 405. The above-described BD signal is input to the engine controller 522, and the engine controller 522 determines timing to cause the LD 401 Y to emit light with this BD signal as a reference. The video controller 523 generates a VIDEO signal to cause the LD 401Y to emit light based print data transmitted from an external device such as an externally connected reader scanner or host computer or the like.

The laser driving circuit 406Y includes comparator circuits 501 and 511, variable resistors 502 and 512, sampling-and-hold circuits 503 and 513, hold capacitors 504 and 514, operational amplifiers 505 and 515, and transistors 506 and 516. Also, the laser driving circuit 406Y includes switching current setting resistors 507 and 517, switching circuits 508, 509, 518, and 519, inverters 541 and 551, resistors 542 and 552 configured to smooth PWM1 and PWM2 signals, capacitors 543 and 553 configured to smooth PWM1 and PWM2 signals, and pull-down resistors 544 and 554. The portions 501 to 509 and 541 to 544 are equivalent to a light quantity adjustment device for the first emitted light quantity, and the portions 511 to 519 and 551 to 554 are equivalent to a light quantity adjustment device for the second emitted light quantity, which will be described later in detail.

The laser driving circuit 406Y includes an OR circuit 524. A Ldrv signal of the engine controller 522 and a VIDEO signal from the video controller 523 are input to the OR circuit 524, and an output signal DataY is connected to the switching circuit 508.

The VIDEO signal output from the video controller 523 is input to a buffer 525 with an enable terminal, and the output of the buffer 525 is connected to the OR circuit 524. At this time, the enable terminal is connected with a Venb signal from the engine controller 522. Also, the engine controller 522 are connected with later-described SH1 signal, SH2 signal, SH3 signal, SH4 signal, and BASE signal, and the Ldrv signal and Venb signal so as to output these to the laser driving circuit 406Y.

A first reference voltage Vref11 and a second reference voltage Vref21 are input to the positive-electrode terminals of the comparator circuits 501 and 511 respectively, and outputs thereof are input to the sampling-and-hold circuits 503 and 513 respectively. The reference voltage Vref11 is set as target voltage to cause the LD 401Y to emit light with the amount of light for normal emission (first emitted light quantity). Also, the reference voltage Vref21 is set as target voltage of the amount of light for minute emission (second emitted light quantity). The PWM1 signal (duty value) and PWM2 signal (duty value) which are reference values for setting the reference voltage Vref11 and reference voltage Vref21 are each input from the engine controller 522. The hold capacitors 504 and 514 are connected to the sampling-and-hold circuits 503 and 513, respectively. The outputs of the hold capacitors 504 and 514 are input to the positive-electrode terminals of the operational amplifiers 505 and 515, respectively.

The negative-electrode terminal of the operational amplifier 505 is connected with the resistor 507 for setting switching current, and the emitter terminal of the transistor 506, and output thereof is input to the base terminal of the transistor 506. The negative-electrode terminal of the operational amplifier 515 is connected with the resistor 517 for setting switching current, and the emitter terminal of the transistor 516, and output thereof is input to the base terminal of the transistor 516. Also, the collector terminals of the transistors 506 and 516 are connected with the switching circuits 508 and 518, respectively. According to the operational amplifiers 505 and 515, transistors 506 and 516, and resistors 507 and 517 for setting current, there are determined the driving current Idrv and Ib of the LD 401Y according to the output voltages of the sampling-and-hold circuits 503 and 513.

The switching circuit 508 is turned on/off by a pulse modulation data signal Data. The switching circuit 518 is turned on/off by an input signal Base.

The output terminals of the switching circuits 508 and 518 are connected with the cathode of the LD 401Y, and supply the driving currents Idrv and Ib thereto. The anode of the LD 401Y is connected with power supply Vcc. The cathode of the PD 401Y configured to monitor the amount of light emitted from the LD 401Y is connected with the power supply Vcc, and the anode of the PD 401Y is connected with the switching circuits 509 and 519. Monitor current Im is applied to the variable resistors 502 and 512 at the time of APC control, thereby converting the minor current Im into monitor voltage Vm. This monitor voltage Vm is input to the negative-electrode terminals of the comparator circuits 501 and 511.

The SH1 signal output from the engine controller 522 is a signal to perform switching between the sampling state and hold state of a later-described sampling-and-hold circuit 503. The SH2 signal is a signal to perform switching between the sampling state and hold state of a later-described sampling-and-hold circuit 513. The SH3 signal is a signal to switch on/off of the switching circuit 509. The SH4 signal is a signal to switch on/off of the switching circuit 519. The PWM1 signal and PWM2 signal are signals configured to set the voltages of a later-describe reference voltage Vref11 and reference voltage Vref21, respectively. The Base signal is a signal to switch on/off of the switching circuit 518. The Ldrv signal is input to the OR circuit 524, and is a signal to switch on/off of the DataY signal. The Venb signal is connected to the enable terminal of a buffer 525 with an enable terminal, and is a signal to switch on/off of the VIDEO signal input from the video controller 523 to the buffer 525 with an enable terminal.

Note that, though FIG. 28 separately illustrates the laser driving circuit 406, engine controller 522, and video controller 523, the present invention is not restricted to this mode. For example, part or all of the laser driving circuit 406 and video controller 523 may be housed in the engine controller 522.

APC for Minute Emission

Next, APC control of the second emitted light quantity which is APC for minute emission will be described. The engine controller 522 sets the sampling-and-hold circuit 503 to the hold state according to the instruction of the SH1 signal, and also sets the switching circuit 508 to the off operating state according to the DataY signal. The engine controller 522 sets, regarding the DataY signal, the Venb signal connected with the enable terminal of the buffer 525 to the disabled state, and controls the Ldrv signal to turn off the DataY signal. Also, the engine controller 522 sets the sampling-and-hold circuit 513 to the sampling state according to the instruction of the SH2 signal, and turns off the switching circuit 509 according to the instruction of the SH3 signal. Also, the engine controller 522 turns on the switching circuit 519 according to the instruction of the SH4 signal, and turns on, according to the Base signal, the switching circuit 518, so that the LD 401Y transitions to the emission state with the second emitted light quantity. In this state, the driving current Ib is supplied to the LD 401Y, and the LD 401Y emits light. The PD 401Y receives the light emitted from the LD 401Y to generate monitor current Im proportional to the received light quantity thereof. The monitor current Im flows into the variable resistor 512, thereby converting the monitor current Im into monitor voltage Vm2. Also, the comparator circuit 511 adjusts the driving current Ib of the LD 401Y via the operational amplifier 515 and so forth so that the monitor voltage Vm2 agrees with the reference voltage Vref21. Further, the comparator circuit 511 charges/discharges the capacitor 514. Thereafter, the engine controller 522 sets the sampling-and-hold circuit 513 to the hold state according to the instruction of the SH2 signal, thereby ending APC control of the second emitted light quantity.

During non-APC operation, that is, at the time of irradiating light on the photosensitive drum 5Y, the sampling-and-hold circuit 513 goes into the hold state to hold the voltage charged in the capacitor 514, supplies the constant driving current Ib to maintain the emitted light quantity of the LD 401Y so that minute emission is performed with the desired second emitted light quantity. This desired second emitted light quantity P (Ib) means emitted light quantity for changing the potential of the photosensitive drum 5Y surface to a potential sufficient for suppressing toner from being adhered on the photosensitive drum 5Y by preventing normal fogging, reverse fogging, or the like.

APC for Normal Emission

Next, APC control of the first emitted light quantity which is APC for normal emission will be described. The engine controller 522 sets the sampling-and-hold circuit 503 to the sampling state according to the instruction of the SH1 signal, and also sets the sampling-and-hold circuit 513 to the hold state according to the instruction of the SH2 signal. Also, the engine controller 522 turns on the switching circuit 509 according to the instruction of the SH3 signal, and turns on the switching circuit 509 according to the instruction of the SH4 signal. Next, the engine controller 522 turns off the switching circuit 519 according to the instruction of the DataY signal, and turns on the switching circuit 518 according to the instruction of the Base signal. In this state, the driving current Idrv+Ib is supplied to the LD 401Y, and the LD 401Y emits light. The PD 401Y receives the light emitted from the LD 401Y to generate monitor current Im proportional to the received light quantity thereof. The monitor current Im flows into the variable resistor 502, thereby converting the monitor current Im into monitor voltage Vm1. Also, the comparator circuit 501 adjusts the driving current Idrv of the LD 401Y via the operational amplifier 505 and so forth so that the monitor voltage Vm1 agrees with the reference voltage Vref11. Further, the comparator circuit 501 charges/discharges the capacitor 504. Thereafter, the engine controller 522 sets the sampling-and-hold circuit 503 to the hold state according to the instruction of the SH1 signal, thereby ending APC control of the first emitted light quantity.

During non-APC operations, that is, at the time of irradiating light on the photosensitive drum 5Y, the sampling-and-hold circuits 503 and 513 go into the hold state to hold the voltage charged in the capacitor 504, which is a state in which the driving current Idrv can be delivered. The driving current Idrv is supplied to the LD 401Y in a state in which the driving current Ib is supplied to the LD 401Y, whereby the LD 401Y emits light with the desired first emitted light quantity (Idrv+Ib). This desired first emitted light quantity means emitted light quantity for changing the potential of the photosensitive drum 5Y surface to a potential sufficient for adhering toner on the photosensitive drum 5Y by irradiating the light emitted with the emitted light quantity thereof on the photosensitive drum 5Y.

As described above, the engine controller 522 performs APC control with the first emitted light quantity and second emitted light quantity on the LD 401Y by operating the laser driving circuit 604Y.

Operation in Image Formation Region

Next, description will be made regarding operation in the image formation region which is a period for irradiating light on the photosensitive drum 5Y. At the time of emitting light with the first emitted light quantity and second emitted light quantity in the image formation region, the engine controller 522 sets the sampling-and-hold circuits 503 and 513 to the hold state according to the instructions of the SH1 and SH2 signals, and turns off the switching circuits 509 and 519 according to the instructions of the SH3 and SH4 signals.

Also, the engine controller 522 turns on the switching circuit 518 according to the instruction of the Base signal. Thus, the voltage charged in the capacitor 514 is held, and the constant driving current Ib is supplied to the LD 401Y. Further, based on the output from the BD sensor 405, the pulse modulation data signal DataY serving as the VIDEO signal from the video controller 523 is transmitted to the switching circuit 508 of the laser driving circuit 530. The switching circuit 508 switches on/off according to this pulse modulation data signal DataY. The voltage charged in the capacitor 504 is held, so whether or not the driving current Idrv is supplied to the LD 401Y is switched according to on/off of the switching circuit 508.

The switching circuit 508 turns on as to the image portion which is a portion of the photosensitive drum 5 surface where toner is adhered, and the driving current Idrv+Ib is supplied to the LD 401Y. Therefore, the LD 401Y emits light with the first emitted light quantity P (Idrv+Ib) to irradiate the light on the photosensitive drum 5. Also, the switching circuit 508 turns off as to the non-image portion which is a portion of the photosensitive drum 5 surface where no toner is adhered, and the driving current Ib alone is supplied to the LD 401Y without supplying the driving current Idrv thereto. Therefore, the LD 401Y emits light with the second emitted light quantity P (Ib) to irradiate the light on the photosensitive drum 5.

Necessity of Change of Emitted Light Quantity of Minute Emission

Next, change of the emitted light quantity of minute emission will be described. Note that the image forming apparatus 51 has a configuration in which the high-voltage power source for charging and high-voltage power source for developing are each shared for reduction in cost and reduction in size, and substantially the same charging voltage Vcdc and developing voltage Vdc are output to the photosensitive drums 5Y to 5K. Note that the resistance values and so forth of circuits and electric elements have error in the high-voltage power source for charging and high-voltage power source for developing, the charging voltage Vcdc and developing voltage Vdc to be actually applied to the photosensitive drums 5Y to 5K may vary. However, since such irregularities are within the margin of error, it can be said that substantially the same charging voltage Vcdc and developing voltage Vdc are output.

When usage of the photosensitive drum 5 advances, the photosensitive drum surface is deteriorated due to discharging of the charging roller 7, and also the photosensitive drum surface is scraped by being rubbed with an unshown cleaning device, and the film thickness thereof is reduced. When the photosensitive drum is charged by the charging roller to which the same charging voltage Vcdc has been applied, the smaller the film thickness of the photosensitive drum is, the higher the charging potential Vd according to the charging roller is. Therefore, in a state in which the photosensitive drums 5 having different film thicknesses coexist, when applying the same charging voltage Vcdc to all of the photosensitive drums 5 using the shared high-voltage power source for charging, the charging potentials Vd of the surfaces of the photosensitive drums 5 vary depending on film thickness. That is to say, the absolute value of the charging potential Vd of the surface of the photosensitive drum 5 having a great film thickness decreases, and the absolute value of the charging potential Vd of the surface of the photosensitive drum 5 having a small film thickness increases.

Figure 29A:
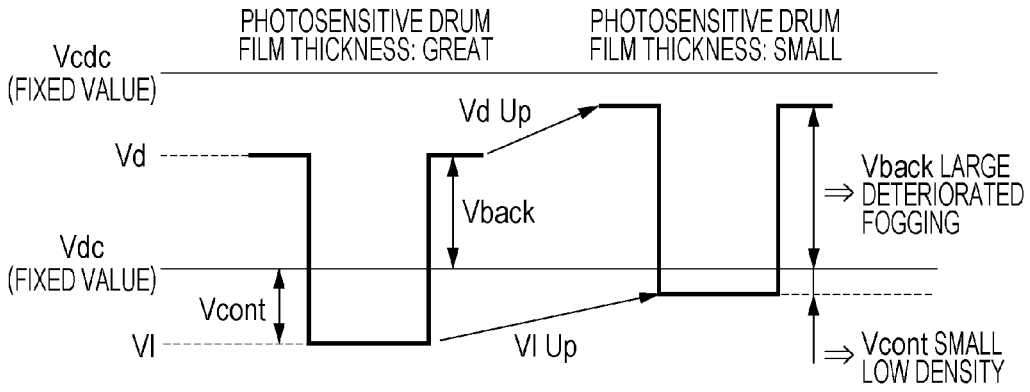
FIGS. 29A and 29B are diagrams illustrating the potential at an image portion and a non-image portion on the surface of the photosensitive drum.
Figure 29B:
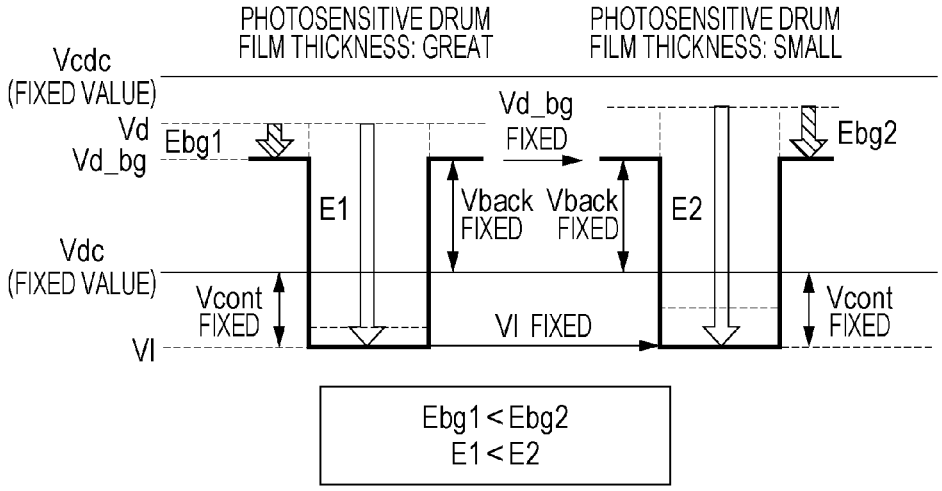

Now, FIGS. 29A and 29B are diagrams illustrating the potentials of the image portion and non-image portion of the surface of the photosensitive drum 5. For example, as illustrated in FIG. 29A, description will be made regarding a case where the developing potential Vdc and charging potential Vd are set so that the back contrast Vback (Vd−Vdc) which is difference between the developing potential Vdc and charging potential Vd at the photosensitive drum 5 having a greater film thickness is a desired state. In this case, the absolute value of the charging potential Vd is great as to the photosensitive drum 5 having a smaller film thickness, so the back contrast Vback increases. When the back contrast Vback increases, toner which was not successfully charged in regular polarity (in the case of reverse developing such as in the present embodiment, toner not charged in negative polarity but 0 to positive polarity) is transferred from the developing roller to the non-image portion, which generates fogging.

Also, in the case of the film thickness of the photosensitive drum 5 being small, the charging potential Vd increases, when the first emitted light quantity for normal emission is constant, so the exposure potential V1 (VL) is also high. Therefore, the developing contrast Vcont (Vdc−V1) which is a difference value between the developing potential Vdc and exposure potential V1 (VL) decreases, and toner is incapable of being sufficiently transferred from the developing roller 8 to the photosensitive drum 5 in an electrostatic manner, which facilitates occurrence of a thin solid black image.

Therefore, the optical scanning device 9 emits light with normal emitted light quantity (first emitted light quantity) as to the image portion of the photosensitive drum 5, emits light with minute emitted light quantity (second emitted light quantity) as to the non-image portion of the photosensitive drum 5, and further changes the first emitted light quantity and second emitted light quantity according to usage situations of the photosensitive drum 5, respectively. Specifically, as illustrated in FIG. 29B, when the film thickness of the photosensitive drum 5 is great, the engine controller 522 causes the LD 401 to emit light with the first emitted light quantity corresponding to exposure amount E1, and with the second emitted light quantity corresponding to exposure amount Ebg1. If we say that the photosensitive drum 5 potential after minute emission is Vdbg, the engine controller 522 set the exposure amount Ebg1 so that the back contrast Vback defined by Vdbg−Vdc becomes a potential where fogging is not generated. Also, when the film thickness of the photosensitive drum 5 is small, the engine controller 522 causes the LD 401 to emit light with the first emitted light quantity corresponding to exposure amount E2 (>E1), and with the second emitted light quantity corresponding to exposure amount Ebg2 (>Ebg1). Thus, the engine controller 522 changes the first emitted light quantity and second emitted light quantity in connection with the usage situations of the photosensitive drum 5, thereby maintaining a constant back contrast Vback and developing contrast Vcont to suppress deterioration in image quality. Note that the term exposure amount means total exposure amount that the unit area of the surface of the photosensitive drum 5 receives. On the other hand, the first emitted light quantity and second emitted light quantity are light quantity that the chip surface (light emitting surface) of the LD 401 emits per unit time. Therefore, if the rotation speed (scanning speed) of the rotating polygon mirror 603, and the rotation speed of the photosensitive drum 5 are constant, increasing the first emitted light quantity increases the exposure amount E, and increasing the second emitted light quantity increases the exposure amount Ebg.

Setting of Emitted Light Quantity According to State of Usage of Photosensitive Drum Description will be made regarding specific setting for changing the first emitted light quantity and second emitted light quantity of the light sources (LD 401Y to LD 401K) according to the thickness (state of usage) of the film thickness of the photosensitive drum 5 as described above. FIGS. 30A and 30B are tables indicating relationship between the usage states of the photosensitive drums (5Y, 5M, 5C, and 5K), and the target value of the emitted light quantity of the corresponding LD 401Y to LD 401K. FIG. 30A indicates the target value of the normal emitted light quantity (first emitted light quantity), and FIG. 30B indicates the target value of the minute emitted light quantity (second emitted light quantity).

Figure 31:
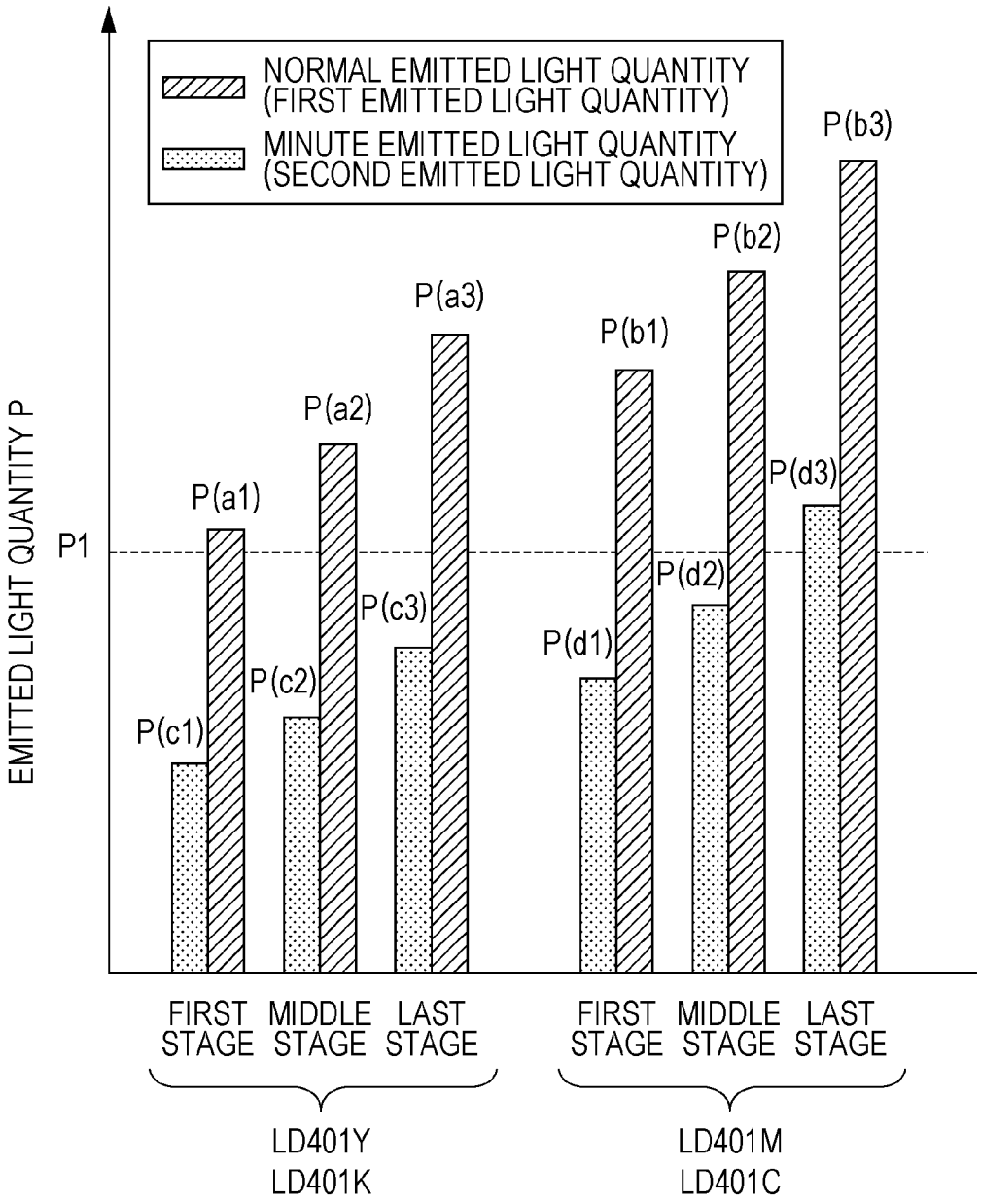
FIG. 31 is a graph illustrating the target values of the amount of the first light and the amount of the second light corresponding to the state of usage of the photosensitive drum.

A parameter relating to the thickness (state of usage) of the film thickness of the photosensitive drum 5 is set as the (cumulative) number of prints at the photosensitive drum 5 in use in the present embodiment. As the (cumulative) number of prints increases, the usage state advances from the first stage to the last stage, and the film becomes thin. FIG. 31 is a graph of emitted light quantities described in FIGS. 30A and 30B. As can be understood from FIG. 31, emitted light quantities to be set satisfy the following relations.

$$P(c1)<P(c2)<P(c3)<P(a1)<P(a2)<P(a3) \quad \text{(i)}$$

$$P(d1)<P(d2)<P(d3)<P(b1)<P(b2)<P(b3) \quad \text{(ii)}$$

$$P(c3)<P(d2)<P(a1)<P(d3) \quad \text{(iii)}$$

Thus, the setting for the emitted light quantities according to the number of prints is performed so as to increase the target values of the normal and minute emitted light quantities as the usage state of the photosensitive drum 5 in usage advances from the first stage to the last stage (as the number of prints increases).

Note that the emitted light quantities differ between the LD 401Y (401K) and the LD 401M (401C) even in the same usage state (the same number of prints). This is because the number of the mirrors 605 provided onto the corresponding optical path differ as described above.

The setting for the emitted light quantities according to the number of prints is performed before image formation. The engine controller 522 obtains information relating to the number of prints of each photosensitive drum 5 in use at that time. Next, the engine controller 522 sets the reference voltage Vref11 and reference voltage Vref21 serving as references at the time of adjusting the first and second emitted light quantities by APC control as to the corresponding light sources (LD 401Y to LD 401K) based on the tables in FIGS. 30A and 30B, respectively. Specifically, the engine controller 522 outputs the PWM1 signal (duty value) to which the reference voltage Vref11 is set, and the PWM2 signal (duty value) to which the reference voltage Vref21 is set, to the laser driving circuit 406.

Note that the (cumulative) number of prints of each photosensitive drum 5 in use is counted by a counter which is not illustrated, and is stored in memory which is not illustrated. Though the information relating to the number of prints (the amount of image formation) is employed as the information (parameter) relating to the film thickness of the photosensitive drum 5 in the present embodiment, the present invention is not restricted to this. For example, there may be employed a value relating to the cumulative number of rotations of the photosensitive drum 5 in use, or a value relating to the cumulative number of rotations of the developing roller 8 or charging roller 7 as the information relating to the film thickness of the photosensitive drum 5. Also, an arrangement may be made in which a toner patch configured to detect toner density is formed on the photosensitive drum 5, the toner density or the like of the toner patch thereof is measured, and information of the measurement result to which the film thickness is reflected is set as the information relating to the film thickness of the photosensitive drum 5. Alternatively, an arrangement may be made in which the film thickness itself of the photosensitive drum 5 or information relating to the film thickness is detected by a sensor, and a detection result thereof is set as the information relating to the film thickness of the photosensitive drum 5.

Stray Light

Figure 32:
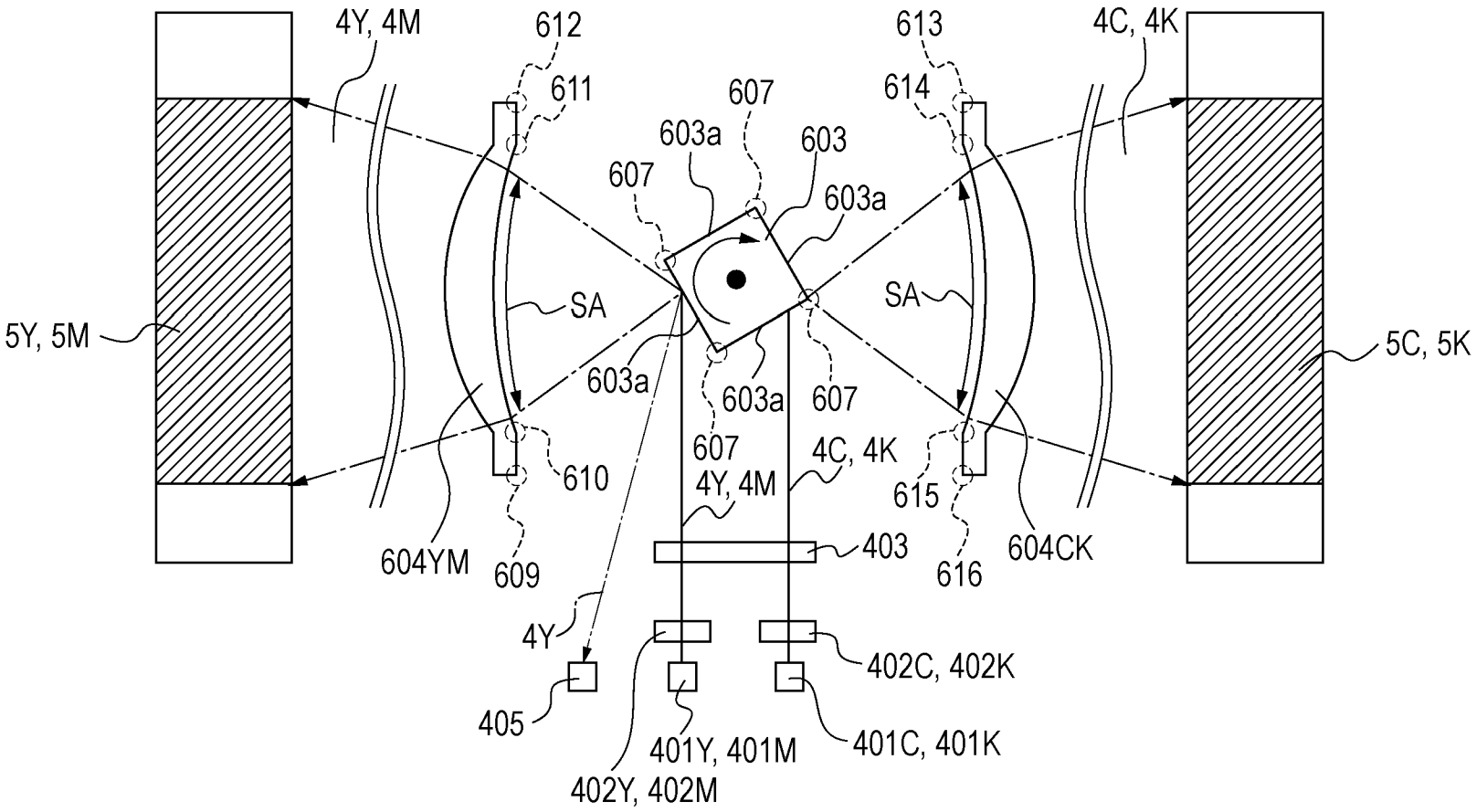
FIG. 32 is a schematic cross-sectional view of an optical scanning device.

Next, stray light generated within the optical scanning device 9 will be described. FIG. 32 is a diagram for describing occurrence of stray light at the optical scanning device 9. In FIG. 32, for simplification, the optical box 9*a*, *f*θ lens 604Y, 604M, 604C, and 604K, and mirrors 605 are omitted.

As illustrated in FIG. 26, the laser beams 4Y to 4K are input to the reflecting surfaces 603*a* of the rotating polygon mirror 603, the fθ lenses 604YM and 604CK, which are provided in the one optical box 9*a*. The rotating polygon mirror 603 has a polygonal shape, and multiple reflecting surfaces 603*a* which reflect the laser light 4 are formed on the side faces thereof. At the time of rotating the rotating polygon mirror 603, upon the laser light 4 being input to a joint portion (a ridge line where the reflecting surfaces intersect) 607 between the multiple reflecting surfaces 603*a*, the reflected laser light may become stray light regardless of which direction the laser light 4 is reflected. Also, when the laser beams 4Y and 4M reflected at the rotating polygon mirror 603 are input to the corner portions 609, 610, 611, and 612 of the fθ lens 604YM as well, the laser light 4 may become stray light regardless of which direction the laser light 4 is directed in. Similarly, when the laser beams 4C and 4K reflected at the rotating polygon mirror 603 are input to the corner portions 613, 614, 615, and 616 of the fθ lens 604CK as well, the laser light 4 may become stray light regardless of which direction the laser light 4 is directed in.

Next, description will be made regarding occurrence timing of stray light in the case of performing deflection scanning of the laser light 4 at the rotating polygon mirror 603. A period since one BD signal was output from the BD sensor 405 until the next BD signal is output is one scanning period. This one scanning period is substantially the same as a period while deflection scanning of the laser light 4 is performed at one reflecting surface of the rotating polygon mirror 604.

Figure 33:
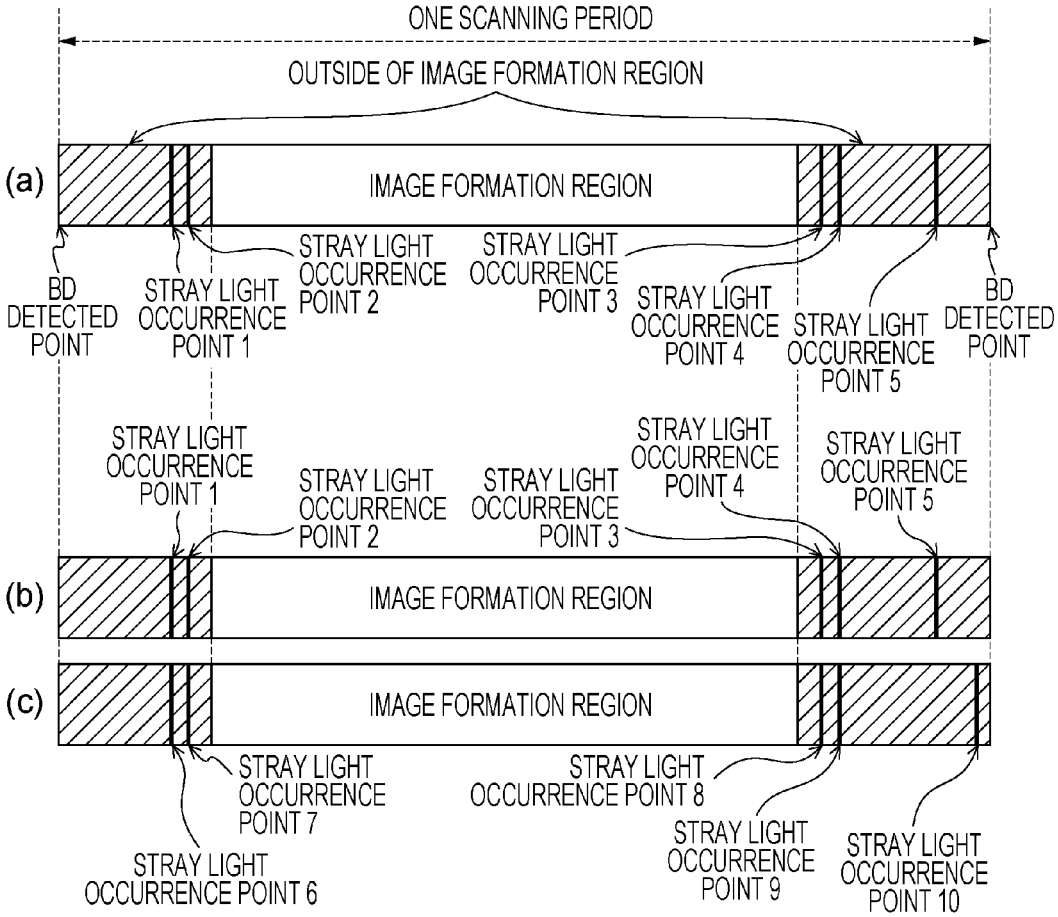
FIG. 33 is a diagram illustrating one scanning period of the image forming apparatus.

(a), (b), and (c) in FIG. 33 are diagrams illustrating stray light occurrence timing during one scanning of the laser beams 4Y, 4M, 4C, and 4K. During a period for performing one scanning, there are an image formation region, and a region other than the image formation region. The image formation region means a period while the laser light 4 is transmitted through an effective region SA (see FIG. 32) of the fθ lens 604 and is irradiated on the photosensitive drum 5, and is a period while the laser light 4 is imaged on the photosensitive drum 5 to form a latent image. Note that the laser beam 4Y alone is input to the BD sensor 405, so input timing thereof is illustrated as a BD detected point in (a) in FIG. 33.

Stray occurrence points 1 to 4 in (a) and (b) in FIG. 33 are timing while the laser beams 4Y and 4M are each input to the corner portions 609, 610, 611, and 612 of the fθ lens 604YM in FIG. 29. A stray occurrence point 5 is a timing at which the laser beams 4Y and 4M are each input to the ridge line 607 of the rotating polygon mirror 603. Stray occurrence points 6 to 9 in (c) in FIG. 33 are timings at which the laser beams 4C and 4K are each input to the corner portions 613, 614, 615, and 616 of the fθ lens 604CK. A stray occurrence point 10 is a timing at which the laser beams 4C and 4K are each input to the ridge line 607 of the rotating polygon mirror 603.

Problem in APC

APC control has to be performed in periods other than the image formation region so as to emit light with desired emitted light quantity in the image formation region. In the case of performing APC in two levels (APC for normal emission (APC for setting the first emitted light quantity), and APC for minute emission (APC for setting the second emitted light quantity)) such as in the case of the LD 401, it takes time for APC control in comparison with a case of performing APC in one level. Therefore, of the period other than the image formation region, there is a possibility that APC control will be performed at a stray light occurrence point. Since APC control forcibly causes the LD 401 to emit light, there is a possibility that when stray light generated at a stray light occurrence point is irradiated on the photosensitive drum 5, an unintended latent image will be formed, which influences image quality in some cases. In particular, there is a possibility that when increasing the scanning speed of the laser light 4 to increase image formation speed, each scanning period is shortened, and the image formation region and regions other than the image formation region are shortened, and consequently, the above problem becomes even more prominent.

Execution Period of APC Control

Next, description will be made regarding a period for performing APC control at the image forming apparatus according to the present embodiment. First, in the case of APC for normal emission, the engine controller 522 causes the LD 401 to emit light with the emitted light quantity of the target value of the first emitted light quantity or emitted light quantity approximate thereto to adjust the first emitted light quantity. The target values of the first emitted light quantity are all emitted light quantities to change the surface of the corresponding photosensitive drum 5 to a potential sufficient for adhering toner on the surface thereof. Therefore, there is a possibility that when performing APC for normal emission at the stray light occurrence points 1 to 10, stray light will influence all of the photosensitive drums 5Y to 5K regardless of the usage states (film thicknesses) of the photosensitive drums 5, an unintended latent image will be formed, and consequently, image quality will deteriorate.

On the other hand, in the case of APC for minute emission, the engine controller 522 causes the LD 401 to emit light with the emitted light quantity of the target value of the second emitted light quantity or emitted light quantity approximate thereto to adjust the second emitted light quantity. The target values of the second emitted light quantity are emitted light quantities to change the surface of the corresponding photosensitive drum 5 to a potential sufficient for preventing toner from being adhered on the surface of the corresponding photosensitive drum 5. Therefore, in the case of APC for minute emission, even if APC for minute emission is performed at the stray light occurrence points 1 to 10, stray light generated as a result thereof does not readily form an unintended latent image, and also image quality does not readily deteriorate.

However, there is a possibility that when performing APC control for minute emission at a stray light occurrence point, stray light generated as a result thereof forms an unintended latent image to disturb the image in some cases. This case will be described. As illustrated in FIG. 31, in the case that the usage situation of the photosensitive drums 5M and 5C on which the light beams of the LDs 401M and 401C are irradiated is the last stage, the target value P (d3) of the second emitted light quantity to be set is greater than the target value P (a1) of the first emitted light quantity in the case that the usage states of the photosensitive drums 5Y and 5K are the first stage. Therefore, there is a possibility that stray light thereof forms a latent image which does not have to be formed, on the photosensitive drums 5Y and 5K, and the latent image thereof disturbs the image. Also, in the case that the usage state of the photosensitive drum 5 is closer to the first stage, the target values of the first emitted light quantity and second emitted light quantity are set low. Therefore, if stray light with constant emitted light quantity has been irradiated on the photosensitive drum 5, when the usage state of the photosensitive drum 5 is closer to the first stage, the potential of a portion where the stray light has been irradiated readily becomes a potential sufficient for toner being readily adhered, so there is a high possibility that the image will be disturbed.

Therefore, the execution period of APC control is set as follows in the present embodiment. In order to set the execution period of APC control, an emitted light quantity threshold P1 of the light source (LD 401) is considered as one reference in the present embodiment. In the case that stray light has been generated by causing the light source (LD 401) to emit light with equal to or greater than the emitted light quantity thereof, the emitted light quantity threshold P1 is the value of emitted light quantity where there is a possibility that the image is disturbed at one of the photosensitive drums 5 of which the usage state is the first stage. Conversely, even when stray light occurs by causing the light source to emit light with lower emitted light quantity than the emitted light threshold P1, influence on the image of the photosensitive drum 5 of which the usage state due to stray light thereof is the first stage is negligible. In the case of the present embodiment, the target value P(a1) of the first emitted light quantity is set greater than the emitted light quantity threshold P1, and the target value P(d2) of the second emitted light quantity is set smaller than the emitted light quantity threshold P1.

Figure 34A:
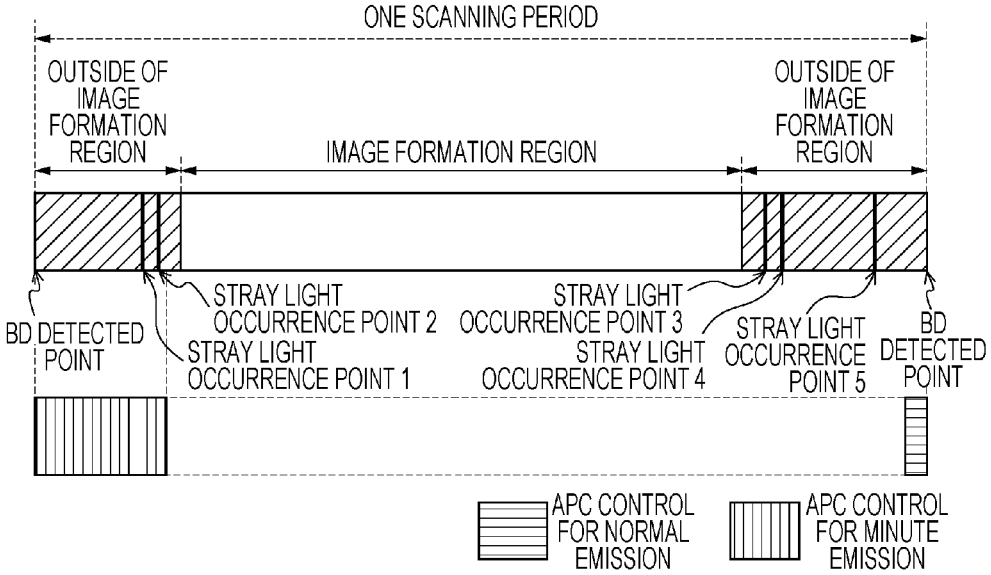
FIGS. 34A and 34B are diagrams illustrating a period for performing APC control within one scanning period.

FIG. 34A is a diagram illustrating the execution period of APC control of the LD 401Y. The engine controller 522 performs APC control for normal emission on the LD 401Y during a period including a BD detected point and not including the stray light occurrence points 1 to 5 regardless of the usage state of the photosensitive drum 5Y. The engine controller 522 performs APC control for minute emission on the LD 401Y during a period including the stray light occurrence points 1 to 5. This is because the target value P (c3) of the second emitted light quantity of the LD 401Y is smaller than the emitted light quantity threshold P1 even when the usage state of the photosensitive drum Y is the last stage.

Figure 34B:
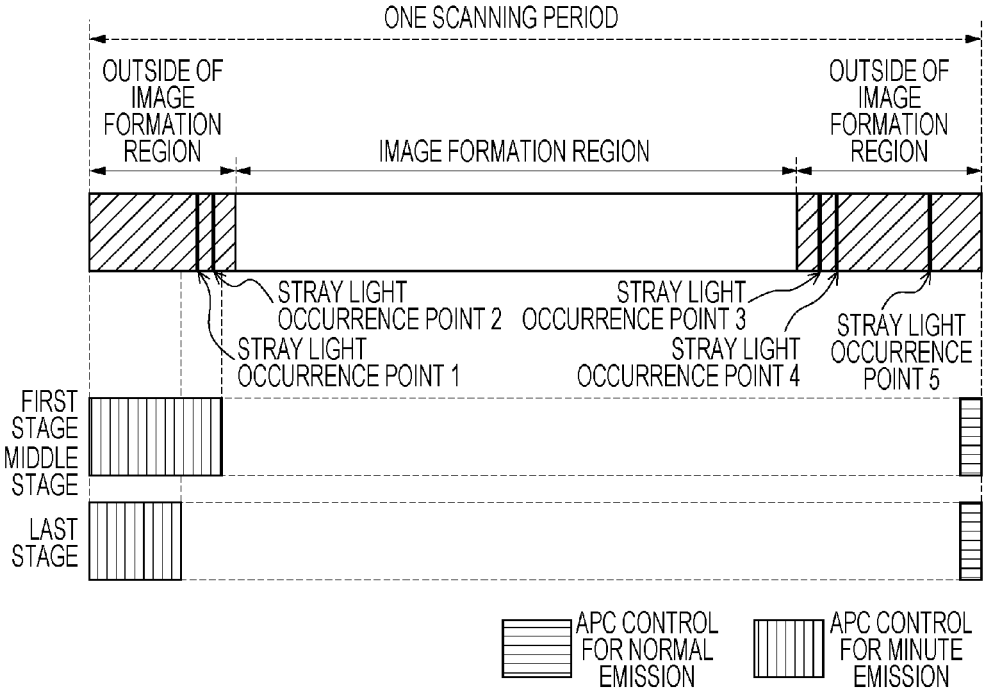

FIG. 34B is a diagram illustrating the execution period of APC control of the LD 401M. The engine controller 522 performs APC control for normal emission on the LD 401M during a period including a BD detected point and not including the stray light occurrence points 1 to 5 regardless of the usage state of the photosensitive drum 5M. On the other hand, in the case of APC control for minute emission, when the usage state of the photosensitive drum 5M is the first or middle state (first state), the target values P(d1) and P(d2) of the second emitted light quantity is set lower than the emitted light quantity threshold P1, so the engine controller 522 performs APC control for minute emission during a period including the stray light occurrence points 1 to 5. On the other hand, when the usage state of the photosensitive drum 5M is the last stage (second state), the target value P(d3) of the second emitted light quantity is set greater than the emitted light quantity threshold P1. Therefore, the engine controller 522 sets the length of the execution period of APC control for minute emission which is an adjustment period for adjusting the second emitted light quantity P shorter than that in the first or middle stage, and performs APC control for minute emission during a period not including the stray light occurrence points 1 to 5.

Note that the reason why the length of the execution period of APC control for minute emission at the time of the target value P(d3) of the second emitted light quantity can be set shorter than that at the time of the target value P(d2) of the second emitted light quantity is as follows. Due to the characteristics of circuits, when converting the monitor current Im into the monitor Vm by the variable resistor 512 at the time of APC control for minute emission (see FIG. 28), it takes time for conversion to the monitor voltage Vm as the monitor current Im is smaller.

Figure 35A:
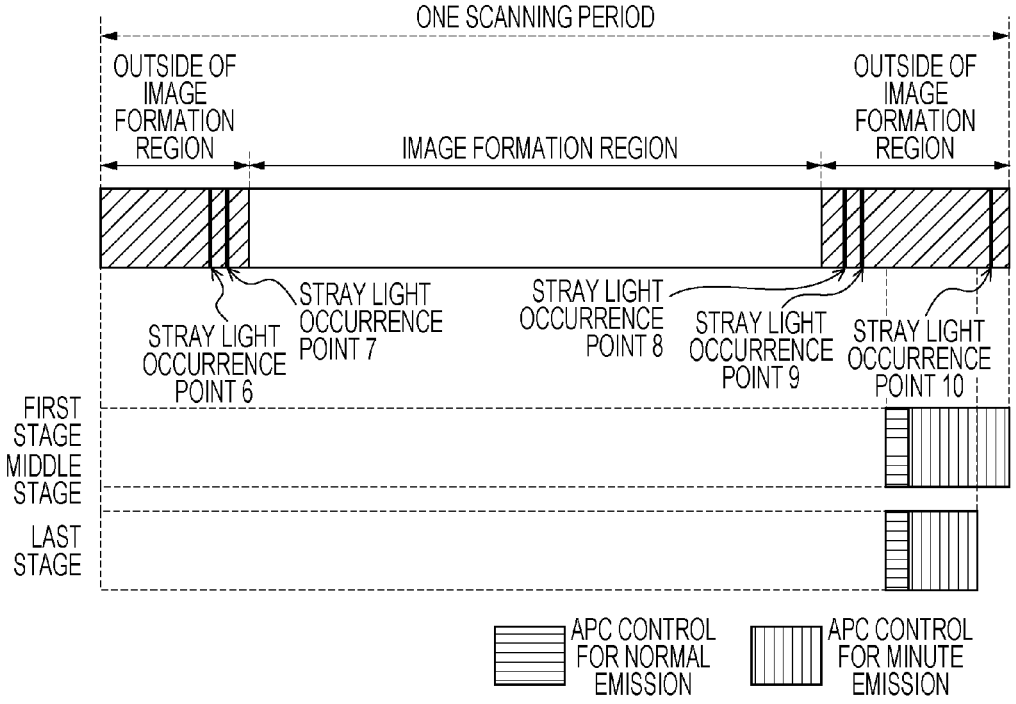
FIGS. 35A and 35B are diagrams illustrating a period for performing APC control within one scanning period.

FIG. 35A is a diagram illustrating the execution period of APC control of the LD 401C. The engine controller 522 performs APC control for normal emission on the LD 401C during a period not including the stray light occurrence points 6 to 10 regardless of the usage state of the photosensitive drum 5C. On the other hand, in the case of APC control for minute emission, when the usage state of the photosensitive drum 5C is the first or middle state, the target values P(d1) and P(d2) of the second emitted light quantity is set lower than the emitted light quantity threshold P1, so the engine controller 522 performs APC control for minute emission during a period including the stray light occurrence points 6 to 10. When the usage state of the photosensitive drum 5C is the last stage, the target value P(d3) of the second emitted light quantity is set greater than the emitted light quantity threshold P1. Therefore, the engine controller 522 sets the length of the execution period of APC control for minute emission shorter than that in the first or middle stage, and performs APC control for minute emission during a period not including the stray light occurrence points 6 to 10.

Figure 35B:
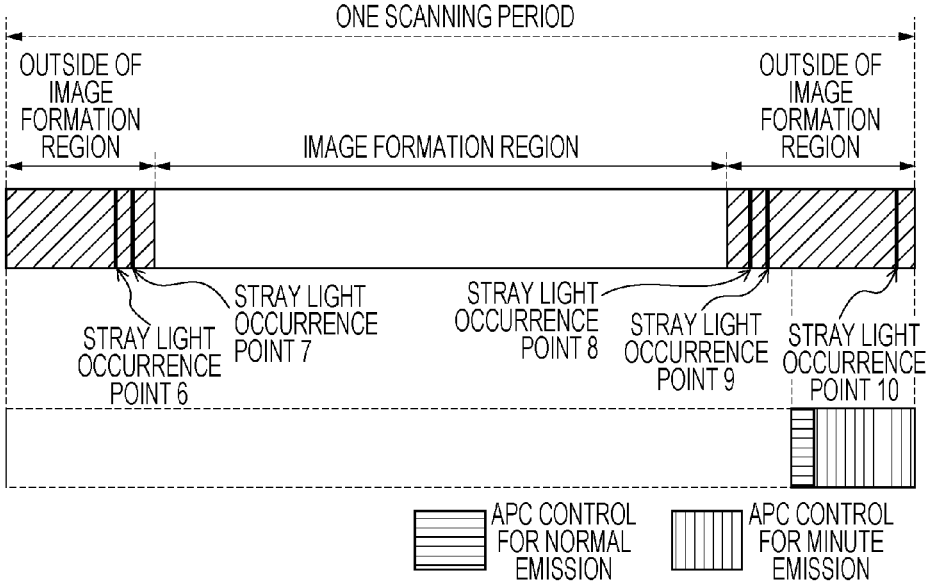

FIG. 35B is a diagram illustrating the execution period of APC control of the LD 401K. The engine controller 522 performs APC control for normal emission on the LD 401K during a period not including the stray light occurrence points 6 to 10 and performs APC control for minute emission during a period including the stray light occurrence points 6 to 10, regardless of the usage state of the photosensitive drum 5K. This is because the target value P(c3) of the second emitted light quantity of the LD 401K is smaller than the emitted light quantity P1 even when the usage state of the photosensitive drum K is the last stage.

Though the emitted light quantity threshold P1 has been set smaller than P(d3) but greater than P(d2) in the present embodiment, the present invention is not restricted to this. For example, an arrangement may be made in which the emitted light quantity P1 is set smaller than P(c3), and the length of the period of APC control for minute emission of the LDs 401Y and 401M is changed. Also, though P(d3) has been set greater than P(a1) in the present embodiment, there is a possibility that even when P(d3) is smaller than P(a1), image defects due to stray light will occur as long as P(d3) is greater than P1. Therefore, as described above, the engine controller 522 has to change the length of the period of APC control for minute emission.

Change of the length of the APC period for minute emission as described above may automatically be determined when the target value of the second emitted light quantity is determined after storing the change thereof in a table along with a value relating to the target value of the second emitted light quantity beforehand.

Another method may be employed in which each time the target value of the second emitted light quantity is updated, the magnitude relationship between the target value of the second emitted light quantity and the emitted light quantity threshold P1 is distinguished using "a parameter relating to the target value of the second emitted light quantity", and the length of the APC period for minute emission is changed based on a distinguished result thereof.

Examples of "a parameter relating to the target value of the second emitted light quantity" include the reference voltage Vref21 (see FIG. 28) which is the target voltage of the second emitted light quantity, and the duty value (see FIG. 28) of the reference value PWM2 signal for setting the reference voltage Vref21 other than the target value of the second emitted light quantity. Also, in the case of a configuration in which the target value of the second emitted light quantity is changed in connection with the thickness of the film thickness of the photosensitive drum 5, a parameter relating to the film thickness of the photosensitive drum 5 (the number of prints, the cumulative amount of rotations, etc.) may be set as "a parameter relating to the target value of the second emitted light quantity".

Also, whether to change the length of the execution period of APC control for minute emission may be determined not only by "a parameter relating to the target value of the second emitted light quantity" but also by further adding the state of usage of another photosensitive drum which the generated stray light may influence. For example, if the target value of the second emitted light quantity to be set is greater than the emitted light quantity threshold P1 regarding the LD 401M, and also, the film thickness of one of the photosensitive drums 5Y, 5C, and 5K is greater than a predetermined value (state closer to the first stage), the engine controller 522 shortens the period of APC control for minute emission. Thus, the usage state of another photosensitive drum is added, a period for performing APC control for minute emission can be maximally secured in comparison with a case of determining whether to change the length of the period for performing APC control for minute emission by "a parameter relating to the target value of the second emitted light quantity" alone. Thus, the second emitted light quantity can be adjusted even more accurately.

Note that a configuration has been described in the present embodiment in which the charging voltage Vcdc and developing voltage Vdc become a fixed value. However, there may be a case where the emitted light quantity of minute emission is changed by considering change in the sensitivity characteristic of the photosensitive drum (variation of the photosensitive drum potential as to exposure amount) and so forth even when the charging voltage Vcdc and developing voltage Vdc are not fixed. In such a case as well, it is effective to change the period for executing APC control for minute emission such as the present embodiment.

As described above, a configuration has been employed in the present embodiment in which the length of the period for executing APC control for minute emission can be changed according to a value relating to the target value of the second emitted light quantity. Further, the length of the period for executing APC control for minute emission is changed, whereby APC control can be suppressed from being performed at timing for stray light with light quantity sufficient for causing image defects to occur being generated, while performing APC control of the emitted light in two levels of normal emission and minute emission.

Fifth Embodiment

A configuration for accurately suppressing occurrence of stray light will be described in the present embodiment. Note that points different from the fourth embodiment will be described in the present embodiment, and the same portions as those in the fourth embodiment will be denoted with the same reference symbols, and description thereof will be omitted.

The emitted light quantity threshold P1 has been set smaller than the target value P(a1) but greater than the target value P(d2) in the fourth embodiment. However, there may be case where the emitted light quantity threshold P1 is set to a further lower value depending on ease of occurrence of stray light due to a device configuration or demanded image quality. Also, in the case of setting a great range of the film thickness of the photosensitive drum 5 in which image formation can be performed, difference between the target value of the second emitted light quantity in the first stage and the target value of the second emitted light quantity in the last stage (e.g., difference between the target value P(c3) and target value P(c1)) increases even at the same light source (e.g., LD 401Y), so the emitted light quantity threshold P1 may be set to a value lower than the target value P(c3) and target value P(c2).

Also, there is a case where difference between the target values of the first and second emitted light quantities is set great depending on the LD 401Y (401K) and LD 401M (401C) even in the usage state of the same photosensitive drum 5 depending on the configuration of the optical member making up an optical path such that difference of the numbers of the mirrors 605 increases depending on the configuration of the optical scanning device 9. In this case as well, the emitted light quantity threshold P1 may be set to a value lower than the target value P(d1).

Therefore, description will be made regarding a configuration capable of handling a lower emitted light quantity threshold P1 in the present embodiment. Specifically, the period for performing APC control is more finely changed according to the target values of the first and second emitted light quantities in the present embodiment. FIGS. 36A and 36B are diagrams illustrating the target values of the first and second light emitted quantities of the LDs 401Y, 401M, 401C, and 401K according to the usage states of the photosensitive drums 5Y, 5M, 5C, and 5K, and the length (time width) of the period for executing APC control. The target value of the emitted light quantity of each light source is the same as that in the fourth embodiment. The set time width of APC control is time used for completing APC control by considering error and so forth at the time of performing APC control with each emitted light quantity as the target value.

As described above, when converting the monitor current Im into the monitor voltage Vm by the variable resistor 512 at the time of APC control for minute emission (see FIG. 28), the smaller the monitor current Im is, the longer conversion to the monitor voltage Vm takes time. Therefore, the smaller the emitted light quantity is, the longer the period minimally necessary for APC control is.

Accordingly, the time width of APC control satisfies the following relations.

$$T(a3)<T(a2)<T(a1)<T(c3)<T(c2)<T(c1) \quad \text{(i)}$$

$$T(b3)<T(b2)<T(b1)<T(d3)<T(d2)<T(d1) \quad \text{(ii)}$$

$$T(d3)<T(a1)<T(d2)<T(c3) \quad \text{(iii)}$$

Figure 37:
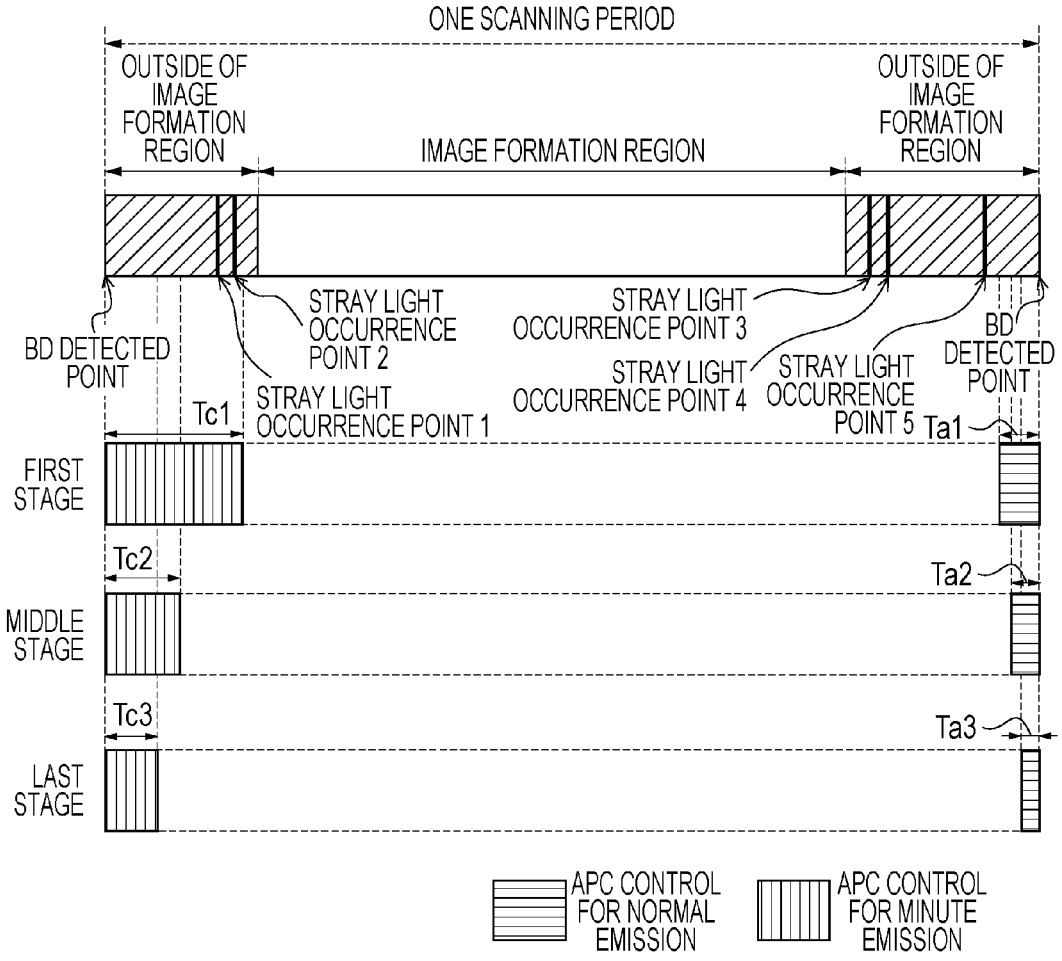
FIG. 37 is a diagram illustrating a period for performing APC control within one scanning period.
Figure 38:
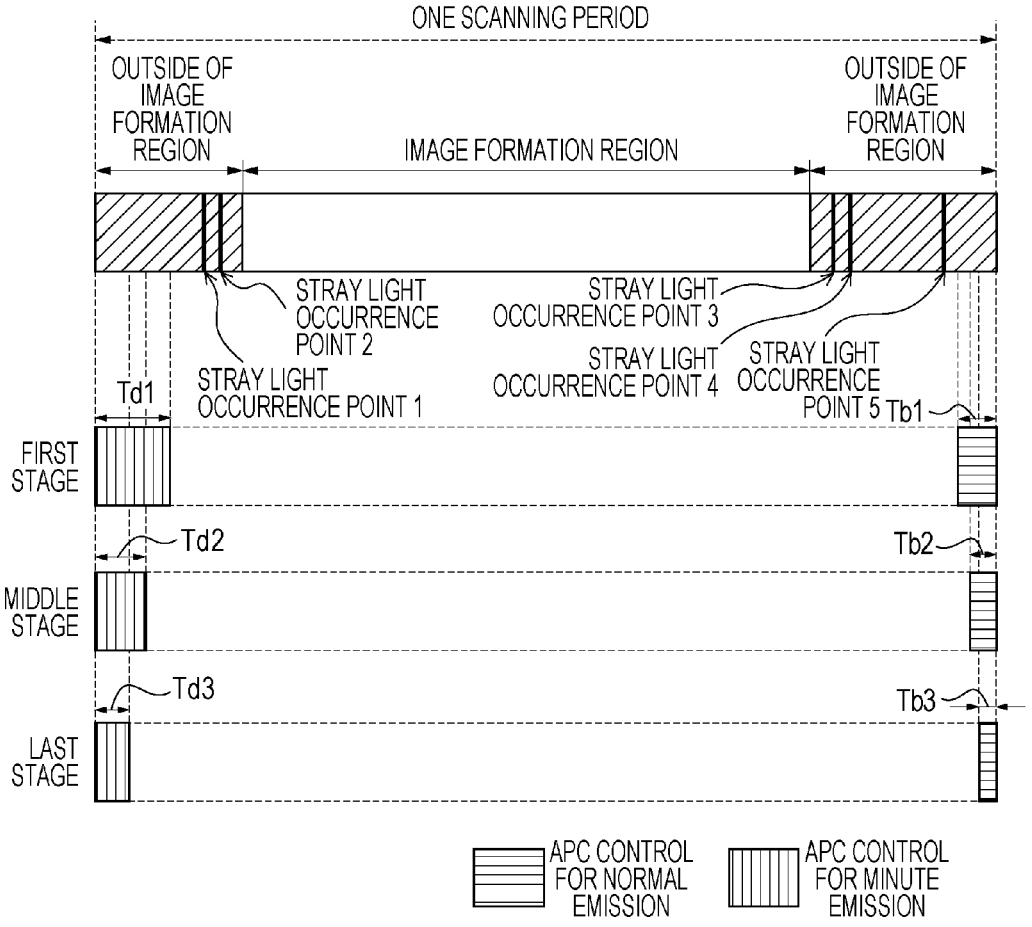
FIG. 38 is a diagram illustrating a period for performing APC control within one scanning period.
Figure 39:
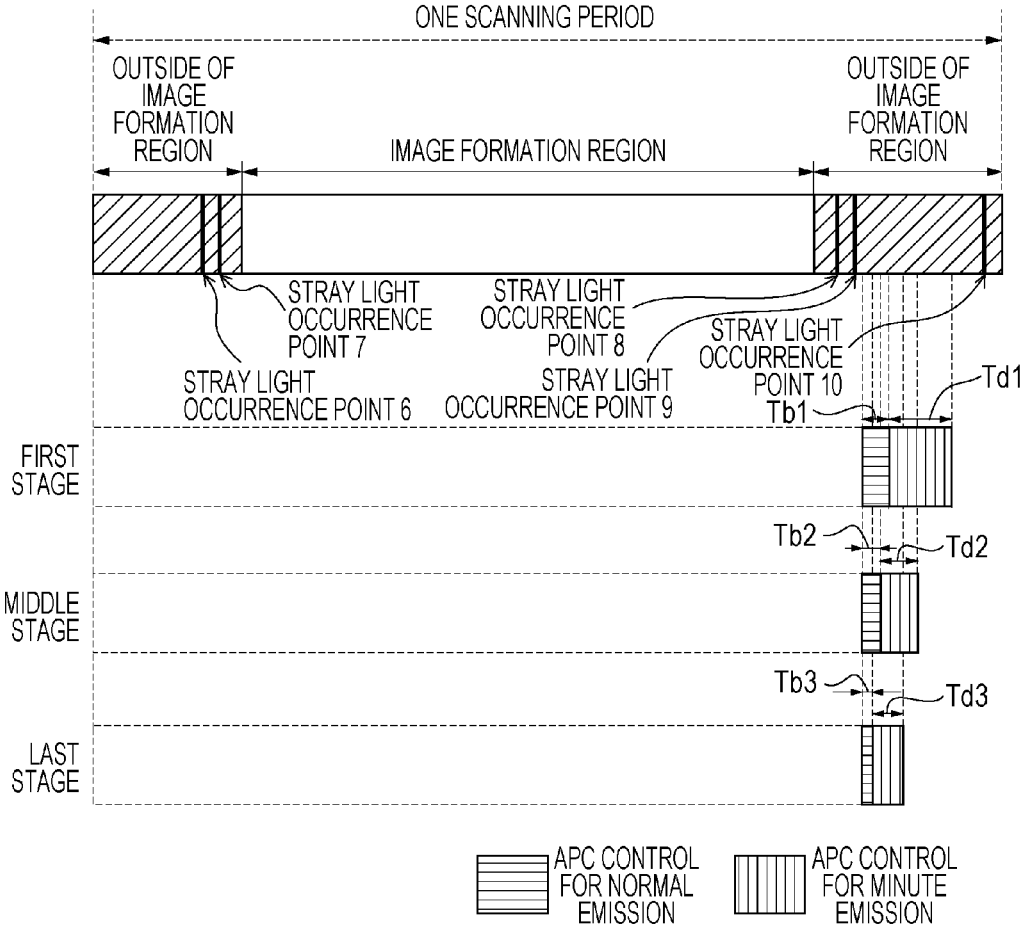
FIG. 39 is a diagram illustrating a period for performing APC control within one scanning period.
Figure 40:
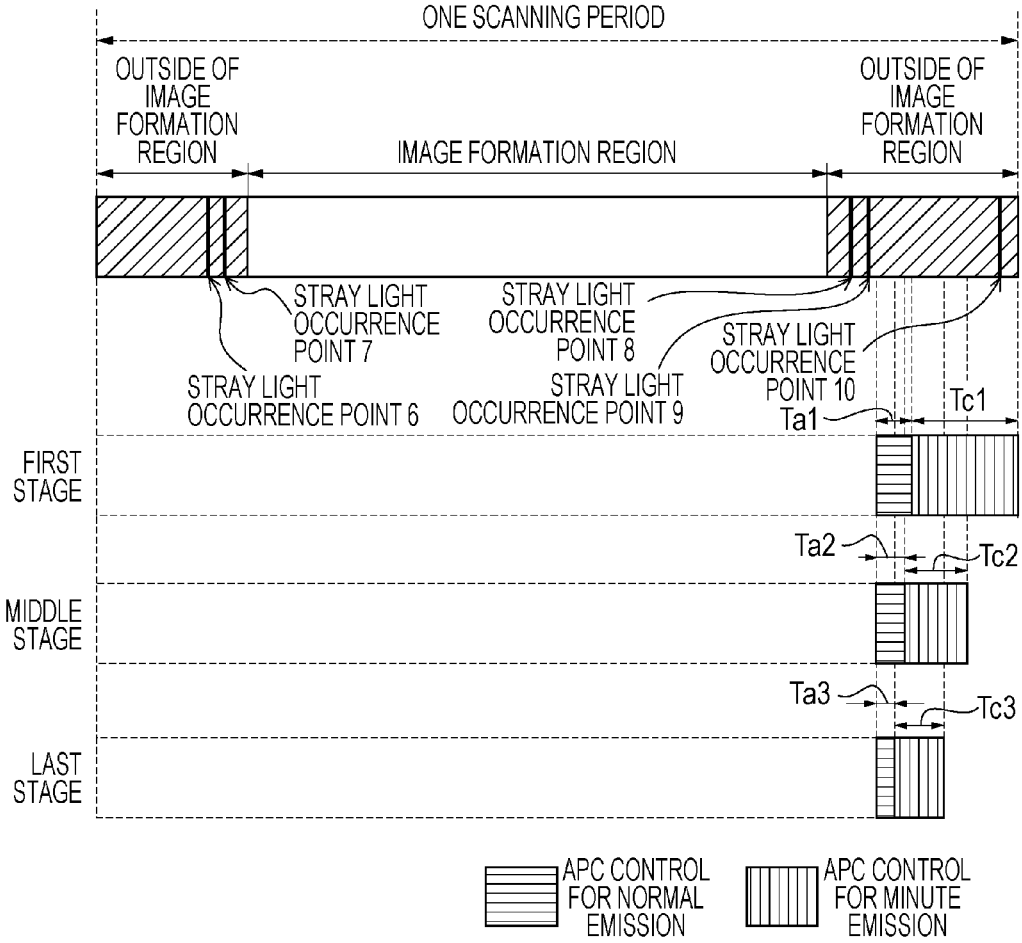
FIG. 40 is a diagram illustrating a period for performing APC control within one scanning period.

FIG. 37 is a diagram illustrating the execution time of APC control of the LD 401Y which is a light source. FIG. 38 is a diagram illustrating the execution time of APC control of the LD 401M which is a light source. FIG. 39 is a diagram illustrating the execution time of APC control of the LD 401C which is a light source. FIG. 40 is a diagram illustrating the execution time of APC control of the LD 401K which is a light source.

As illustrated in FIGS. 37 to 40, the engine controller 522 performs APC control for normal emission of the light sources LDs 401Y to 401K during a period not including the corresponding stray light occurrence points 1 to 5 and 6 to 10 in the same way as that in the fourth embodiment.

Also, the engine controller 522 executes, as illustrate in FIG. 37, the APC control for minute emission of the LD 401Y during a period including the stray light occurrence points 1 and 2 only when the usage state of the photosensitive drum 5 is in the first stage, but does not execute APC control at the stray light occurrence points in other states of usage. As illustrated in FIG. 38, APC control for minute emission of the LD 401M is not executed, regardless of the usage state of the photosensitive drum 5. The engine controller 522 does not execute, as illustrated in FIG. 39, APC control for minute emission of the LD 401C, as well as LD 401M, at the stray light occurrence points regardless of the usage state of the photosensitive drum 5. The engine controller 522 executes, as illustrate in FIG. 40, the APC control for minute emission of the LD 401K during a period including the stray light occurrence point 10 only when the usage state of the photosensitive drum 5 is in the first stage, but does not execute APC control at the stray light occurrence points in other usage states. Thus, if the execution period of APC control for minute emission of the light sources LDs 401Y to 401K is set, even when the emitted light quantity P1 is set to a value smaller than the target value P(c2) but greater than the target value P(c1), APC control can be prevented from being performed at timing where stray light is generated with enough emitted light quantity to cause an image defect to occur.

Thus, the period for performing APC control for normal emission and for minute emission is more finely changed according to the target value of the emitted light quantity of APC control, thereby maximally reducing the period for executing APC control. Thus, APC control can be more accurately prevented from being performed at timing where stray light is generated with enough emitted light quantity to cause an image defect to occur. Accordingly, image defects can be suppressed from occurring due to stray light generated at the time of APC control while performing APC control of the emitted light quantities in two levels for normal emission and for minute emission.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-107467 filed May 21, 2013, No. 2013-107468 filed May 21, 2013 and No. 2013-107469 filed May 21, 2013, which are hereby incorporated by reference herein in their entirety.

What is claimed is:

1. An image forming apparatus comprising:

a photosensitive member;

a light irradiating device, which includes a light source, configured to irradiate light that the light source emits on the photosensitive member;

a developing device configured to adhere toner on the photosensitive member; and a determining unit configured to determine a reference value to be input to the light irradiating device, wherein the light irradiating device causes the light source to emit light with normal emitted light quantity sufficient for adhering toner on an image portion of the photosensitive member, and causes the light source to emit light with minute emitted light quantity smaller than normal emitted light quantity sufficient for preventing toner from being adhered on a non-image portion of the photosensitive member;

wherein the minute emission amount is set based on the reference value to be input to the light irradiating device;

and wherein the determining unit determines the reference value to be input to the light irradiating device based on information relating to relationship between a predetermined reference value, and the light quantity in the position of the photosensitive member at the time of causing the light source to emit light based on the predetermined reference value.

2. The image forming apparatus according to claim 1, wherein the information is a value relating to light quantity in the position of the photosensitive member at the time of causing the light source to emit light in accordance with the predetermined reference value.

3. The image forming apparatus according to claim 2, wherein the information is a value relating to a plurality of light amount corresponding to a plurality of predetermined reference values.

4. The image forming apparatus according to claim 1, wherein the light irradiating device includes an adjusting unit configured to adjust the amount of light emitted from the light source, and a light-receiving unit configured to receive light emitted from the light source;

and wherein the adjusting unit adjusts the minute emission amount based on a reference value to be input to the light irradiating device, and output of the light-receiving unit.

5. The image forming apparatus according to claim 4, wherein the adjusting unit adjusts driving current for causing the light source to emit light.

6. An image forming apparatus comprising:

a photosensitive member;

a light irradiating device, which includes a light source, configured to irradiate light that the light source emits on the photosensitive member;

a developing device configured to adhere toner on the photosensitive member; and a determining unit configured to determine a reference value to be input to the light irradiating device, wherein the light irradiating device causes the light source to emit light with normal emitted light quantity sufficient for adhering toner on an image portion of the photosensitive member, and causes the light source to emit light with minute emitted light quantity smaller than normal emitted light quantity sufficient for preventing toner from being adhered on a non-image portion of the photosensitive member;

wherein the minute emission amount is set based on the reference value to be input to the light irradiating device;

and wherein the determining unit determines the reference value to be input to the light irradiating device based on information relating to relationship between predetermined light quantity, and a reference value for causing the light source to emit light so that the light quantity at the position of the photosensitive member becomes the predetermined light quantity.

7. The image forming apparatus according to claim 6, wherein the information is a value relating to a reference value for causing the light source to emit light so that the light quantity in the position of the photosensitive member becomes the predetermined light quantity.

8. The image forming apparatus according to claim 7, wherein the information is a value relating to a plurality of reference values corresponding to a plurality of the predetermined light quantity.

9. The image forming apparatus according to claim 6, wherein the light irradiating device includes an adjusting unit configured to adjust the amount of light emitted from the light source, and a light-receiving unit configured to receive light emitted from the light source;

and wherein the adjusting unit adjusts the minute emission amount based on a reference value to be input to the light irradiating device, and output of the light-receiving unit.

10. The image forming apparatus according to claim 9, wherein the adjusting unit adjusts driving current for causing the light source to emit light.

11. An image forming apparatus comprising:

a photosensitive member;

a light irradiating device causing a light source to emit light to irradiate light on the photosensitive member; and a developing device configured to adhere toner on the photosensitive member, wherein the light irradiating device emits light with first emission amount on an image portion of the surface of the photosensitive member where the toner is adhered so as to obtain potential sufficient for adhering the toner on the image portion, and emits light with second emission amount smaller than the first emission amount on a non-image portion of the surface of the photosensitive member where no toner is adhered so as to obtain potential sufficient for not adhering the toner on the non-image portion;

wherein the light irradiating device moves the light that the light irradiating device irradiates, in the scanning direction on the surface of the photosensitive member, thereby forming a latent image on the photosensitive member, and emits light with the second emission amount on a marginal portion of a portion corresponding to the surface of a recording member of the surface of the photosensitive member where no latent image is formed;

and wherein the light irradiating device starts emission from an emission start position further upstream than a region corresponding to the surface of the recording member regarding the scanning direction, and is capable of changing the emission start position.

12. The image forming apparatus according to claim 11, wherein the emission start position in the case that a target value of the second emission amount is a second target value greater than the first target value is positioned further downstream in the scanning direction than the emission start position in the case that a target value of the second emission amount is a first target value.

13. The image forming apparatus according to claim 11, wherein the light irradiating device changes the emission start position based on information relating to the film thickness of the photosensitive member.

14. The image forming apparatus according to claim 13, wherein the information relating to the film thickness of the photosensitive member is the cumulative number of rotations of the photosensitive member.

15. The image forming apparatus according to claim 13, wherein the information relating to the film thickness of the photosensitive member is amount of image formation performed by the photosensitive member.

16. The image forming apparatus according to claim 11, wherein the emission start position is changed based on the target value of the second emission amount.

17. The image forming apparatus according to claim 16, wherein the target value of the second emission amount is changed based on the information relating to the film thickness of the photosensitive member.

18. The image forming apparatus according to claim 11, wherein the light irradiating device emits light with the second emission amount when the light that the light irradiating device irradiates reaches an edge portion farthest upstream in the scanning direction of a region corresponding to the surface of the recording member of the photosensitive member.

19. The image forming apparatus according to claim 11, wherein the scanning direction is a direction where the surface of the photosensitive member moves as to the light irradiating device intersects with the moving direction of the surface of the photosensitive member.

20. The image forming apparatus according to claim 19, wherein the light irradiating device, which includes a rotating polygon mirror configured to reflect light that the light source emits, moves the light that the light irradiating device irradiates to the scanning direction on the surface of the photosensitive member.

21. The image forming apparatus according to claim 20, wherein the light irradiating device includes a lens configured to input the light from the light source reflected at the rotating polygon mirror, and a supporting portion configured to support the lens;

wherein an attachment portion pressed by a pressing member and fixed to the supporting portion is provided to the lens;

and wherein the emission start position is further downstream in the scanning direction than a position where the light from the light source reflected at the rotating polygon mirror input to the attachment portion and the pressing member.

22. The image forming apparatus according to claim 11, further comprising:

another photosensitive member, wherein the light irradiating device includes a plurality of the light sources configured to irradiate light on each of the photosensitive member and the other photosensitive member.

23. The image forming apparatus according to claim 22, further comprising:

a charging device configured to apply a charging voltage to each of the photosensitive member and the other photosensitive member to charge the surfaces of the photosensitive member before light is irradiated from the light irradiating device and the other photosensitive member, wherein the charging voltages that the charging device applies to the photosensitive member and the other photosensitive member respectively are substantially the same bias.

24. The image forming apparatus according to claim 22, wherein the developing device applies developing voltage to each of the photosensitive member after light is irradiated from the light irradiating device, and the other photosensitive member, and the developing voltages to which the developing device applies the photosensitive member and the other photosensitive member respectively are substantially the same voltage.

25. An image forming apparatus comprising:

a photosensitive member;

a light irradiating device causing a light source to emit light to irradiate light on the photosensitive member;

a developing device configured to adhere toner on the photosensitive member; and an adjusting unit configured to cause the light source to emit light and to adjust the amount of light emitted from the light source so that the amount of light thereof becomes a target value of second emission amount, wherein the light irradiating device emits light with first emission amount on an image portion of the surface of the photosensitive member where the toner is adhered so as to obtain potential sufficient for adhering the toner on the image portion, and emits light with second emission amount smaller than the first emission amount on a non-image portion of the surface of the photosensitive member where no toner is adhered so as to obtain potential sufficient for not adhering the toner on the non-image portion;

wherein the length of an adjustment period of the adjustment by the adjusting unit is changeable.

26. The image forming apparatus according to claim 25, wherein the adjusting unit changes the length of the adjustment period based on the information relating to the film thickness of the photosensitive member.

27. The image forming apparatus according to claim 26, wherein the information relating to the film thickness of the photosensitive member is the cumulative number of rotations of the photosensitive member.

28. The image forming apparatus according to claim 26, wherein the information relating to the film thickness of the photosensitive member is amount of image formation performed by the photosensitive member.

29. The image forming apparatus according to claim 26, wherein the target value of the second emission amount is changed based on the information relating to the film thickness of the photosensitive member.

30. The image forming apparatus according to claim 29, wherein the smaller the film thickness of the photosensitive member becomes, the greater the target value of the second emission amount becomes.

31. The image forming apparatus according to claim 30, wherein, assuming that a state in which the target value of the second emission amount is smaller than a predetermined value is a first state, and a state in which the target value of the second emission amount is greater than a predetermined value, the length of the adjustment period of the adjustment in the second state is shorter than the length of the adjustment period of the adjustment in the first state.

32. The image forming apparatus according to claim 31, wherein the light irradiating device includes a rotating polygon mirror in which there are formed a plurality of reflecting surfaces to which the light from the light source is input, and a lens to which the light from the light source is input;

wherein the adjustment period of the adjustment in the second state does not include a joint portion between a plurality of reflecting surfaces of the rotating polygon mirror, or timing of light being input to a corner portion of the lens.

33. The image forming apparatus according to claim 25, wherein the target value of the second emission amount is changed based on the information relating to the film thickness of the photosensitive member, and the adjusting unit changes the length of the adjustment period based on the target value of the second emission amount.

34. The image forming apparatus according to claim 25, further comprising:

another photosensitive member, wherein the light irradiating device includes a plurality of the light sources configured to irradiate light on each of the photosensitive member and the other photosensitive member.

35. The image forming apparatus according to claim 34, wherein the light irradiating device includes a plurality of lenses through which the light emitted from the plurality of the light sources passes respectively, and an optical box housing the plurality of lenses.

36. The image forming apparatus according to claim 34, further comprising:

a charging device configured to apply a charging voltage to each of the photosensitive member and the other photosensitive member to charge the surfaces of the photosensitive member before the light irradiating device irradiates light thereupon and the other photosensitive member, wherein the charging voltages that the charging device applies to the photosensitive member and the other photosensitive member respectively are substantially the same bias.

37. The image forming apparatus according to claim 34, wherein the developing device applies developing voltage to each of the photosensitive member after light is irradiated from the light irradiating device, and the other photosensitive member, and the developing voltages to which the developing device applies the photosensitive member and the other photosensitive member respectively are substantially the same voltage.

* * * * *